US011827500B2

(12) United States Patent
Goncalves et al.

(10) Patent No.: US 11,827,500 B2
(45) Date of Patent: Nov. 28, 2023

(54) ASSISTIVE ROBOT SYSTEMS FOR TRANSPORTING CONTAINERS

(71) Applicant: Toyota Research Institute, Inc., Los Altos, CA (US)

(72) Inventors: Aimee S. Goncalves, Kingston, MA (US); Joseph Bondaryk, Brookline, MA (US); Paul W. Baim, Natick, MA (US); Christopher Gidwell, Sherborn, MA (US); Toffee Albina, Cambridge, MA (US)

(73) Assignee: TOYOTA RESEARCH INSTITUTE, INC., Los Altos, CA (US)

( * ) Notice: Subject to any disclaimer, the term of this patent is extended or adjusted under 35 U.S.C. 154(b) by 1006 days.

(21) Appl. No.: 16/560,341

(22) Filed: Sep. 4, 2019

(65) Prior Publication Data

US 2020/0207597 A1 Jul. 2, 2020

Related U.S. Application Data

(60) Provisional application No. 62/785,495, filed on Dec. 27, 2018.

(51) Int. Cl.
*B66F 5/02* (2006.01)

(52) U.S. Cl.
CPC ..... *B66F 5/02* (2013.01)

(58) Field of Classification Search
CPC ..... B66F 5/02; B66F 9/18; B66F 9/186
See application file for complete search history.

(56) References Cited

U.S. PATENT DOCUMENTS 2,807,382 A * 9/1957 Schenkelberger ..... B66F 9/18 414/622
3,870,180 A * 3/1975 Snelling, Jr. ..... B66F 9/186 294/81.1
3,982,645 A * 9/1976 Brink ..... B66F 9/186 414/607

(Continued)

FOREIGN PATENT DOCUMENTS

CA 2949306 A1 5/2018
CN 101897641 12/2011

(Continued)

OTHER PUBLICATIONS

McGinn, Conor, et al., "Design of a terrain adaptive wheeled robot for human-orientated environments," https://link.springer.com/article/10.1007/s10514-018-9701-1; Published Date: Feb. 13, 2018.

(Continued)

*Primary Examiner* — Seahee Hong
(74) *Attorney, Agent, or Firm* — Dinsmore & Shohl LLP

(57) ABSTRACT

Embodiments described herein related to a robotic system for transporting a container. The robotic system includes a lifting mechanism and a container storage assembly coupled to the lifting mechanism. The container storage assembly includes at least one bracket assembly that further includes a bracket elongated member. The bracket elongated member includes a surface having at least one slot and a locking mechanism within the at least one slot. The at least one slot and the locking mechanism are configured to slidably receive and positively lock at least one locking member of the container.

9 Claims, 32 Drawing Sheets

(56) References Cited

U.S. PATENT DOCUMENTS

| | | | | |
|---|---|---|---|---|
| 4,354,794 | A * | 10/1982 | Macnab | B66F 9/186 294/81.1 |
| 4,983,094 | A * | 1/1991 | Ping | B66F 9/186 294/81.1 |
| 5,544,860 | A * | 8/1996 | Craig | B66B 9/025 254/7 R |
| 6,113,343 | A | 9/2000 | Goldenberg et al. | |
| 6,328,120 | B1 | 12/2001 | Haeussler et al. | |
| 6,523,629 | B1 | 2/2003 | Buttz et al. | |
| 6,644,426 | B1 | 11/2003 | Larue | |
| 6,896,078 | B2 | 5/2005 | Wakui | |
| 7,137,464 | B2 | 11/2006 | Stahler | |
| 7,152,869 | B2 | 12/2006 | Dupay et al. | |
| 7,255,238 | B2 * | 8/2007 | Ikeya | B66C 13/085 212/331 |
| 7,424,923 | B2 | 9/2008 | Yang et al. | |
| 7,426,970 | B2 | 9/2008 | Olsen | |
| 7,434,638 | B2 | 10/2008 | Tanielian | |
| 7,475,745 | B1 | 1/2009 | DeRoos | |
| 7,581,746 | B2 | 9/2009 | Abate et al. | |
| 7,645,110 | B2 | 1/2010 | Ogawa et al. | |
| 7,721,829 | B2 | 5/2010 | Lee et al. | |
| 8,066,298 | B2 | 11/2011 | Alguera et al. | |
| 8,083,013 | B2 | 12/2011 | Bewley et al. | |
| 8,162,351 | B2 | 4/2012 | Lee et al. | |
| 8,307,923 | B2 | 11/2012 | Lin et al. | |
| 8,360,178 | B2 | 1/2013 | Goldenberg et al. | |
| 8,753,155 | B2 | 6/2014 | Olm et al. | |
| 8,840,128 | B2 | 9/2014 | Glazner | |
| 8,840,130 | B2 | 9/2014 | Columbia | |
| 8,875,815 | B2 | 11/2014 | Terrien et al. | |
| 8,915,692 | B2 | 12/2014 | Grinnell et al. | |
| 9,032,831 | B2 | 5/2015 | Sutherland | |
| 9,096,281 | B1 | 8/2015 | Li et al. | |
| 9,248,875 | B2 | 2/2016 | Wolf et al. | |
| 9,248,876 | B2 | 2/2016 | Nuchter et al. | |
| 9,283,681 | B2 | 3/2016 | Slawinski et al. | |
| 9,314,921 | B2 | 4/2016 | Jacobsen et al. | |
| 9,314,929 | B2 | 4/2016 | Hyde et al. | |
| 9,387,892 | B2 | 7/2016 | Gettings et al. | |
| 9,387,895 | B1 | 7/2016 | Theobald et al. | |
| 9,463,574 | B2 | 10/2016 | Purkayastha et al. | |
| 9,475,193 | B2 | 10/2016 | Bosscher et al. | |
| 9,527,213 | B2 | 12/2016 | Luo et al. | |
| 9,586,636 | B1 | 3/2017 | Burmeister et al. | |
| 9,616,948 | B2 | 4/2017 | Ben-Tzvi et al. | |
| 9,724,829 | B2 | 8/2017 | Hyde et al. | |
| 9,726,268 | B1 | 8/2017 | Krasowski et al. | |
| 9,776,333 | B2 | 10/2017 | Sakai et al. | |
| 9,808,383 | B2 | 11/2017 | Mulhern et al. | |
| 9,902,069 | B2 | 2/2018 | Farlow et al. | |
| 2003/0118431 | A1 * | 6/2003 | Marrero | B66F 9/10 414/667 |
| 2003/0137268 | A1 | 7/2003 | Papanikolopoulos et al. | |
| 2004/0265106 | A1 * | 12/2004 | Charvet | B66F 9/12 414/623 |
| 2008/0302586 | A1 | 12/2008 | Yan | |
| 2010/0025964 | A1 | 2/2010 | Fisk et al. | |
| 2013/0231814 | A1 | 9/2013 | Sarokhan et al. | |
| 2014/0379198 | A1 | 12/2014 | Amino et al. | |
| 2016/0090284 | A1 * | 3/2016 | Svensson | B66F 9/0755 701/50 |
| 2016/0311479 | A1 | 10/2016 | Rudakevych et al. | |
| 2017/0066132 | A1 | 3/2017 | Casey et al. | |
| 2017/0280960 | A1 | 10/2017 | Ziegler et al. | |
| 2018/0043530 | A1 | 2/2018 | Goldenberg et al. | |
| 2018/0065242 | A1 | 3/2018 | Tanaka et al. | |
| 2018/0071909 | A1 | 3/2018 | Bewley et al. | |
| 2018/0118553 | A1 * | 5/2018 | Cohen | B66F 9/07581 |
| 2019/0232992 | A1 | 8/2019 | Bondaryk et al. | |

FOREIGN PATENT DOCUMENTS

| | | | |
|---|---|---|---|
| CN | 101712199 | B | 7/2012 |
| CN | 102718012 | B | 11/2014 |
| CN | 203993868 | U | 12/2014 |
| CN | 103568018 | B | 9/2015 |
| CN | 105598937 | A | 5/2016 |
| CN | 105666474 | A | 6/2016 |
| CN | 105269593 | B | 8/2016 |
| CN | 205441615 | U | 8/2016 |
| CN | 106272478 | A | 1/2017 |
| CN | 206296921 | U | 7/2017 |
| CN | 107150336 | A | 9/2017 |
| CN | 206748412 | U | 12/2017 |
| CN | 107618026 | A | 1/2018 |
| CN | 207669294 | U | 7/2018 |
| CN | 108466278 | A | 8/2018 |
| EP | 1290935 | B1 | 9/2006 |
| JP | 2885367 | B2 | 4/1999 |
| JP | 2001225754 | | 8/2001 |
| JP | 2004195592 | A | 7/2004 |
| JP | 2009166181 | A | 7/2009 |
| JP | 2017164872 | A | 9/2017 |
| WO | 2014162605 | | 10/2014 |
| WO | 2017088048 | | 6/2017 |
| WO | 2017191591 | A1 | 11/2017 |

OTHER PUBLICATIONS

"StairKing battery powered stair climbing appliance truck," https://catalog.wescomfg.com/item/all-categories/liftkar-hd-stairking-and-stair-climbing-trucks/230051-1?plpver=1001 Accessed Date: Sep. 19, 2018.

"Toru", Sep. 19, 2018; URL: https://www.magazino.eu/toru-cube/?lang=en.

The difference between cartesian, six-Axis, and SCARA robots; Published Date: Dec. 2, 2013; URL: https://www.machinedesign.com/motion-control/difference between-cartesian-six-axis-and-scararobots.

* cited by examiner 113b
804a
802a
808
806
810b
807
810a
$X_1$
122c
122b
804b
802c
122a
802b
812b
812a $X_2$

ASSISTIVE ROBOT SYSTEMS FOR TRANSPORTING CONTAINERS

CROSS REFERENCE TO RELATED APPLICATIONS

This utility patent application claims priority from U.S. Provisional Patent Application Ser. No. 62/785,495, filed on Dec. 27, 2018, the entire contents of which is incorporated herein in its entirety.

TECHNICAL FIELD

The present specification generally relates to portable robot systems and, more particularly, to assistive robot systems that grip, raise, store, and transport containers.

BACKGROUND

Certain people may have difficulty with transporting items, such as large, bulky and/or heavy items. For example, people may struggle with the tasks required to lift a container, transport and/or store the container, and remove the container from storage and/or place the container somewhere else, such as onto a shelf. That is, people may be required to complete a number of tasks that may be physically taxing, such as lifting a container full of items and/or placing the container onto the shelf or into storage areas.

Accordingly, alternative systems for assisting users with lifting, carrying and storing containers is desired.

SUMMARY

In one embodiment, a robotic system for transporting a container is provided. The robotic system includes a lifting mechanism and a container storage assembly coupled to the lifting mechanism. The container storage assembly includes at least one bracket assembly that further includes a bracket elongated member. The bracket elongated member includes a surface having at least one slot and a locking mechanism within the at least one slot. The at least one slot and the locking mechanism are configured to slidably receive and positively lock at least one locking member of the container.

In another embodiment, an assistive robotic system for transporting a container is provided. The assistive robotic system includes a lifting mechanism, a container storage assembly coupled to the lifting mechanism, a processing device communicatively coupled to the lifting mechanism and the movable arm assembly, and a non-transitory, processor-readable storage medium in communication with the processing device. The container storage assembly includes at least one bracket assembly. The non-transitory, processor-readable storage medium includes one or more programming instructions that, when executed, cause the processing device to transmit a command to the lifting mechanism to cause the lifting mechanism to move the movable arm assembly such that the movable arm assembly grips the container, transmit a first one or more signals to the movable arm assembly to cause the movable arm assembly to move in a system longitudinal direction such that the container gripped by the movable arm assembly is positioned at the at least one bracket assembly of the container storage assembly, and transmit a second one or more signals to the movable arm assembly to cause the movable arm assembly to move such that the container gripped by the movable arm assembly is released from the movable arm assembly and stored on the at least one bracket assembly of the container storage assembly.

In yet another embodiment, an assistive robotic system for transporting a container is provided. The assistive robotic system includes a drive mechanism having a motor, one or more wheels coupled to the drive mechanism that drives movement of the one or more wheels, a lifting mechanism coupled to the drive mechanism, a container storage assembly coupled to the lifting mechanism, a movable arm assembly coupled to the lifting mechanism, a processing device communicatively coupled to the lifting mechanism, the movable arm assembly and the drive mechanism, and a non-transitory, processor-readable storage medium communicatively coupled to the processing device. The container storage assembly comprising at least one bracket assembly. The non-transitory, processor-readable storage medium includes one or more programming instructions stored thereon that, when executed by the processing device, cause the processing device to determine a grip position of the container to receive the movable arm assembly, generate at least one movement command that corresponds to one or more movements for the drive mechanism, the lifting mechanism and the movable arm assembly wherein the one or more movement commands correspond to the movement command to grip the container, and transmit one or more movement commands to the movable arm assembly and the lifting mechanism, wherein the one or more movement commands correspond to the movement command to move the container to a pre-dock position. The non-transitory, processor-readable storage medium includes one or more programming instructions stored thereon that, when executed by the processing device, further cause the processing device to determine a storage position of the container within the container storage assembly, transmit one or more movement commands to the movable arm assembly and the lifting mechanism, wherein the one or more movement commands correspond to the movement command to dock the container within the container storage assembly, and generate at least one movement command to the movable arm assembly and the lifting mechanism, wherein the one or more movement commands correspond to the movement command to release the container.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and example in nature and not intended to limit the subject matter defined by the claims. The following detailed description of the illustrative embodiments can be understood when read in conjunction with the following drawings, wherein like structure is indicated with like reference numerals and in which:

DETAILED DESCRIPTION

The present disclosure relates generally to robot systems that raise, lower, extend, retract, store and/or transport objects, such as containers, thereby providing versatility in the type and transportation of the containers relative to other systems. The robot systems described herein are capable of lifting, lowering, gripping, storing and placing a plurality of containers. Further, the robots systems described herein may store more than one container and/or may raise or lower one container while storing other containers. The robot systems described herein are not limited by this disclosure, and may generally be any robot systems configured to assist humans with everyday tasks, such as robot systems that lift and lower containers, store and transport containers, and/or the like. The robot systems described herein generally include various components that couple/decouple the robot systems from a plurality of varied shaped containers.

Although embodiments herein are described in the context of shopping and delivery robots, embodiments are not limited thereto. For example, the robot systems described herein may be used for various healthcare purposes, manufacturing purposes, and/or the like. Further, the robot systems described herein may be used for indoor and/or outdoor applications. Other uses should generally be understood and are included within the scope of the present disclosure.

As used herein, the term "assistive robot system" refers to any robot system that is capable of raising, lowering, placing, removing, transporting, storing, gripping, releasing, and/or the like a plurality of containers. That is, the assistive robot systems described herein are not limited to robot systems that are designed for a particular use, but rather any robot system that has the container transportation capabilities as described herein.

As used herein, the term "container" refers to any object that is capable of being raised, lowered, placed, stored, transported, gripped, released, tilted, and the like, and that is capable of holding at least one article or anther object to be emptied or removed from the container during the tilting process.

Figure 1:
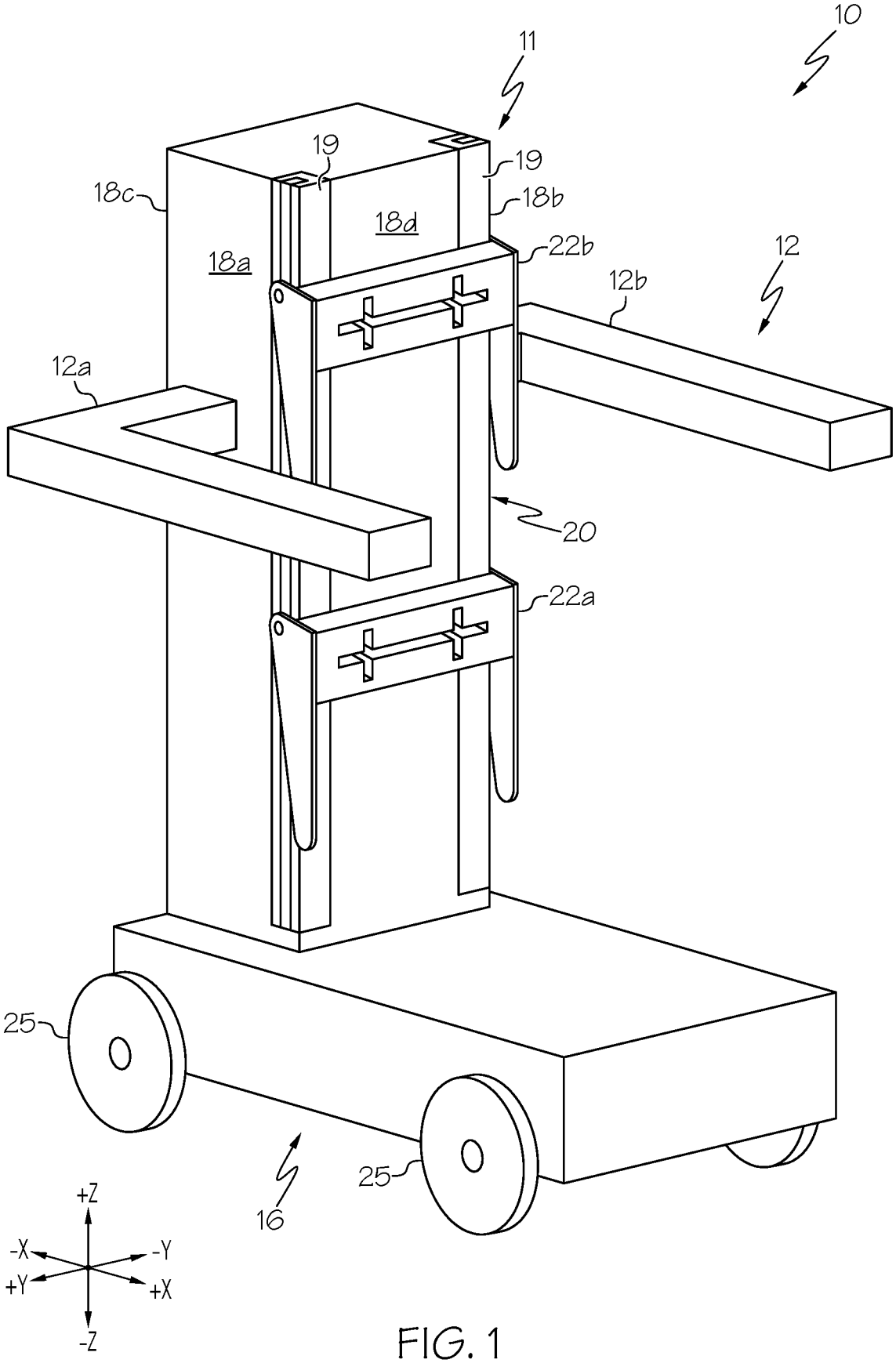
FIG. 1 depicts a perspective view of an assistive robot system according to one or more embodiments shown and described herein.

As used herein, the term "system longitudinal direction" refers to the forward-rearward direction of the system (i.e., in the +/−X direction depicted in FIG. 1). The term "system lateral direction" refers to the cross-direction (i.e., in the +/−Y direction depicted in FIG. 1), and is transverse to the longitudinal direction. The term "system vertical direction" refers to the upward-downward direction of the system (i.e., in the +/−Z direction depicted in FIG. 1). As used herein, "upper" or "top" is defined as the positive Z direction of the coordinate axis shown in the drawings. "Lower" or "bottom" is defined as the negative Z direction of the coordinate axis shown in the drawings. Further, the terms "inward", "extend", "retract", and "outward" are used to describe the relative positioning of various components of the system and/or their movements.

Referring now to the drawings, FIG. 1 depicts a perspective view of an illustrative assistive robot system 10. The illustrative assistive robot system 10 depicted in FIG. 1 may provide particular use in assisting people with moving objects, such as a plurality of containers containing a plurality of goods (e.g., groceries from a grocery store) from a first position, such as, without limitation, a floor or a lower position and moving the container, using illustrative assistive robot system 10, to position the container at a second position, such as, without limitation, a storage position on the illustrative assistive robot system 10 or placing the container an end location (e.g., a shelf raised from the floor), as described in further detail herein. However, it should be appreciated that the assistive robot system 10 is not limited to this use and may be used for other purposes without departing from the scope of the present disclosure. For example, the assistive robot system 10 may be used to provide a storage location for the plurality of containers and/or transport the plurality of containers, as described in further detail herein. In another example, the assistive robot system 10 may be used in other fields, such as the warehouse field, the manufacturing field, and/or the like.

The assistive robot system 10 generally includes an example lifting mechanism 11. The example lifting mechanism 101 is supported on a base 16. The lifting mechanism 11 may include a plurality of surfaces, including, but not limited to, a first side 10*a*, a second side 18*b*, a rear side 18*c*, and a front side 18*d*. The various surfaces of the lifting mechanism 11 may support one or more components of the assistive robot system 10, as described in further detail herein. The assistive robot system 10 further includes an example movable arm assembly 12. The example movable arm assembly 12 includes a pair of arms 12*a*, 12*b* extending from the second side 18*b* and the first side 18*a* of the lifting mechanism 11 respectively to define a gap. The example movable arm assembly 12 is configured to work in conjunction with the example lifting mechanism 11 to move in coordination such that an object, such as a container, may be gripped, raised, lowered, picked, placed, tilted, and/or the like.

An example container storage assembly 20 is mounted to the front side 18*d* of the lifting mechanism 11. The container storage assembly 20 includes a pair of elongated slots 19 in which a first example bracket 22*a* and a second example bracket 22B are mounted thereto. The second example bracket 22B is positioned above the first example bracket 22*a* in the system vertical direction (i.e., in the +/−Z direction). Each example bracket 22*a*, 22*b* is configured to retain a container to the example bracket 22*a*, 22*b*.

In operation, the example lifting mechanism 11 may move in the system vertical direction (i.e., in the +/−Z direction) and the example movable arm assembly 12 may move in the system lateral direction (i.e., in the +/−Y direction) and/or the system longitudinal direction (i.e., in the +/−X direction). As such, the movement of the example movable arm assembly 12 permits for a container to be gripped, released, and the like. As such, the example movable arm assembly 12 and the example lifting mechanism 11 are configured to work in conjunction with the container storage assembly 20 to add, remove and/or transport containers. As such, the container may be gripped by the movable arm assembly 12 and positioned to be coupled to the container storage assembly 20. To achieve this position, the lifting mechanism 11 and/or the example movable arm assembly 12 may move in a plurality of coordinated movements. Once the container is positioned at the example container storage assembly 20, the movable arm assembly 12 may move in a motion that causes the container to be docked or coupled to the first example bracket 22*a* or the second example bracket 22B The base 16 of the assistive robot system 10 may be coupled to one or more wheels 25. In some embodiments, at least one of the one or more wheels 25 may be coupled to a drive mechanism such as a motor, a transmission, and/or the like such that the wheels 25 can be rotated to move the assistive robot system 10 across a surface, as described in greater detail herein. In some embodiments, the wheels 25 may not be coupled to a drive mechanism, but rather the assistive robot system 10 is moved by receiving an external force (e.g., a user pushes or pulls the assistive robot system 10) to cause the wheels 25 to rotate and the assistive robot system 10 to move. Accordingly, it should be appreciated that the components of the assistive robot system 10 (i.e., the lifting mechanism 11, the movable arm assembly 12, and the one or more wheels 25) assist users in moving containers, transporting containers, placing containers and/or on different surfaces, such as shelves, and the like.

Figure 2:
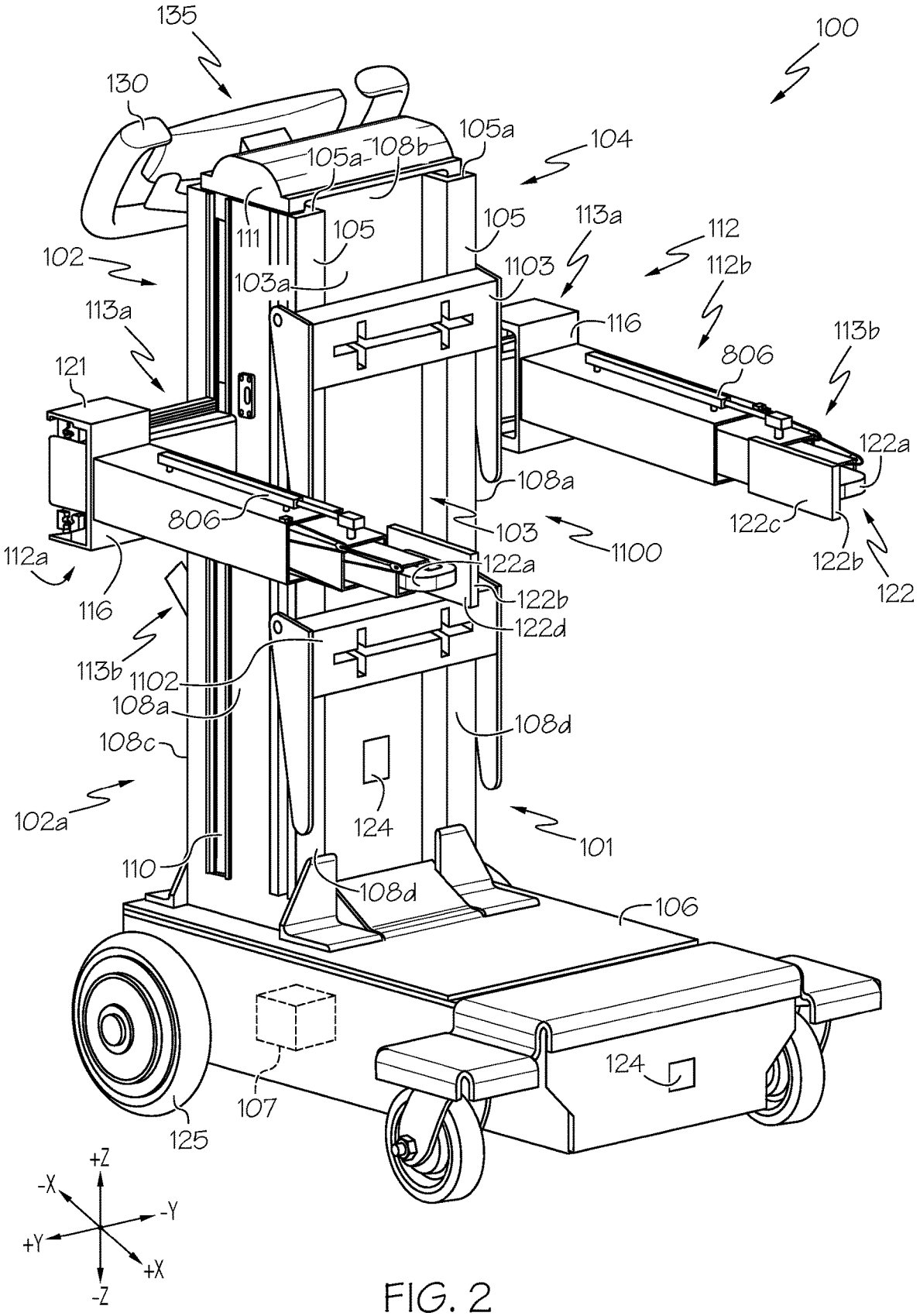
FIG. 2 depicts a perspective view of an illustrative assistive robot system according to one or more embodiments shown and described herein.

Referring now to the FIG. 2, another assistive robot system 100 according to an example embodiment is depicted in greater detail. The illustrative assistive robot system 100 depicted in FIG. 2 may provide particular use in assisting people with moving objects, such as a plurality of containers containing a plurality of goods (e.g., groceries from a grocery store) from a first position, such as, without limitation, a floor or a lower position and moving the container, using illustrative assistive robot system 100, to position the container at a second position, such as, without limitation, a storage position on the illustrative assistive robot system 100 or placing the container an end location (e.g., a shelf raised from the floor), as described in further detail herein. However, it should be appreciated that the assistive robot system 100 is not limited to this use and may be used for other purposes without departing from the scope of the present disclosure. For example, the assistive robot system 100 may be used to provide a storage location for the plurality of containers and/or transport the plurality of containers, as described in further detail herein. In another example, the assistive robot system 100 may be used in other fields, such as the warehouse field, the manufacturing field, and/or the like.

The assistive robot system 100 generally includes an example lifting mechanism 101. The example lifting mechanism 101 is supported on a base 106. The lifting mechanism 101 may include a plurality of surfaces, including, but not limited to, a first side 108*a*, a second side 108*b*, a rear side 108*c*, and a front side 108*d*. The various surfaces of the lifting mechanism 101 may support one or more components of the assistive robot system 100, as described in further detail herein. The assistive robot system 100 further includes an example movable arm assembly 112. The example movable arm assembly 112 includes a pair of arms 112*a*, 112*b* extending from the second side 108*b* and the first side 108*a* of the lifting mechanism 101 respectively to define a gap. The example movable arm assembly 112 is configured to work in conjunction with the example lifting mechanism 101 to move in coordination such that an object, such as a container, may be gripped, raised, lowered, picked, placed, tilted, and/or the like.

The example lifting mechanism 101 includes an example first tower actuator assembly 102 and an example second tower actuator assembly 104 spaced apart from one another defining a gap. In some embodiments, a mast 103 may be disposed in the gap between the first tower actuator assembly 102 and the second tower actuator assembly 104. In embodiments, the mast 103 is stationary and does not translate with the example lifting mechanism 101. In other embodiments, there may be more than two tower actuator assemblies. The lifting mechanism 101 is supported on the base 106. In some embodiments, the first and second tower actuator assemblies 102, 104 may have telescoping sections that extend from a lower section 102*a*, as explained in greater detail herein. Further, in some embodiments, the first and second tower actuator assemblies 102, 104 and the telescoping sections may be actuated by a single actuator. In other embodiments, the first and second tower actuator assemblies 102, 104 and the telescoping sections may be actuated by multiple actuators. The lower section 102*a* includes the plurality of surfaces, including, but not limited to, the first side 108*a*, the second side 108*b* (FIG. 3), the rear side 108*c*, and the front side 108*d*. The various surfaces of the lower section 102*a* of the first tower actuator assembly 102 may support one or more components of the assistive robot system 100, as described in further detail herein. The first side 108*a* further includes a lower section slot 110. The lower section slot 110 extends vertically in the system vertical direction (i.e., in the +/−X direction) a length of the lower section 102*a*.

It should be appreciated that the example second tower actuator assembly 104 is a mirror image of the first tower actuator assembly 102. As such, the same element numbers are used to describe the identical mirrored components and surfaces of the second tower actuator assembly 104.

In some embodiments, the mast 103 further includes a front surface 103*a* separating a pair of elongated members 105. One of the pair of elongated members 105 is attached to the second side 108*b* of the lower section 102*a* of the first tower actuator assembly 102 and the other one of the pair of elongated members 105 is attached to the second side 108*b* of the lower section 102*a* of the second tower actuator assembly 104. However, it should be appreciated that the pair of elongated members are not limited to the illustrated locations and may be positioned anywhere on the first tower actuator assembly 102. The pair of elongated members 105 extend in the system vertical direction (i.e., in the +/−Z direction) the length of the lower section 102*a* of the first tower actuator assembly 102 and the second tower actuator assembly 104 and terminate at the base 106. In some embodiments, the lifting mechanism 101 includes a cap 111 that extends between the first and second tower assemblies 102, 104 defining a top portion of the lifting mechanism 101. As such, the elongated members 105 may extend a length of the lower section 102*a* between the cap 111 and the base 106. Each one of the pair of elongated members 105 further includes an elongated slot 105*a* that extends the length of the elongated members 105 in the system vertical direction (i.e., in the +/−Z direction), as discussed in greater detail herein. The elongated slot may be a c-channel, a Unistrut, and/or the like.

Figure 4A:
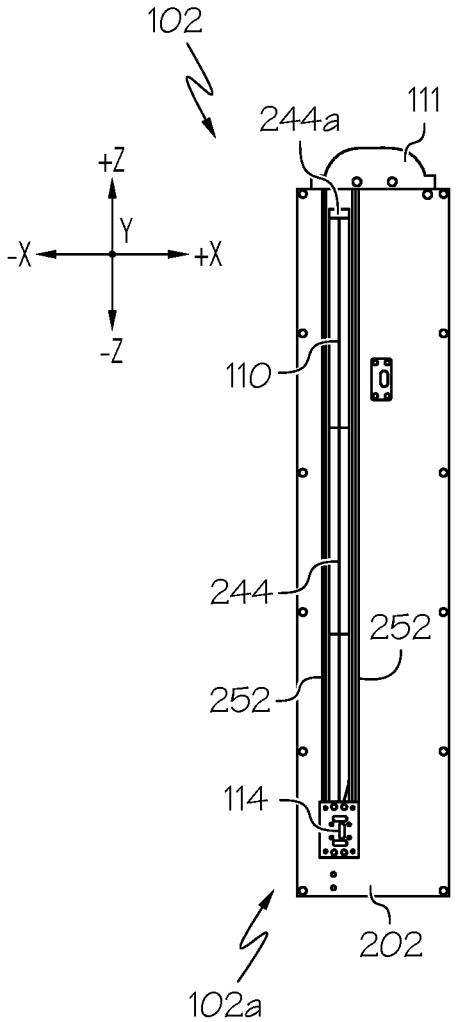
FIG. 4A schematically depicts a side view of the lifting mechanism of FIG. 3 at a home position according to one or more embodiments shown and described herein.
Figure 4B:
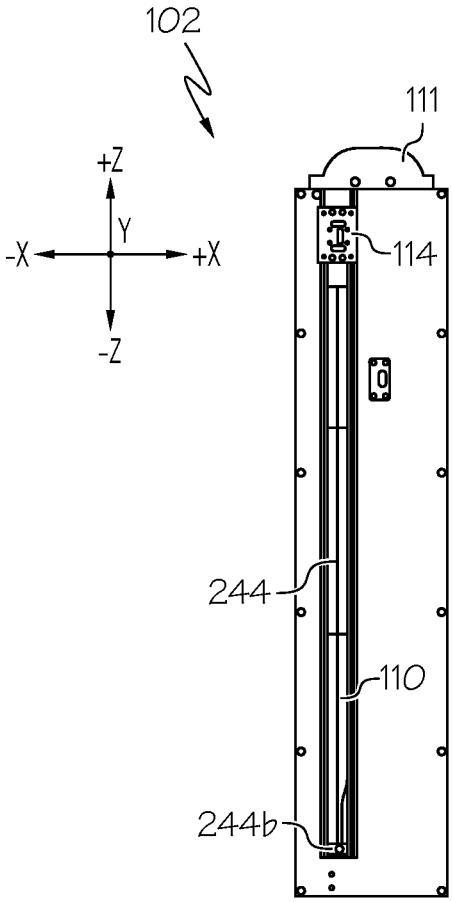
FIG. 4B schematically depicts a side view of the lifting mechanism of FIG. 4A with a connector raised in a system vertical direction according to one or more embodiments shown and described herein.

Still referring to FIG. 2, the assistive robot system 100 includes the movable arm assembly 112. The movable arm assembly 112 includes a pair of arms 112*a*, 112*b*. Each of the pair of arms 112*a*, 112*b* may include a lateral telescoping assembly 113*a*, a longitudinal telescoping assembly 113*b*, and a housing 121 having an outer surface 116. Each one of the pair of arms 112*a*, 112*b* are operably coupled to a connector 114 (FIG. 4A) that travels within the lower section slot 110, and in some embodiments, along an extension section rail 244 (FIG. 4B), as discussed in greater detail herein. The lateral telescoping assembly 113*a* is operably coupled to the longitudinal telescoping assembly 113*b*, and vice versa. In some embodiments, the lateral telescoping assembly 113*a* may include a plurality of telescoping segments that travel laterally in the system lateral direction (i.e., in the +/−Y direction), as discussed in greater detail herein. Further, in some embodiments, the longitudinal telescoping assembly 113*b* may also include a plurality of telescoping segments that travel longitudinally in the system longitudinal direction (i.e., in the +/−X direction), as discussed in greater detail herein. In some embodiments, the plurality of telescoping segments of the longitudinal telescoping assembly 113*b* are driven by a linear actuator 806. Each segment of the plurality of telescoping segments have a different interior area such that each segment nests within the previous telescoping segment, as explained in greater detail below. In other embodiments, each segment of the plurality of telescoping segments are in reserve order to form a reverse pyramid shape. It should be appreciated that in either embodiment, the telescoping segments mimic a gantry crane or other mechanism configured to lift and support heavy weight with limited degrees of freedom to support the weight of the container to be raised, lowered, placed, stored, transported, tilted, and the like.

In some embodiments, an example gripping assembly 122 is coupled to the longitudinal telescoping assembly 113*b*. In particular, the example gripping assembly 122 includes an attachment portion 122*a* and a gripping portion 122*b*. The attachment portion 122*a* is configured to attach and move the gripping portion 122*b* such that the example gripping assembly 122 is configured to extend and retract with the telescoping segments of the longitudinal telescoping assembly 113*b* extend and retract, as discussed in greater detail herein. The gripping portion 122*b* of the example gripping assembly 122 may have an inside surface 122*c* and an outside surface 122*d*. The inside surface 122*c* may be configured to engage with the container while the outside surface 122*d* is configured to be coupled to the attachment portion 122*a*. The inside surface 122*c* of the gripping portion 122*b* may be configured to grip and/or retain a plurality of containers. Each container may have a different shape, as discussed in greater detail herein. As such, in some embodiments, the inside surface 122*c* may be a pad that is contoured, textured, and/or a combination thereof, as discussed in greater detail herein. In other embodiments, the gripping portion may be a hook, a clasp, and/or the like. The attachment portion 122*a* may be a U-shape or a hook shape that positons the gripping portion 122*b* along an inner surface of the longitudinal telescoping assembly 113*b* such that contact is made with the container between the arms 112*a*, 112*b* of the movable arm assembly 112, as discussed in greater detail herein. Still referring to FIG. 2, the base 106 of the assistive robot system 100 may be coupled to one or more mobility components, such as, for example, one or more wheels 125 rotatably coupled to the base 106. In some embodiments, at least one of the one or more wheels 125 may be coupled to a drive mechanism 107 such as a motor, a transmission, and/or the like such that the wheels 125 can be rotated to move the assistive robot system 100 across a surface, as described in greater detail herein. In some embodiments, the wheels 125 may not be coupled to the drive mechanism 107, but rather the assistive robot system 100 is moved by receiving an external force (e.g., a user pushes or pulls the assistive robot system 100) to cause the wheels 125 to rotate and the assistive robot system 100 to move. Further, it should be appreciated that the drive mechanism 107 may include power management components, such as, a battery, a charging unit, and the like. In some embodiments, at least one of the wheels 125 may be movable around a plurality of axes such that the wheel is steerable. The wheels 125 are otherwise not limited by the present disclosure and may contain any other features. For example, the wheels 125 may be adapted for moving over varied and/or unpaved terrain, adapted for lifting the assistive robot system 100 up a single step (such as a curb or the like), adapted to move in inclement weather conditions, and/or the like. Systems and methods for traversing a step or a curb are described in U.S. Pat. Appl. No. 16/560,252 [Attorney Docket No. 108749-183/2018-680], which is hereby incorporated by reference in its entirety. While FIG. 2 depict the wheels 125 as the mobility components, (also FIG. 1 with the wheels 25) it should be appreciated that the present disclosure is not limited to such. For example, the mobility components may be skis, rotors, tracks, and/or the like that provide the assistive robot system 100 with an ability to move.

Still referring to FIG. 2, the assistive robot system 100 (as well as the assistive robot system 10 shown by FIG. 1) may include various components that allow the assistive robot system 100 to be manually pushed/pulled around a space, be semi-automatically driven by a user, and/or have autonomous movement capabilities that allow the assistive robot system 100 to move around a space with little or no input from a user. That is, the assistive robot system 100 may include components that allow for operation in a full manual mode, a manual assist mode, a semi-autonomous mode, and/or an autonomous mode, as described in greater detail herein.

Figure 6:
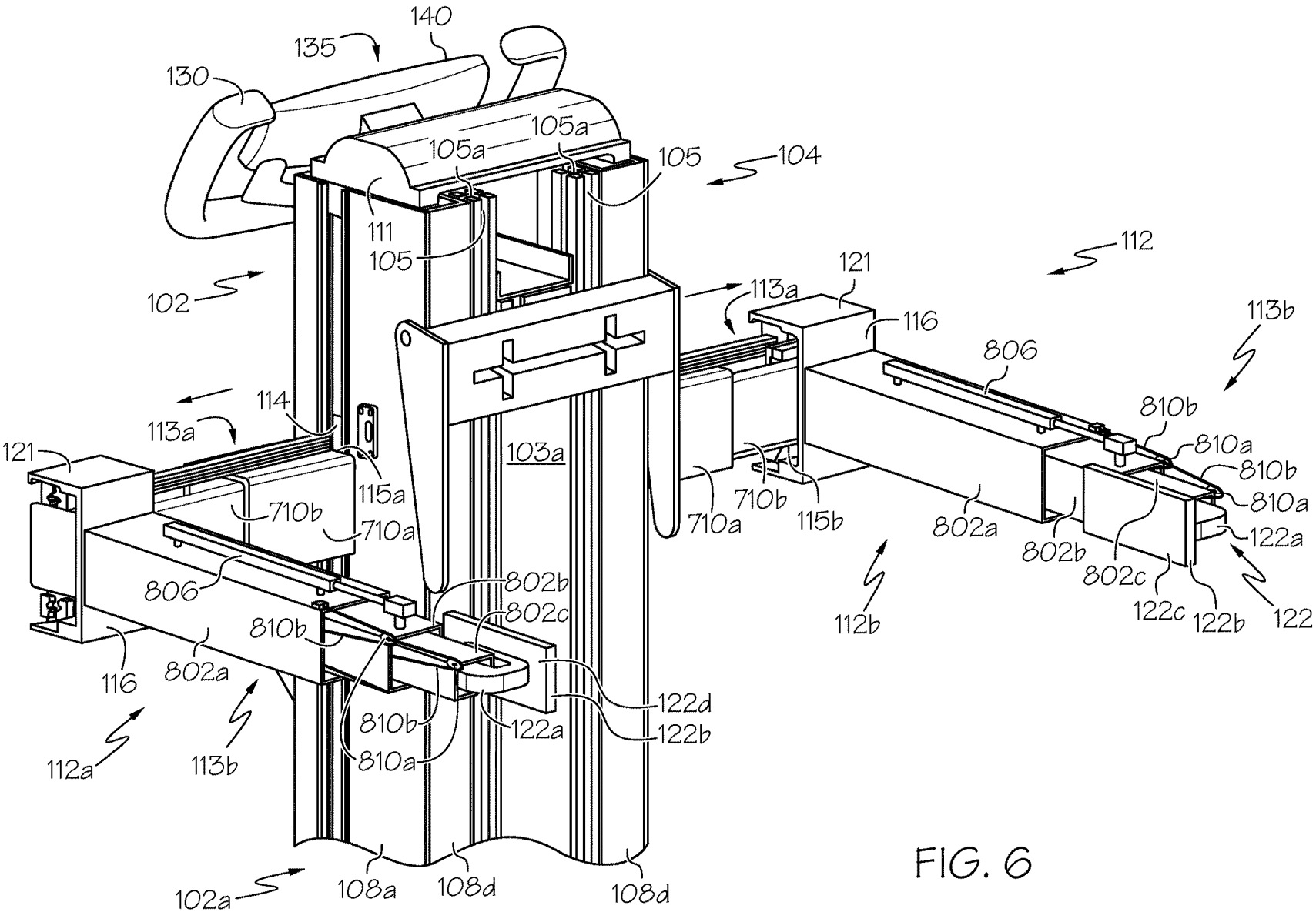
FIG. 6 schematically depicts an isolated perspective view of the movable arm assembly with an example lateral telescoping assembly in an extended position, an example longitudinal telescoping assembly in a retracted position, and a user interface device coupled to the mast according to one or more embodiments shown and described herein.

For example, in some embodiments, the assistive robot system 100 may include one or more handles 130 that are positioned and arranged for a user to grasp. That is, a user may manually push/pull the assistive robot system 100, turn the assistive robot system 100, and/or the like by applying a force to at least the one or more handles 130. As such, the one or more handles 130 may generally be located anywhere on the assistive robot system 100, particularly locations that are accessible by a user. For example, the one or more handles 130 may be located at elbow level or below for an average human such that the one or more handles 130 can be comfortably grasped by the user. In some embodiments, the one or more handles 130 may be coupled to the rear side of the lifting mechanism 101. In other embodiments, the one or more handles 130 may be coupled to a rear side of the mast 103, as depicted in FIGS. 2 and 6, as well as other locations not depicted, such as, for example, coupled to a side of the lifting mechanism 101. In some embodiments, the one or more handles 130 may be integrated with one or more portions of the assistive robot system 100 at or near the base 106 such that a user may use his or her feet to contact the one or more handles 130 to move the assistive robot system 100. In some embodiments, the one or more handles 130 may have one or more user interface hardware components (not shown) integrated therein or coupled thereto, such as touch screens, buttons, switches, joysticks, and/or the like that allow a user to navigate a user interface, to provide inputs for moving the assistive robot system 100 (e.g., to automatically or semi-automatically drive the assistive robot system 100), to lock one or more portions of the assistive robot system 100, to provide commands that allow the assistive robot system 100 to autonomously move, and/or the like. In some embodiments, the one or more user interface hardware components may be able to decouple from the one or more handles 130 such that a user may carry the one or more user interface hardware components separately from the assistive robot system 100 and use the one or more user interface hardware components to remotely control one or more aspects of the assistive robot system 100 and/or components thereof.

The assistive robot system 100 may include a sensor device 124 that includes one or more sensors positioned or mounted thereto, as shown in FIG. 2. However, the position is of the one or more sensors Is not limited to the positions as illustrated in FIG. 2. The sensor device 124 may include various components for assisting a user of the assistive robot system 100 in lifting, carrying, storing, placing and/or tilting a container such that the one or more containers may be stored and/or transported from the first position to the second position, and/or the like. Further, the sensor device 124 may assist in the semi-autonomous movement of the assistive robot system 100, assisted movement of the assistive robot system 100 in a manual assist mode, and/or the like.

In embodiments, the one or more sensors of the sensor device 124 are positioned on the assistive robot system 100 and configured to identify whether a container is stored in the container storage assembly 1100. It should be appreciated that the assistive robot system 100 may change the lifting, carrying, storing, placing, extending, retracting, and/or tilting of the container when a second container is in the movable arm assembly 112 and a first container is stored in the container storage assembly 1100. In embodiments, the plurality of sensors of the sensor device 124 are positioned on the assistive robot system 100 and configured to identify whether the container is in a proper position to be properly retained in the container storage assembly 1100. In these embodiments, the assistive robot system 100 may change the position of the container via the movable arm assembly 112, the position of the container storage assembly 1100 via the lifting mechanism 101, prompt a user to change the position of the container, the movable arm assembly 112, the lifting mechanism 101, and the like, as discussed in greater detail herein.

The various components of the sensor device 124 are not limited by the present disclosure, and may generally be any components that provide the functionality described herein. For example, the sensor device 124 may include one or more sensing devices, including cameras, optical sensors, ranging systems, time of flight (TOF) sensors, proximity sensing systems, laser emitting devices, and/or the like. Such systems should generally be understood and are not described further herein. It should be understood that other embodiments do not include sensors or a sensor device.

Now referring to FIG. 3, an isolated perspective exploded sectional view of the example first tower actuator assembly 102 of the lifting mechanism 101 will now be described. It should be appreciated that, as discussed above, the second tower actuator assembly 104 is a mirror image of the first tower actuator assembly 102 and thus will not be described. In embodiments, the first tower actuator assembly 102 includes telescoping sections. The example first tower actuator assembly 102 includes three telescoping sections: the lower section 102*a*, a midsection 102*b*, and an extension section 102*c*. As discussed above, the lower section 102*a* includes the first side 108*a* spaced apart from the second side 108*b*, the rear side 108*c* also spaced apart from the front side 108*d* so to form a lower section base portion 202 and a lower section cavity 204. The lower section base portion 202 may be in contact with the base 106.

In some embodiments, the lower section cavity 204 further includes a plurality of surfaces, including, but not limited to, a lower section cavity first inner side 204*a*, a lower section cavity second inner side 204*b*, a lower section cavity third inner side 204*c*, and a lower section cavity fourth inner side 204*d*. The various surfaces of the lower section cavity 204 house the midsection 102*b* and the extension section 102*c*. As such, the lower section cavity 204 extends from the lower section base portion 202 to a lower section upper opening 206, opposite the lower section base portion 202 in the system vertical direction (i.e., in the +/−Z direction). In embodiments, the front side 108*d* of the lower section 102*a* further includes a groove 208 that extends the length of the front surface 108*d* of the lower section 102*a* in the system vertical direction (i.e., in the +/−Z direction). The groove 208 encroaches on the lower section cavity 204 such that the lower section cavity 204 may have an asymmetrical or irregular shape. In some embodiments, a lower section rail 210 is mounted to the lower section cavity second inner side 204*b* and extends the length of the lower section cavity second inner side 204*b* in the system vertical direction (i.e., in the +/−Z direction). In some embodiments, the lower section rail 210 includes a lower section rail stop limit 210*a* adjacent to the lower section upper opening 206. The lower section rail stop limit 210*a* may be generally a u-shaped stop that abuts the lower section rail 210 and the lower section cavity second inner side 204*b*. The lower section rail stop limit 210*a* may be any material that is capable of preventing a movement of another section of the first tower actuator assembly 102 from travelling or telescoping beyond on the limit stop. In some embodiments, the lower section rail stop limit 210*a* may be an electrically controlled switch, such as a toggle switch, a proximately switch, a laser switch, and/or the like.

In some embodiments, the illustrated lower section cavity 204 maintains a first sprocket 211, a second sprocket 212, and a third sprocket 214, as discussed with greater detail herein. More specifically, the first, second, and third sprockets 211, 212, 214 may be mounted to the lower section cavity second inner side 204*b*.

Figure 3:
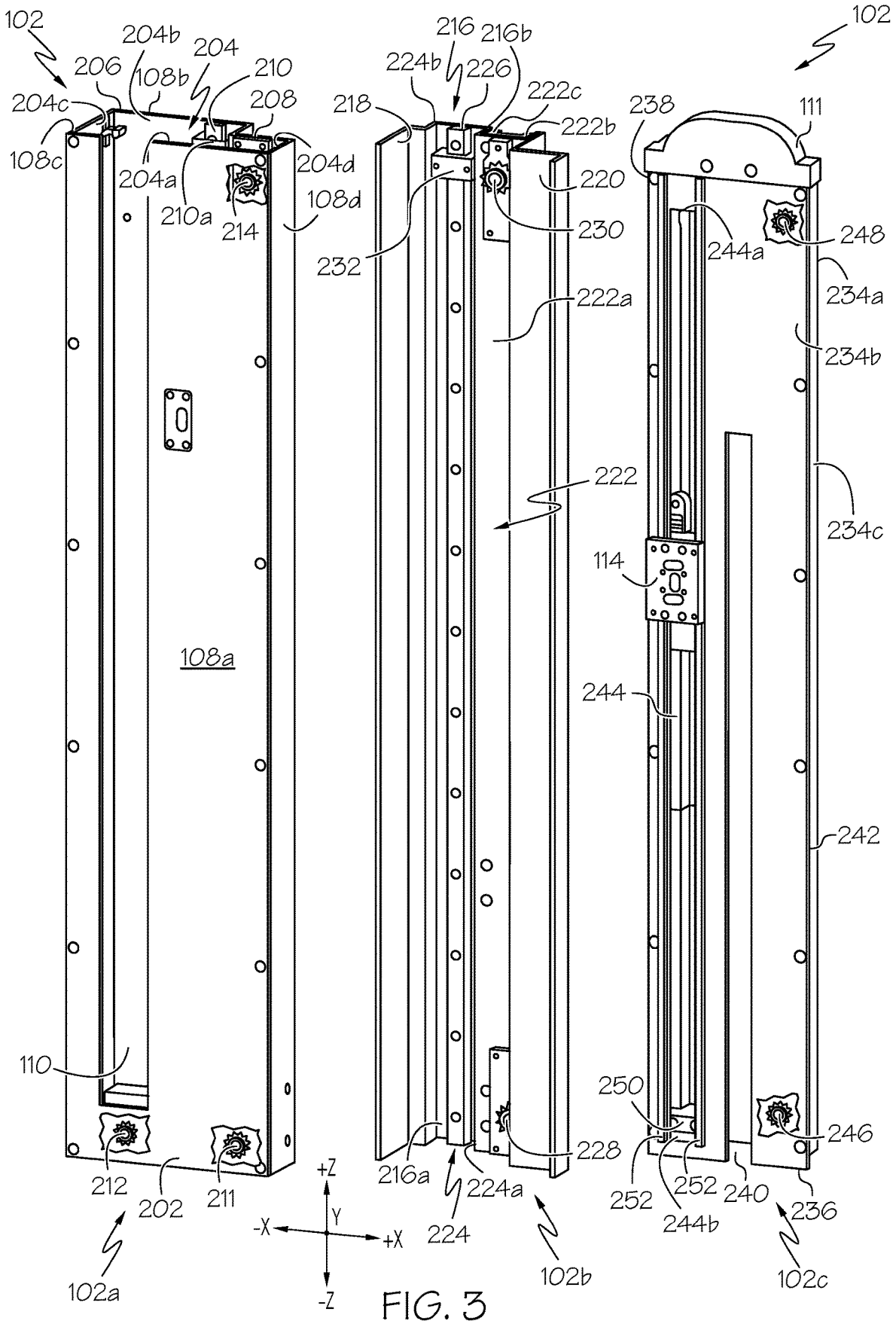
FIG. 3 depicts an isolated perspective exploded view of an example lifting mechanism of an illustrative assistive robot system of FIG. 2 according to one or more embodiments shown and described herein.

Still referring to FIG. 3, in some embodiments, the midsection 102*b* further includes a plurality of surfaces, including, but not limited to, a midsection wall 216 having a midsection wall inner surface 216*a* and a midsection wall outer surface 216*b*, a midsection first flange 218, a midsection second flange 220, and a midsection u-shaped flange 222. The midsection wall 216 may be attached to the midsection first flange 218 and the midsection u-shaped flange 222 so to space apart the midsection first flange 218 from the midsection u-shaped flange 222. As such, a midsection channel 224 is defined within the midsection wall inner surface 216*a*, which in turn forms an inner surface of the midsection channel 224. The midsection first flange 218 and the midsection u-shaped flange 222 continue to form the walls of the midsection channel 224 respectively. The midsection second flange 220 is connected to the midsection u-shaped flange 222 opposite of the midsection wall 216 connection to the midsection u-shaped flange 222. That is, the midsection second flange 220 is outside of the midsection channel 224. Further, the midsection channel 224 includes a midsection channel base portion 224*a* and a midsection channel upper portion 224*b*. It should be appreciated that the example first tower actuator assembly 102 of the lifting mechanism 101 is not limited to the configuration as illustrated in FIG. 3 and that the example first tower actuator assembly 102 may take on any shape or structure and is not limited by the disclosure herein.

In some embodiments, the various surfaces of the midsection 102*b* align with the lower section cavity 204 such that the midsection 102*b* is housed within and extends from the lower section cavity 204 in the system vertical direction (i.e., in the +/−Z direction), as will be discussed in further detail herein. A midsection rail 226 is mounted to the midsection wall inner surface 216*a* and extends the length of the midsection channel 224 in the system vertical direction (i.e., in the +/−Z direction). Further, the midsection rail 226 aligns vertically with the lower section slot 110 in the system vertical direction (i.e., the +/−Z direction) so that when extended, the midsection rail 226 and the lower section slot 110 are continuous in the system vertical direction (i.e., in the +/=Z direction). Further, the midsection u-shaped flange 222 includes an outer portion 222*a* and an inner portion 222*b* that form the u-shape. As such, the inner portion 222*b* of the midsection u-shaped flange 222 aligns with and slidably engages with the lower section rail 210 in the system vertical direction (i.e., in the +/−Z direction) so that the midsection 102*b* may raise and lower from and into the lower section 102*a* by slidably engaging the midsection u-shaped flange 222 with the lower section rail 210. Moreover, the inner portion 222*b* of the midsection u-shaped flange 222 includes a u-shape flange stop limit 222*c* adjacent to both the midsection channel base portion 224*a* and the midsection channel upper portion 224*b*. The u-shape flange stop limit 222*c* may be any material that is capable of preventing a movement of another section of the first tower actuator assembly 102 from travelling or telescoping beyond on the limit stop. In some embodiments, the u-shape flange stop limit 222*c* may be an electrically controlled switch, such as a toggle switch, a proximately switch, a laser switch, and/or the like.

Still referring to FIG. 3, in some embodiments, the midsection second flange 220 may be configured to allow clearance to the first and third sprockets 211, 214 of the lower section 102*a* in the system vertical direction (i.e., in the +/−Z direction) so that when the midsection 102*b* rises and lowers from and into the lower section 102*a*, there will not be any interference with the operation of the first and third sprockets 211, 214 of the lower section 102*a*.

In some embodiments, a fourth sprocket 228 and a fifth sprocket 230 are attached to the midsection u-shaped flange 222 of the midsection 102*b* and assist in raising and lowering the midsection 102*b* from the lower section cavity 204, as discussed with greater detail herein. More specifically, the fourth and fifth sprockets 228, 230 are attached to the outer portion 222*a* of the midsection u-shaped flange 222. Further, a midsection limit stop 232 is coupled to an upper portion of midsection rail 226. The midsection limit stop 232 may be generally a u-shaped stop that abuts the midsection rail 226 and the midsection wall inner surface 216*a*. The midsection limit stop 232 may be any material that is capable of preventing a movement of another section of the first tower actuator assembly 102 from travelling or telescoping beyond on the limit stop. In some embodiments, the midsection limit stop 232 may be an electrically controlled switch, such as a toggle switch, a proximately switch, a laser switch, and/or the like.

Still referring to FIG. 3, in some embodiments, the extension section 102*c* further includes a plurality of surfaces, including, but not limited to, an extension section outer wall 234*a* and opposing extension section inner wall 234*b*. The extension section outer wall 234*a* and opposing extension section inner wall 234*b* are separated by a thickness that forms an extension section front wall 234*c* and an extension section rear wall 234*d* (FIG. 3C). Further, in embodiments, the extension section 102*c* includes an extension base portion 236 and an extension top portion 238 in which the cap 111 of the first tower actuator assembly 102 is attached to the extension top portion 238. The extension section inner wall 234*b* includes an extension section slot 240 that extends in the system vertical direction (i.e., in the +/−Z direction). It should be appreciated that the extension section slot 240 may not extend the length of the extension section inner wall 234*b*, but may extend from the extension base portion 236 towards the extension top portion 238 without its apex in contact with the extension top portion 238. In some embodiments, the extension section outer wall 234*a*, the extension section front wall 234*c* and/or the extension section rear wall 234*d* may not be flush or extend to a point adjacent to the extension section inner wall 234*b*, thereby creating an extension section flange 242.

In some embodiments, the various surfaces of the extension section 102*c* align with the midsection 102*b* and the lower section cavity 204 of the lower section 102*a* such that the extension section 102*c* is maintained within the lower section cavity 204 and slidably extends from the lower section 102*a* and the midsection 102*b* in the system vertical direction (i.e., in the +/−Z direction), as will be discussed in further detail herein. In embodiments, an extension section rail 244 is mounted to the extension section inner wall 234*b* and extends the length of the extension section inner wall 234*b* in the system vertical direction (i.e., in the +/−Z direction). The extension section rail 244 has an upper edge rail portion 244*a* and a lower edge rail portion 244*b*. Further, the extension section rail 244 aligns vertically with the midsection rail 226 and the lower section slot 110 in the system vertical direction (i.e., in the +/−Z direction) so that when extended, the extension section rail 244, the midsection rail 226 and the lower section slot 110 are continuous in the system vertical direction (i.e., the +/−Z direction). In some embodiments, a pair of ribs 252 are separated by the extension section rail 244. The pair of ribs 252 protrude from the extension section inner wall 234*b* and extend from the extension base portion 236 to the extension top portion 238 in a system vertical direction (i.e., in the +/−Z direction). The pair of ribs 252 may shield or protect the extension section rail 244, may assist in aligning or maintain the alignment of the extension section 102*c* to the midsection 102*b*, provide strength and support to the connector 114 as well as provide a surface for the connector 114 to travel, move, or ride thereon during movement in the system vertical direction (i.e., in the +/−Z direction) between the upper edge rail portion 244*a* and a lower edge rail portion 244*b*. It should be appreciated that the example first tower actuator assembly 102, including the lower section 102*a*, the midsection 102*b* and the extension section 102*c*, is not limited to the configuration of the embodiments as illustrated in FIG. 3 and that the example first tower actuator assembly 102 may take on any shape or structure and is not limited by the disclosure herein.

Still referring to FIG. 3, in some embodiments, the extension section flange 242 may align with the fourth and fifth sprockets 228, 230 of the midsection 102*b* in the system vertical direction (i.e., in the +/−Z direction) so that the extension section 102*c* may raise and lower from the midsection 102*b* without interfering with the operation of the fourth and fifth sprockets 228, 230 of the midsection 102*b*.

In the illustrated embodiment, a sixth sprocket 246 and a seventh sprocket 248 are attached to an inside surface of the extension section outer wall 234*a* and assist in raising and lowering the extension section 102*c* from the midsection 102*b* and the lower section cavity 204, as discussed with greater detail herein. Further, an extension section limit stop 250 is coupled to the lower edge rail portion 244*b* of the extension section rail 244. The extension section limit stop 250 may be generally a u-shaped stop that abuts the lower edge rail portion 244*b* of the extension section rail 244 and the extension section inner wall 234*b*. The extension section limit stop 250 may be any material that is capable of preventing a movement of another section of the first tower actuator assembly 102 from travelling or telescoping beyond on the limit stop or used to temporarily lock the extension section 102*c* to the midsection 102*b* at a predetermined position during the extension process, as discussed in greater detail herein. The extension section limit stop 250 may be an electrically controlled switch, such as a toggle switch, a proximately switch, a laser switch, and/or the like. Further, it should be appreciated that the limit stops 210*a*, 222*c*, 232, 250 are not limited by the placement as illustrated in FIG. 3 and may be placed anywhere on the plurality of surfaces as appreciated by one skilled in the art.

It should be appreciated that the example first tower actuator assembly 102 make take on any shape or structure and is not limited by the disclosure herein. Further, the example first tower actuator assembly 102 may have a plurality of telescoping sections, which may have any shape or structure and is not limited by the disclosure herein. Further, in some embodiments, the example lifting mechanism 101 is a single tower assembly that has fewer telescoping sections than that of the first tower actuator assembly 102 and the second tower actuator assembly 104 described herein. It should be appreciated that the single tower assembly embodiment may provide more stability and may lift heavier loads than the other embodiments described herein with respect to the first tower actuator assembly 102 and the second tower actuator assembly 104. It should be appreciated that, in embodiments, the telescoping sections of the single tower assembly may be an inverted pyramid or may be a telescoping box structure.

Still referring to FIG. 3 and now also referring to FIGS. 4A-4D which schematically depict isolated side views of the first tower actuator assembly 102 and the corresponding the telescoping sections in various positions. In embodiments, the connector 114 is slidably engaged with the extension section rail 244 between the upper edge rail portion 244*a* and a lower edge rail portion 244*b*. Further, the connector 114 may travel in the system vertical direction (i.e., in the +/−Z direction) within the lower section slot 110 when the midsection 102*b* and the extension section 102*c* are at a first position, as discussed in greater detail herein. Further, in some embodiments, the connector 114 is mechanically coupled to a continuous member 302 (FIG. 5A) that is configured to raise and lower the connector 114 along the extension section rail 244 between the upper edge rail portion 244*a* and a lower edge rail portion 244*b*, as will be discussed in greater detail herein. Consequently, because the movable arm assembly 112 is mechanically coupled to the connector 114, when the connector 114 is raised or lowered along the extension section rail 244, whether while within the lower section slot 110 and/or when the extension section 102*c* is extended from the lower section 102*a* in the system vertical direction (i.e., in the +/−Z direction), the movable arm assembly 112 also travel the same distance in the system vertical direction (i.e., in the +/−Z direction).

Still referring to FIGS. 4A-4D, in some embodiments, the lower section 102*a*, the midsection 102*b*, and the extension section 102*c* are all depicted as being in the first position, also referred to herein as a home position. In this first position, the midsection 102*b* and the extension section 102*c* are housed within the lower section 102*a*. The connector 114 may travel within the lower section slot 110 along the extension section rail 244 between the upper edge rail portion 244*a* and the lower edge rail portion 244*b* from a position adjacent to the lower section base portion 202 to an upper position in which the connector 114 makes contact with the upper edge rail portion 244*a* of the extension section rail 244. It should be appreciated that, in embodiments, the extension section 102*c* is positioned ahead of, or in front of the midsection 102*b* within the lower section 102*a* in the positive system lateral direction (i.e., in the +Y direction) such that the extension section rail 244 and the connector 114 are always accessible in the lower section slot 110. Further, in this arrangement, when the connector 114 makes contact with the upper edge rail portion 244*a* (FIG. 2) of the extension section rail 244, the extension section 102*c* is driven or raised in the system vertical direction (i.e., in the +/−Z direction).

Figure 4C:
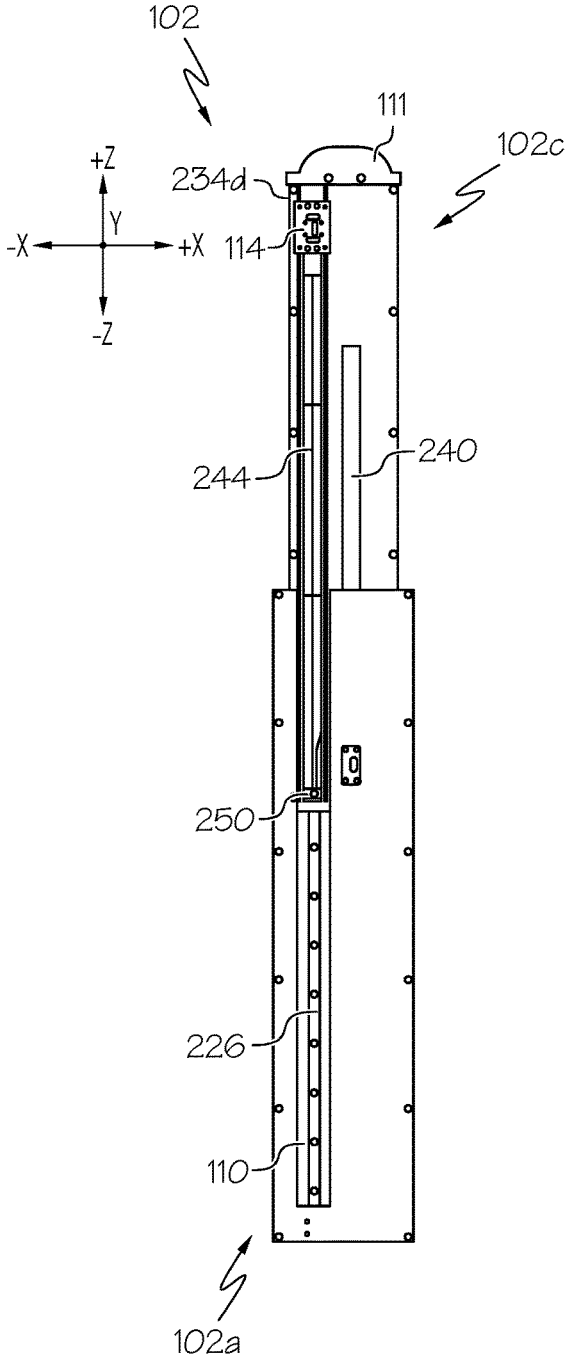
FIG. 4C schematically depicts a side view of the lifting mechanism of FIG. 4A with an extension section raised in the system vertical direction according to one or more embodiments shown and described herein.

Now referring to FIG. 4C, in some embodiments, the connector 114 makes contact with the upper edge rail portion 244*a* (FIG. 2) of the extension section rail 244. As a result, when the continuous member 302 (FIG. 5A, described below) continues to rotate, the connector 114 drives or raises the extension section 102*c* from the lower section 102*a* in the system vertical direction (i.e., in the +/−Z direction), as explained in greater detail below. As such, the extension section 102*c* will continue to raise in the system vertical direction (i.e., in the +/−Z direction) independent of the midsection 102*b* until the extension section limit stop 250 makes contact with the midsection limit stop 232 (FIG. 3), at which point the extension section 102*c* drives or raises the midsection 102*b* in the system vertical direction (i.e., in the +/−Z direction), as shown in FIG. 4D.

Figure 4D:
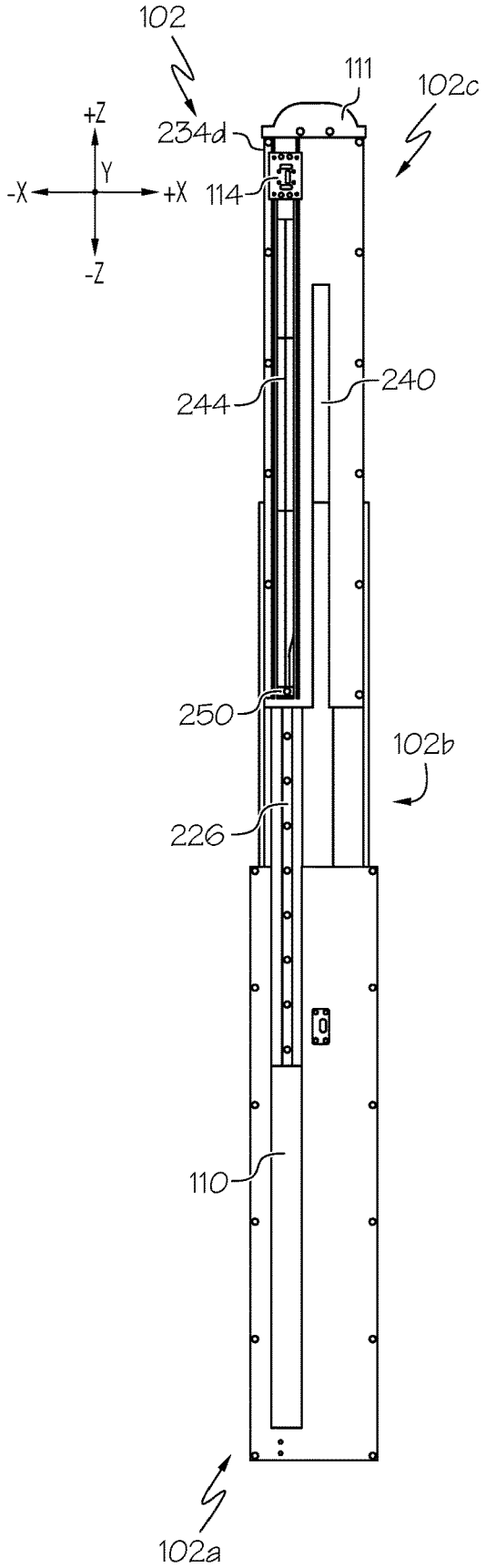
FIG. 4D schematically depicts a side view of the lifting mechanism of FIG. 4A with an extension section and a midsection raised in the system vertical direction according to one or more embodiments shown and described herein.

Now referring to FIGS. 3 and 4D, the extension section limit stop 250 makes contact with the midsection limit stop 232. As a result, the continuous member 302 continues to rotate driving or raising the extension section 102*c* and the midsection 102*b* in the system vertical direction (i.e., in the +/−Z direction) to an extended or a second position. The second position may be met when the u-shape flange stop limit 222*c* is in contact with the lower section rail stop limit 210*a* (FIG. 2). The contact between the stop limits 210*a*, 222*c* prevents the midsection 102*b* from raising any further in the system vertical direction (i.e., in the +/−Z direction) and the contact between the extension section limit stop 250 and the midsection limit stop 232 prevents the extension section 102*c* from advancing any further in the system vertical direction (i.e., in the +/−Z direction).

Referring now to FIGS. 5A-5D, a side isolated view of an example linkage assembly 300 of the first tower actuator assembly 102 that corresponds to the telescoping positions of FIGS. 4A-4D is schematically depicted. In some embodiments, the linkage assembly 300 includes the plurality of sprockets 301 and the continuous member 302. It should be appreciated that the plurality of sprockets 301 may be rollers or a combination of sprockets and rollers. The plurality of sprockets 301 of the illustrated embodiment includes the first sprocket 211, the second sprocket 212 the third sprocket 214, the fourth sprocket 228, the fifth sprocket 230, the sixth sprocket 246, and the seventh sprocket 248 described above and shown in FIG. 3. It should be appreciated that the some of the sprockets of the plurality of sprockets 301 travel, or translate, between a stop position and a travel position, while other sprockets are fixed and do not travel. Further, in some embodiments, certain sprockets rotate whether in the stop or travel positions while others do not rotate while in the stop or travel positions. For example, the first sprocket 211, the second sprocket 212, and the third sprocket 214 of the lower section 102*a* are all fixed position sprockets and do not travel or move positions, and, depending on the position of the telescoping sections, may or may not rotate. It should be appreciated that the continuous member 302 may be an elongated member such as a belt, a chain, an elastic band, and the like. The continuous member 302 is a loop and does not have an end or a beginning, but in some embodiments, the ends are attached to one another to form the loop. In embodiments, the continuous member 302 selectively engages different sprockets to drive or control the telescoping sections (i.e., the midsection 102*b*, extension section 102*c*, and/or the like). In some embodiments, the first sprocket 211 is a gear driven sprocket. That is, the first sprocket 211 may be attached to an axle or some other mechanism that receives a torque from a motor (not shown) and/or the like, to drive the continuous member 302, which in turn rotates and selectively engages different sprockets, as discussed in greater detail herein. It should be appreciated that the motor may be positioned within the base 106 (FIG. 2) to help provide stability and keep the weight of the motor in the base, as appreciated by those skilled in the art, when the telescoping sections (i.e., the midsection 102*b*, extension section 102*c*, and/or the like) are extended in the system vertical direction (i.e., in the +/−Z direction). Further, in some embodiments, as discussed with respect to FIGS. 3 and 4A-4D, limit switches and/or hard stops may be used to translate the different telescoping sections (i.e., the midsection 102*b*, and/or the extension section 103*c*). In other embodiments, an encoder may be used to track the position of the motor, the continuous member 302, the sprockets, and the like to obtain precise movements of the components of the assistive robot system 100.

Figure 5A:
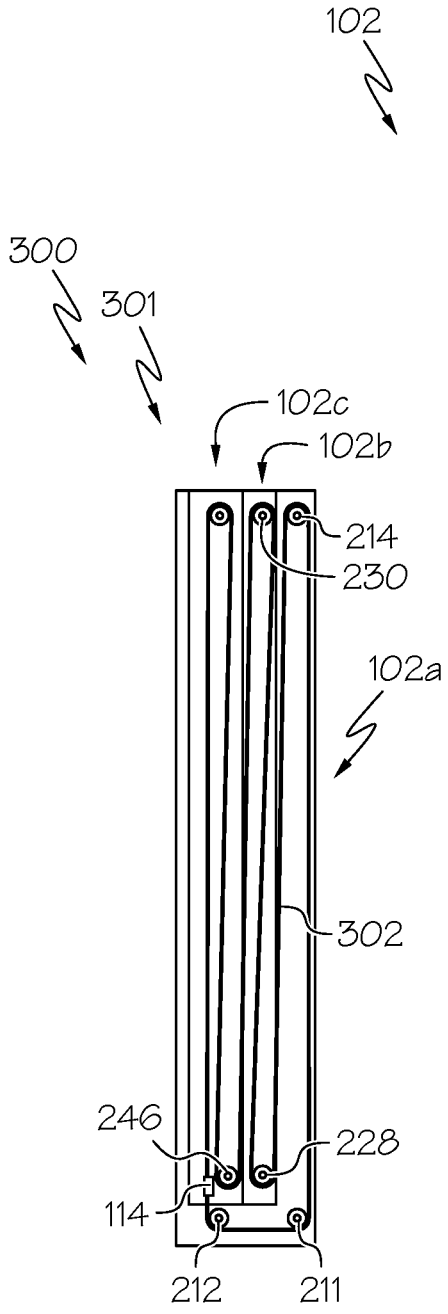
FIG. 5A schematically depicts a side isolated view of an example linkage assembly of the lifting mechanism of FIG. 4A at a home position according to one or more embodiments shown and described herein.
Figure 5B:
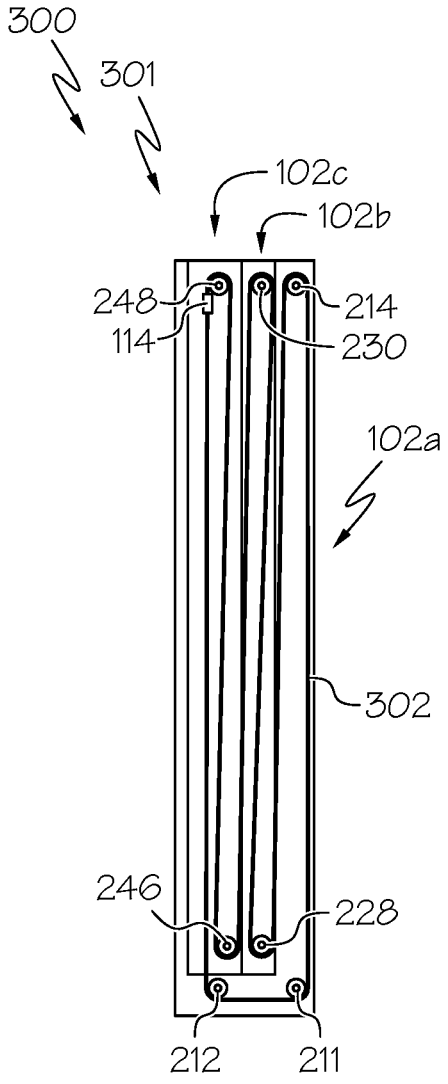
FIG. 5B schematically depicts a side isolated view of the linkage assembly of lifting mechanism of FIG. 5A with a connector raised in the system vertical direction according to one or more embodiments shown and described herein.

Referring now to FIGS. 5A-5B, the lower section 102*a*, the midsection 102*b*, and the extension section 102*c* are all depicted as being in the first position or home position. In this embodiment, in the first position, the midsection 102*b* and the extension section 102*c* are housed within the lower section 102*a*. The connector 114 may travel without making contact with the upper edge rail portion 244*a* (FIG. 3) of the extension section rail 244. Further, because the midsection 102*b* and the extension section 102*c* are housed within the lower section 102*a*, the fourth sprocket 228, the fifth sprocket 230, the sixth sprocket 246, and the seventh sprocket 248 are in their respective stop positions. In the home position, the first and second sprockets 211, 212 are positioned below any other sprockets in the system vertical direction (i.e., in the +/−Z direction) and the third, fifth, and seventh sprockets 214, 230, 248 are positioned vertically above the remaining sprockets in the system vertical direction (i.e., in the +/−Z direction). Further, the fourth and sixth sprockets 228, 246 are positioned between the first and second sprockets 211, 212 and the third, fifth, and seventh sprockets 214, 230, 248 in the system vertical direction (i.e., in the +/−Z direction). As a result of this arrangement, the continuous member 302 has slack between the plurality of sprockets, which permits the continuous member 302 to lengthen or become tight as the plurality of sprockets 301 move from their stop position to their travel position and as the telescoping sections extend between the first position and the second positon. Further, in this arrangement, each sprocket of the plurality of sprockets 301 may rotate freely because the continuous member 302 is not restricting any of their respective movements.

Figure 5C:
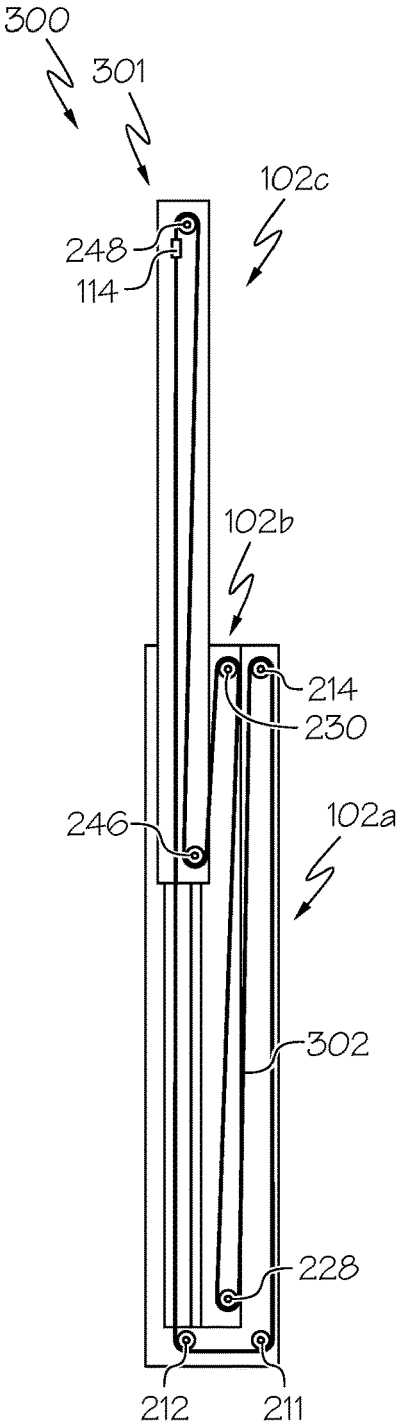
FIG. 5C schematically depicts a side isolated view of the linkage assembly of lifting mechanism of FIG. 5A with an extension section raised in the system vertical direction according to one or more embodiments shown and described herein.

Now referring to FIG. 5C, in some embodiments, the connector 114 makes contact with the upper edge rail portion 244*a* (FIG. 3) of the extension section rail 244 (FIG. 3). As such, the continuous member 302 has slack or is long between the second sprocket 212, the sixth sprocket 246, and the seventh sprocket 248 that allows the extension section 102*c* to raise in the system vertical direction (i.e., in the +/−Z direction) independent of the midsection 102*b* until the extension section limit stop 250 (FIG. 3) makes contact with the midsection limit stop 232 (FIG. 3). In this positon, the sixth sprocket 246 and the seventh sprocket 248 have traveled in the system vertical direction (i.e., in the +/−Z direction) from their stop position to their respective travel positions. The seventh sprocket 248, in its travel position, is vertically above the third sprocket 214 and the fifth sprocket 230 in the system vertical direction (i.e., in the +/−Z direction), while the sixth sprocket 246 is vertically above the first, second, and fourth sprockets 211, 212, 228 but is vertically below the third and fifth sprockets 214, 230 in the system vertical direction (i.e. in the +/−Z direction). As such, the continuous member 302 is now tight between the second sprocket 212, the sixth sprocket 246, and the seventh sprocket 248. In some embodiments, the continuous member 302 tightening prevents the second sprocket 212, the sixth sprocket 246, and the seventh sprocket 248 from rotation. It should be appreciated that the third sprocket 228 and the fourth sprocket 230 remain in their respective stop positions and the continuous member 302 has slack or is long between the first sprocket 211, the third sprocket 214, the fourth sprocket 228 and the fifth sprocket 230. As such, the first sprocket 211, the third sprocket 214, the fourth sprocket 228 and the fifth sprocket 230 may rotate freely in this configuration.

Figure 5D:
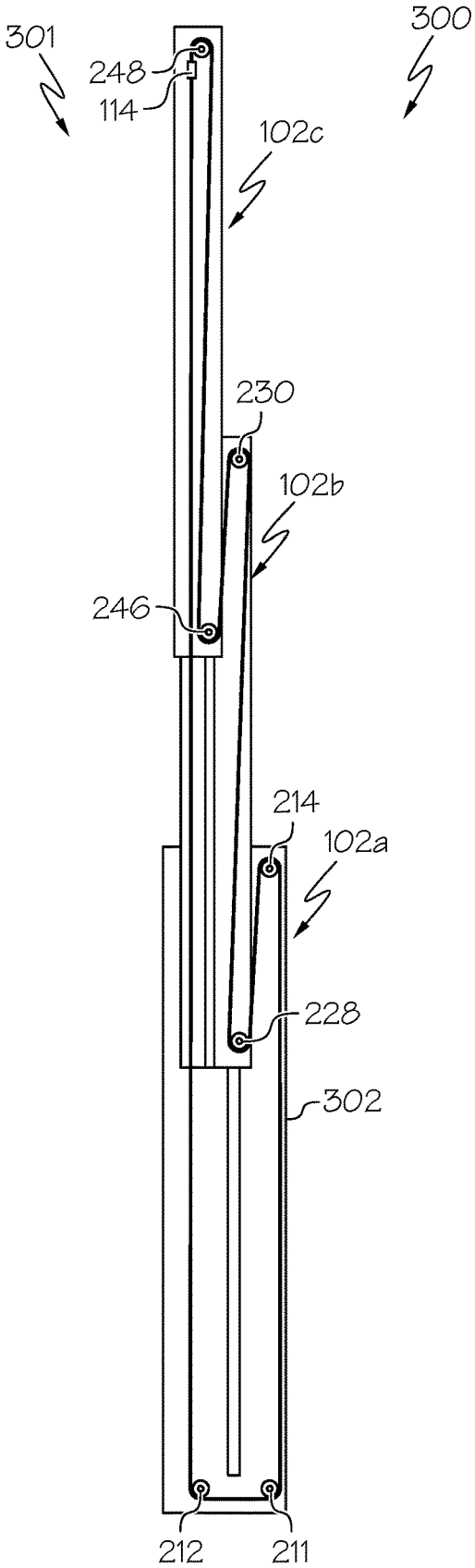
FIG. 5D schematically depicts a side isolated view of the linkage assembly of lifting mechanism of FIG. 5A with an extension section and a midsection raised in the system vertical direction according to one or more embodiments shown and described herein.

Now referring to FIG. 5D, in some embodiments, the first tower actuator assembly 102 is at the second position. That is, the extension section 102*c* and now the midsection 102*b* are raised to the full extension position in the system vertical direction (i.e., in the +/−Z direction). The slack in the continuous member 302 between the first sprocket 211, the third sprocket 214, the fourth sprocket 228 and the fifth sprocket 230 allows the midsection 102*b* to raise in the system vertical direction (i.e., in the +/−Z direction) while also vertically raising the extension section 102*c* in the system vertical direction (i.e., in the +/−Z direction). In this positon, the fourth sprocket 228 and the fifth sprocket 230 have traveled in the system vertical direction (i.e., in the +/−Z direction) from their stop position to their respective travel positions. The fifth sprocket 230, in its travel position, is vertically above the sixth sprocket 246 in the system vertical direction (i.e. in the +/−Z direction). Further the travel position of the fourth sprocket 228, while above the first and second sprockets 211, 212 may be vertically below the third sprocket 214 in the system vertical direction (i.e. in the +/−Z direction). As such, the continuous member 302 is tightened due to the displacement of the sprockets. That is, the continuous member 302 may be tightened between the first sprocket 211, the third sprocket 214, the fourth sprocket 228 and the fifth sprocket 230 and the continuous member 302 may remain tight between the second sprocket 212, the sixth sprocket 246, and the seventh sprocket 248. As such, in this configuration, the plurality of sprockets 301 may not be permitted to rotate to permit rising in the system vertical direction (i.e., in the +Z direction) because the continuous member 302 is restricting the plurality of sprockets 301 from rotation in this direction.

It should be appreciated that in addition to the example first tower actuator assembly 102 and the plurality of telescoping sections taking on any shape or structure and is not limited by the disclosure herein, the example linkage assembly 300 may make take on any shape or structure and is not limited by the disclosure herein. Further, in some embodiments, the single tower assembly has only one linkage assembly. As such, in this embodiment, the linkage assembly may be positioned in the middle of the single tower assembly and only requires one actuator.

Now referring to the FIG. 6, an isolated perspective view of the movable arm assembly 112 with the lateral telescoping assembly 113*a* in an extend state and a user interface device 135 coupled to the lower section 102*a* of the tower actuator assemblies 102, 104 are schematically depicted. The assistive robot system 100 includes the user interface device 135 having a display 140 (e.g., a touch screen display). For example, as shown in FIGS. 2 and 6, the user interface device 135 may be coupled to an upper portion of the mast 103 of the assistive robot system 100, similar to the position of the pair handles as described in detail above. However, it should be understood that such a location is merely illustrative and the user interface device 135 may be coupled to other portions of the assistive robot system 100 or may be a separate component that is not coupled to the assistive robot system 100 without departing from the scope of the present disclosure. The user interface device 135 may generally provide one or more user-facing functions, including, but not limited to, providing the user with controls for controlling movement of the assistive robot system 100 including control of movement of the movable arm assembly 112 and the base 106 and providing the user with controls for controlling settings of the assistive robot system 100, and/or the like. It should be understood that the user interface device 135 may provide other functionality not specifically described herein without departing from the scope of the present disclosure.

Figure 7A:
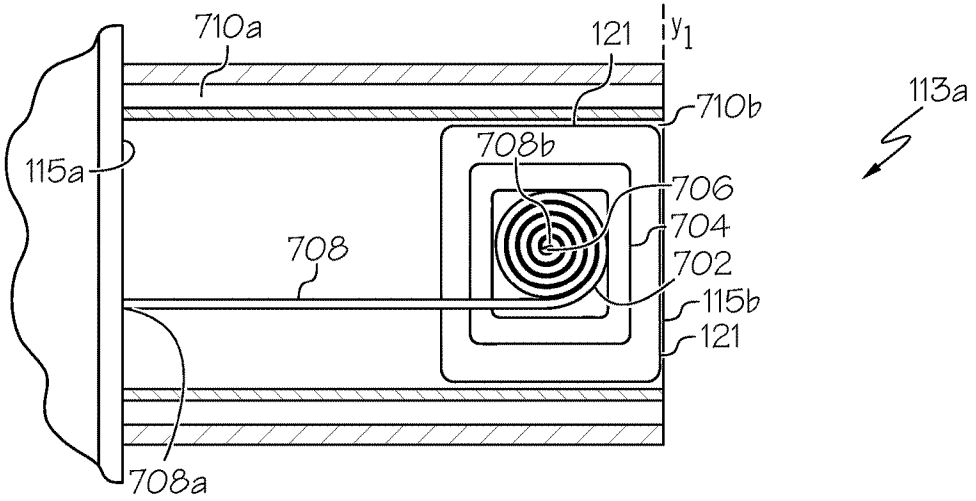
FIG. 7A schematically depicts an isolated view of the example lateral telescoping assembly of FIG. 6 in a first position according to one or more embodiments shown and described herein.
Figure 7B:
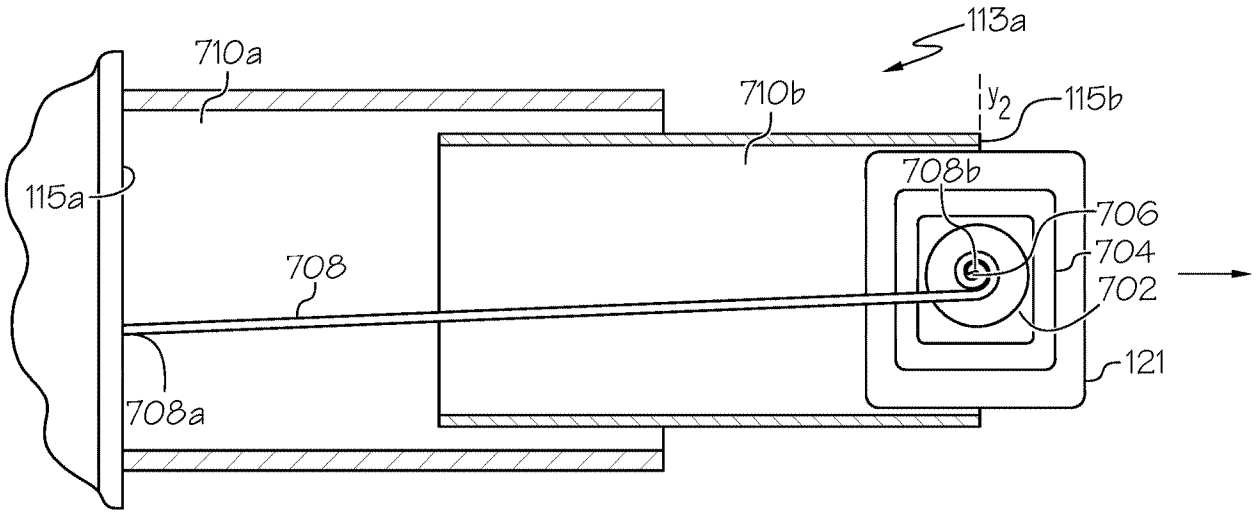
FIG. 7B schematically depicts an isolated view of the example lateral telescoping assembly of FIG. 9A in a second position according to one or more embodiments shown and described herein.

Referring now to FIGS. 6 and 7A-7B, the lateral telescoping assembly 113*a* of the movable arm assembly 112 will now be described. The lateral telescoping assembly 113*a* has a plurality of telescoping segments. In the illustrated embodiment, the lateral telescoping assembly 113*a* is two segments: a first lateral segment 710*a* and a second lateral segment 710*b*. The first lateral segment 710*a* has a lateral attachment end 115*a* that is configured to be coupled to the connector 114 (FIG. 2). The second lateral segment 710*b* has a lateral arm distal end 115*b* is coupled to and housed within a housing 121. The housing 121 is positioned laterally outwardly (i.e., in the +/−Y direction) from the first and second tower actuator assemblies 102, 104 and opposite the lateral attachment end 115*a* that is configured to be coupled to the connector 114 (FIG. 2). As such, the lateral telescoping assembly 113*a* extends laterally from the first tower actuator assembly 102 in a system lateral direction (i.e., in the +/−Y direction) and telescopes in the system lateral direction (i.e., in the +/−Y direction) between a retracted, or first position Y1 and an extended, or second position Y2. The lateral telescoping assembly 113*a* further includes a drum 702 and an actuator 704. The drum 702 is rotatably coupled to the actuator 704 via a connector 706 such as a shaft, a rod, and/or the like. The drum 702 is configured to rotate, in either direction, upon an activation of the actuator 704. Further, the drum 702 is configured to house a coiled member 708, such a as belt or a chain. In some embodiments, the coiled member 708 is a rigid member such as a lead screw, a rack and pinion assembly, a rigid chain, and the like. The coiled member 708 includes a first end 708*a* and a second end 708*b*. The first end 708*a* may be attached to the first tower actuator assembly 102 and the second end 708*b* may be attached to the drum 702. In some embodiments, the first end 708*a* of the coiled member 708 may be attached to the connector 114. The coiled member 708 may be configured to coil tightly around a circumference of the drum 702 and itself when the first lateral segment 710*a* and the second lateral segment 710*b* are in the retracted state Y1.

Conversely, the coiled member 708 may loosen and expand its coil during the unwinding or uncoiling from the drum 702 when the second lateral segment 710*b* is extended from the first lateral segment 710*a* at the second position Y2. As such, when the lateral telescoping assembly 113*a* is extended from the retracted position Y1 into the extended position Y2, the coiled member 708 pushes the second lateral segment 710*b* away from the first lateral segment 710*a* and the first tower actuator assembly 102. It should be appreciated that the second lateral segment 710*b* telescopes across a surface of the first lateral segment 710*a* such that the first lateral segment 710*a* is generally stationary and/or has less telescoping movement in the system lateral direction (i.e. in the +/−Y direction) than the second lateral segment 710*b*. In some embodiments, the second lateral segment 710*b* telescopes away from the first tower actuator assembly 102. In some embodiments, the coiled member 708 is spring loaded when coiled onto the drum 702. As such, when extending the second lateral segment 710*b* from the first lateral segment 710*a* in the system lateral direction (i.e., in the +/−Y direction), the coiled member 708 pushes the second lateral segment 710*b* away from the first lateral segment 710*a* and the first tower actuator assembly 102 using the actuator 704. During retraction, the second lateral segment 710*b* is retracted onto the first lateral segment 710*a* in the system lateral direction (i.e., in the +/−Y direction) without the need for the actuator 704. That is, the coiled member 708 may coil itself during retraction. It should be appreciated that the coiled member 708 is stiff enough to push the second lateral segment 710*b* away from the first lateral segment 710*a* and flexible enough to coil over itself onto the drum 702. Further, it should be appreciated that the coiled member 708 may self-regulate its own recoil speed based on, for example, the stiffness or rigidness of the coiled member 708. That is, the flexibility the coiled member 708 may determine the recoil speed and the strength of the coiled member 708.

Referring now to FIGS. 6 and FIGS. 8A-8C, the longitudinal telescoping assembly 113*b* of the movable arm assembly 112 will now be described. The longitudinal telescoping assembly 113*b* has a plurality of telescoping segments. In the illustrated embodiment, the telescoping segments are boxed beams that each have a different sized inner area such that each segment may nest in another telescoping segment. In some embodiments, the arrangement of each segment is an inverse pyramid. In the illustrated embodiment, the longitudinal telescoping assembly 113*b* is three segments: a first longitudinal segment 802*a*, a second longitudinal segment 802*b*, and a third longitudinal segment 802*c*. It should be understood that more or fewer segments may be provided. The first longitudinal segment 802*a* may include an attachment end 804*a* that is coupled to housing 121. In some embodiments, the attachment end 804*a* is coupled to the outer surface 116 of the housing 121 such that the longitudinal telescoping assembly 113*b* extends from the outer surface 116 of the housing 121 in a direction perpendicular to the lateral telescoping assembly 113*a*.

Figures 8A, 8B, 8C:
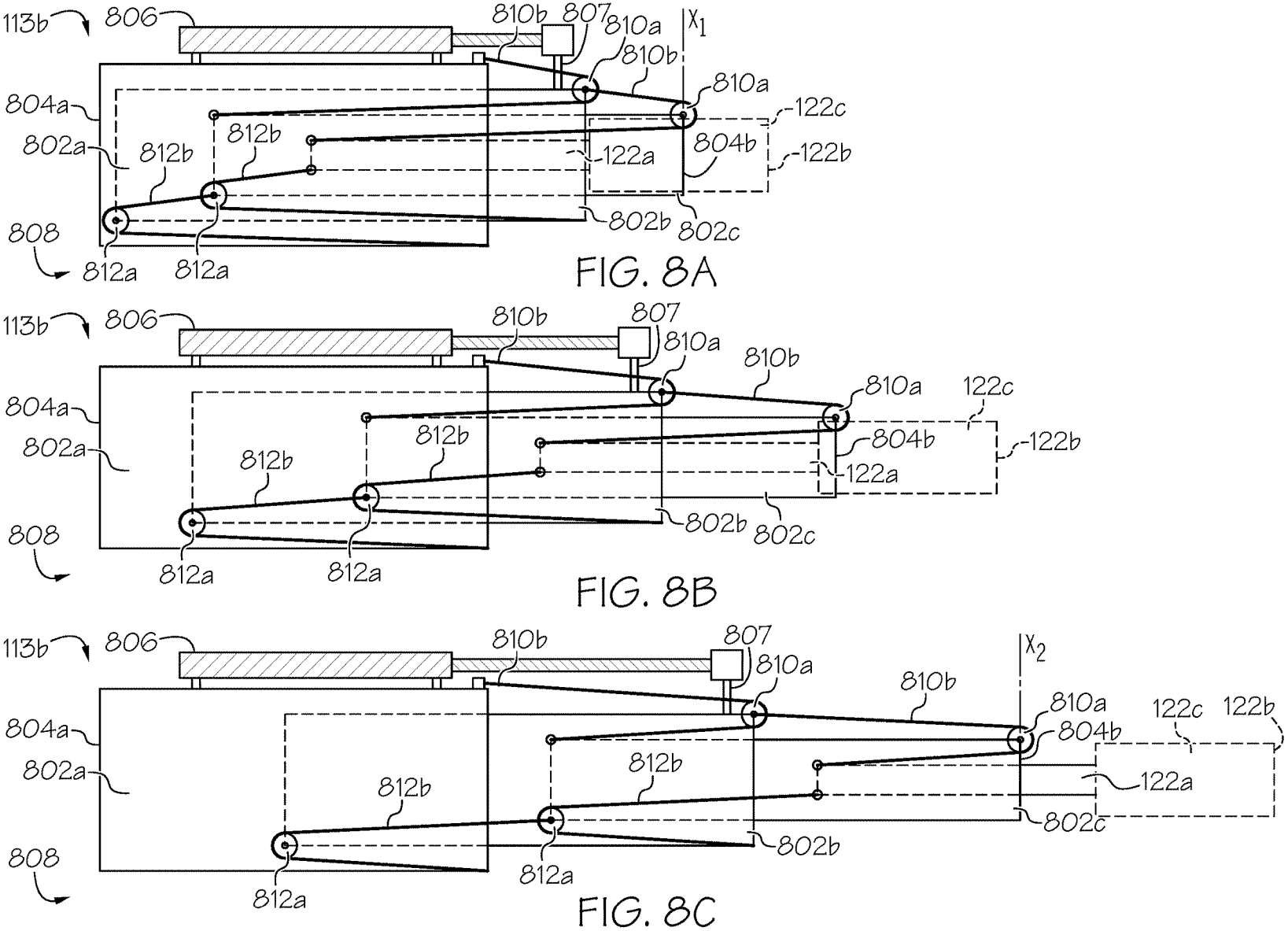
FIG. 8A schematically depicts an isolated view of the example longitudinal telescoping assembly of FIG. 6 in a first position according to one or more embodiments shown and described herein.
FIG. 8B schematically depicts an isolated view of the example longitudinal telescoping assembly of FIG. 8A in a mid-position according to one or more embodiments shown and described herein.
FIG. 8C schematically depicts an isolated view of the example longitudinal telescoping assembly of FIG. 8A in a second position according to one or more embodiments shown and described herein.

The third longitudinal segment 802*c* includes a distal end 804*b*. The longitudinal telescoping assembly 113*b* extends longitudinally from the lateral telescoping assembly 113*a* in a system longitudinal direction (i.e., in the +/−X direction) between a retracted, or first position X1 and an extended, or second portion X2. To facilitate movement, a linear actuator 806 is mounted to the first longitudinal segment 802*a* and operably coupled to the second longitudinal segment 802*b*. In some embodiments, the linear actuator 806 is coupled to the second longitudinal segment 802*b* via a peg 807 that extends from an outer surface of the second longitudinal segment 802*b*. In other embodiments, the linear actuator 806 may be coupled to the second longitudinal segment 802*b* by a fastener such as a bolt and nut, screws, rivets, and the like. It should be appreciated that the linear actuator 806 may be electrically driven, pneumatically driven, hydraulically driven, and the like. Further, the linear actuator 806 may be a cylinder, a motor, and the like having a shaft, a rod, and the like that moves the telescoping segments between the first position X1 and the second position X2 in a uniform movement, as discussed in greater detail herein. It should be appreciated that FIG. 8B illustrates a mid-position between the first position X1 and the second position X2, however this is not limiting and the telescoping segments may move anywhere and stop anywhere between the first position X1 and the second position X2.

Each of the telescoping segments are interconnected to the second longitudinal segment 802*b* via a dual pulley system 808. The dual pulley system 808 includes a plurality of pulleys 810*a* and pulley members 810*b* for use during the extension of the longitudinal telescoping assembly 113*b* to the second position X2. In some embodiments, the plurality of pulleys 810*a* are positioned on an outer surface of each telescoping section and the pulley members 810*b* are routed on the outer surface of each of the telescoping segments. Further, the dual pulley system 808 includes a plurality of pulleys 812*a* and pulley members 812*b* for use during the retraction of the longitudinal telescoping assembly 113*b* to the first position X1. In some embodiments, the plurality of pulleys 812*a* are positioned within the interior area of each telescoping section and the pulley members 812*b* are routed through the interior area of each of the telescoping segments. The pulley members 810*b*, 812*b* may be a chain, a belt, a rope, a string, and the like. It should be appreciated that the dual pulley system 808 works in conjunction with the linear actuator 806 such that each segment of the longitudinal telescoping assembly 113*b* extends and retracts in a uniform movement. It should be appreciated that FIG. 8B illustrates a mid-position between the first position X1 and the second position X2, however this is not limiting and the telescoping segments may move anywhere and stop anywhere between the first position X1 and the second position X2.

In some embodiments, when the linear actuator 806 extends in the system longitudinal direction, the pulley members 810*b* is moved through the plurality of pulleys 810*a* such that the pulley members 810*b* moves the telescoping segments (i.e., the second longitudinal segment 802*b* and the third longitudinal segment 802*c*). In other embodiments, when the linear actuator 806 retracts in the system longitudinal direction, the pulley members 812*b* is moved through the plurality of pulleys 812*a* such that the pulley members 812*b* moves the telescoping segments (i.e., the second longitudinal segment 802*b* and the third longitudinal segment 802*c*).

It should be appreciated that the box beam configuration along with the dual pulley system 808 and the nesting arrangement permit the longitudinal telescoping assembly 113*b* to lift, hold, lower, place, maintain, and/or the like, a plurality of containers with varying weights. That is, the assistive robot system 100 and in particular the longitudinal telescoping assembly 113*b*, while in both the first position X1 and/or in the second position X2 is robust such that the longitudinal telescoping assembly 113*b* is configured to lift, lower, tilt, and the like, containers that weigh much more that the assistive robot system 100. It should be appreciated that the longitudinal telescoping assembly 113*b* is not bound by the first position X1 and the second position X2 and that there are a plurality of positions therebetween that the linear actuator 806 and/or the dual pulley system 808 may position the first longitudinal segment 802*a*, the second longitudinal segment 802*b*, and the third longitudinal segment 802*c*.

In some embodiments, the example gripping assembly 122 is attached to the third longitudinal segment 802*c* and operably connected to the dual pulley system 808. A portion of the attachment portion 122*a* is nested within the interior area of the third longitudinal segment 802*c* and is configured to extend and/or retract into and out of the interior area of the third longitudinal segment 802*c*. In some embodiments, in operation, when the linear actuator 806 actuates the longitudinal telescoping assembly 113*b* and the dual pulley system 808, the attachment portion 122*a* extends and retracts with each of the second longitudinal segment 802*b*, and the third longitudinal segment 802*c* of the longitudinal telescoping assembly 113*b* in a uniform movement thereby changing or modifying the position of the gripping portion 122*b*. As best shown in FIG. 8A, it should be appreciated that in the first position X1, the attachment portion 122*a* of the gripping assembly 122, much like the third longitudinal segment 802*c*, is nested within the interior area of the second longitudinal segment 802*b*, which in turn is nested within the interior area of the first longitudinal segment 802*a*. In the X1 position, a portion of the gripping portion 122*b* is positioned along the inside surface of the third longitudinal segment 802*c*. In other embodiments, when the container is gripped by the movable arm assembly 112, the example gripping assembly 122 may remain in the extended position independent of the position of the telescoping segments. As such, the attachment portion 122*a* and/or the gripping portion 122*b* of the example gripping assembly 122 maintains contact with the container even when the telescoping segments are in the X1 or retracted position.

As discussed above, the inside surface 122*c* of the gripping portion 122*b* may be a pad that is contoured, textured, and/or a combination thereof. For example, the inside surface 122*c* may be a pad with chevron ridges, rounded ridges, deep waves, and/or the like, configured to grip the container. In other embodiments, the gripping portion 122*b* may be a hook, a clasp, and/or the like, configured to grip a plurality of containers, each container having a different shape, as discussed in greater detail herein.

Referring now to FIGS. 6 and. 9A-9C, an additional or a second embodiment of the example movable arm assembly 112 will now be described. It should be appreciated that for like elements, the same reference numerals are used. In the illustrated embodiment, the example movable arm assembly 112 includes another example longitudinal telescoping assembly 113*c*. The longitudinal telescoping assembly 113*c* has a plurality of telescoping segments. In the illustrated embodiment, the longitudinal telescoping assembly 113*c* has three segments: a first slide segment 117*a*, a second slide segment 117*b*, and a third slide segment 117*c*. It should be understood that more or fewer segments may be provided. In some embodiments, the first slide segment 117*a* includes an attachment end 118*a* that is coupled to an attachment plate 119. The attachment plate 119 is mounted to the housing 121 and extends from the housing 121 such that the longitudinal telescoping assembly 113*c* extends from an attachment plate 119 in a direction traverse to or perpendicular to the lateral telescoping assembly 113*a* in the system longitudinal direction (i.e., in the +/−X direction).

The third slide segment 117*c* of the longitudinal telescoping assembly 113*c* includes a distal end 118*b*. The longitudinal telescoping assembly 113*c* is configured to move between a retracted, or first position X'1 and an extended, or second portion X'2. It should be appreciated that FIG. 9B illustrates a mid-position between the first position X'1 and the second position X'2, however this is not limiting and the telescoping segments may move anywhere and stop anywhere between the first position X'1 and the second position X'2. The longitudinal telescoping assembly 113*c* further includes a drum 902 and an actuator 904. The drum 902 is rotatably coupled to the actuator 904 via a connector 906 such as a shaft, a rod, and/or the like. The drum 902 is configured to rotate, in either direction, upon an activation of the actuator 904. Further, the drum 902 is configured to house a coiled member 908, such a as belt or a chain. In some embodiments, the coiled member 908 is a rigid member such as a lead screw, a rack and pinion assembly, a rigid chain, and the like. The coiled member 908 includes a first end 908*a* and a second end 908*b*. The first end 908*a* is attached to a second example gripping assembly 123 and the second end 908*b* is attached to the drum 902. In some embodiments, the first end 908*a* of the coiled member 908 is attached to the third slide segment 117*c*. In embodiments, the coiled member 908 is configured to coil tightly around a circumference of the drum 902 and itself when the longitudinal telescoping assembly 113*c* is in the retracted state X'1. Conversely, the coiled member 908 loosens and expands its coil during the unwinding or uncoiling from the drum 902 while the longitudinal telescoping assembly 113*c* is being extended into the second position X'2. As such, when extending the longitudinal telescoping assembly 113*c* from the retracted position X'1 into the extended position X'2, the coiled member 908 may push the second example gripping assembly 123, which in turn pulls the third slide segment 117*c* and the second slide segment 117*b* from the first slide segment 117*a*.

Still referring to FIGS. 6 and 9A-9C, in some embodiments, the third slide segment 117*c* and the second slide segment 117*b* telescope along a longitudinal linear rail and across an inner surface 120*a* of the first slide segment 117*a* such that the first slide segment 117*a* is generally stationary and/or has less telescoping movement in the system longitudinal direction (i.e. in the +/−X direction) than the third slide segment 117*c* and/or the second slide segment 117*b*. It is appreciated that the longitudinal linear rail is mounted to the inner surfaces 120*a* of the first slide segment 117*a*, and inner surfaces 120*b*, 120*c* of the second and third slide segments 117*b*, 117*c* of the longitudinal telescoping assembly 113*c* and extends a length of the inner surfaces 120*a*, 120*b*, 120*c* in the system longitudinal direction (i.e., in the +/−X direction). It should be appreciated that the first slide segment 117*a* is fixedly mounted to the attachment plate 119. It should also be appreciated that the longitudinal telescoping assembly 113*c* may have other configurations and that the segments may be nested in any arrangement. For example, the arrangement described herein relating to the third slide segment 117*c* and the second slide segment 117*b* telescope along the longitudinal linear rail across the inner surface 120*a* of the first slide segment 117*a* is merely one example and is non-limiting.

In some embodiments, the coiled member 908 is spring loaded when coiled onto the drum 902. As such, when extending the longitudinal telescoping assembly 113*c*, the coiled member 908 retracts the gripping assembly 123, the second slide segment 117*b* and the third slide segment 117*c* towards the attachment plate 119 along the longitudinal linear rail without the need for the actuator 904. It should be appreciated that the actuator 904 is used to drive or extend the second example gripping assembly 123, the second slide segment 117*b*, and the third slide segment 117*c* into the extend position X'2 along the longitudinal linear rail. Further, it should be appreciated that the coiled member 908 coils upon itself during retraction. In embodiments, the coiled member 908 is stiff enough to push or extend the second example gripping assembly 123 in the system longitudinal direction (i.e., in the +/−X direction) such that the second example gripping assembly 123 pulls the third slide segment 117*c* and the second slide segment 117*b* and is also flexible to coil over itself onto the drum 902. Further, it should be appreciated that the coiled member 908 may self-regulate its own recoil speed based on, for example, the stiffness or rigidness the coiled member 908. That is, the flexibility the coiled member 908 may determine the recoil speed and the strength of the coiled member 908.

Still referring to FIGS. 6 and 9A-9C, the second example gripping assembly 123 may be slidably attached to the inner surface 120*c* of the third slide segment 117*c* of the longitudinal telescoping assembly 113*b* along the longitudinal linear rail such that the coiled member 908 drives the second example gripping assembly 123 to extend and retract each of the slide segments 117*b*, 117*c* of the longitudinal telescoping assembly 113*c*. When the longitudinal telescoping assembly 113*c* is retracted, or in the first position X'1, the second example gripping assembly 123 may be adjacent to the attachment end 118*a*. Conversely, when the longitudinal telescoping assembly 113*c* is extended, or in the second position X'2, the second example gripping assembly 123 may be adjacent to the distal end 118*b*.

In some embodiments, an outside surface 123*b* of the second example gripping assembly 123 engages with the longitudinal linear rail of the longitudinal telescoping assembly 113*c*. Further, in some embodiments, an inside surface 123*a* of the second example gripping assembly 123 may be a pad that is be contoured, textured, and/or a combination thereof. For example, the inside surface 123*a* may be a pad with chevron ridges, rounded ridges, deep waves, and/or the like. In other embodiments, the second example gripping assembly 123 may be a hook, a clasp, and/or the like, configured to grip a plurality of containers, each container having a different shape, as discussed in greater detail herein.

Figure 10C:
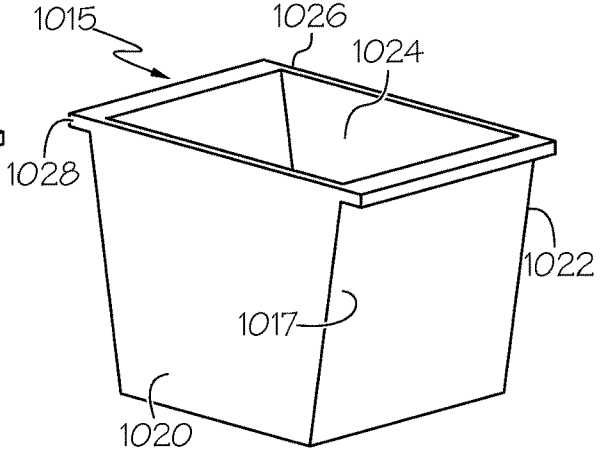
FIG. 10C schematically depicts a perspective view of a third example container according to one or more embodiments shown and described herein.
Figure 10B:
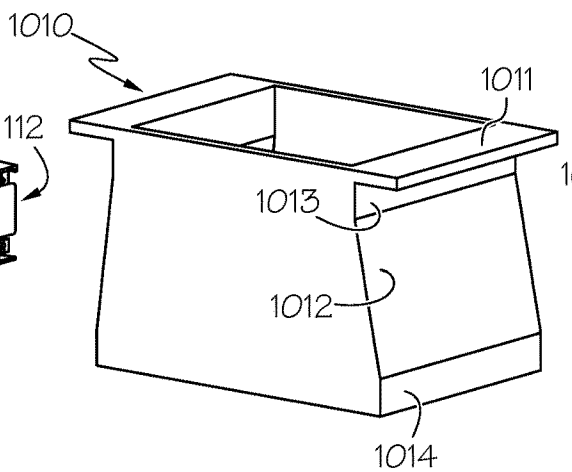
FIG. 10B schematically depicts a perspective view of a second example container according to one or more embodiments shown and described herein.
Figure 10A:
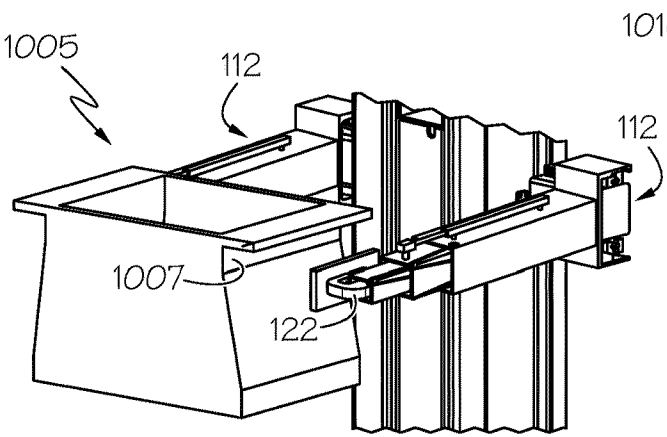
FIG. 10A schematically depicts a perspective view of a first example container according to one or more embodiments shown and described herein.
Figure 10F:
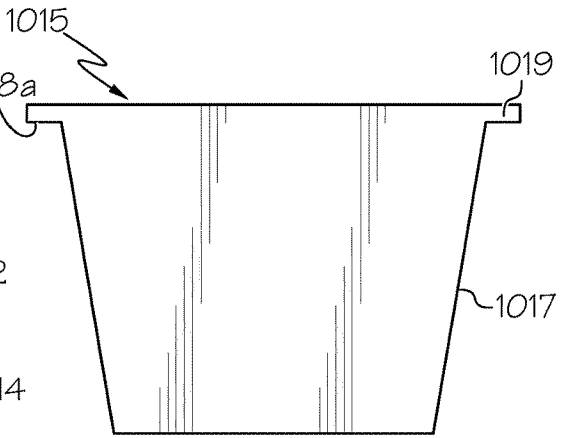
FIG. 10F schematically depicts a front view of the third example container of FIG. 10C according to one or more embodiments shown and described herein.
Figure 10E:
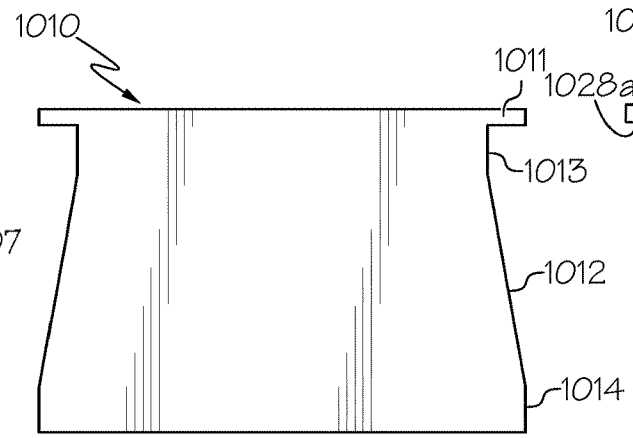
FIG. 10E schematically depicts a front view of the second example container of FIG. 10B according to one or more embodiments shown and described herein.
Figure 10D:
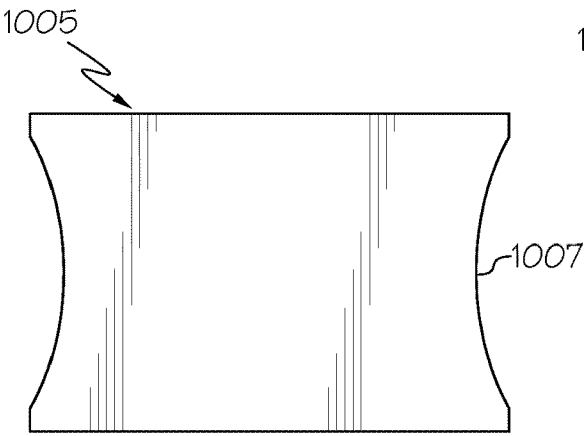
FIG. 10D schematically depicts a front view of the first example container of FIG. 10A according to one or more embodiments shown and described herein.

Referring now to FIGS. 10A-10F, non-limiting container shapes are illustrated and described. FIG. 10A is a perspective view of a first example container 1005 and FIG. 10D is a front view of the first example container 1005 of FIG. 10A. The first example container 1005 includes a pair of parabolic sidewalls 1007. The movable arm assembly 112 and, in particular, the gripping assembly 122 is configured to be in contact with the pair of parabolic sidewalls 1007 so to grip, raise, place, store, lower, and/or the like the container 1005.

FIG. 10B is a perspective view of a second example container 1010 and FIG. 10E is a front view of the first example container 1010 of FIG. 10B. The second example container 1010 includes a pair of modified trapezoidal sidewalls 1012 having an upper flat region 1013 and a lower flat region 1014. The movable arm assembly 112 and the gripping assembly 122 are configured to be in contact with the pair of modified trapezoidal sidewalls 1012 so to grip, raise, place, store, lower, and/or the like the container 1010.

Figure 9A:
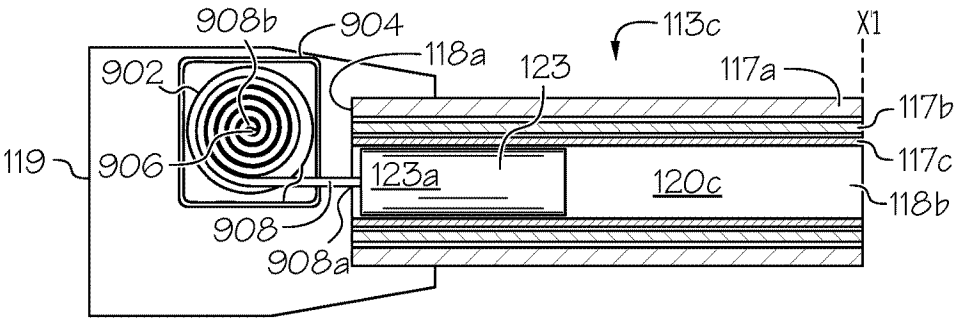
FIG. 9A schematically depicts an isolated view of a second example longitudinal telescoping assembly in a first position according to one or more embodiments shown and described herein.
Figure 9B:
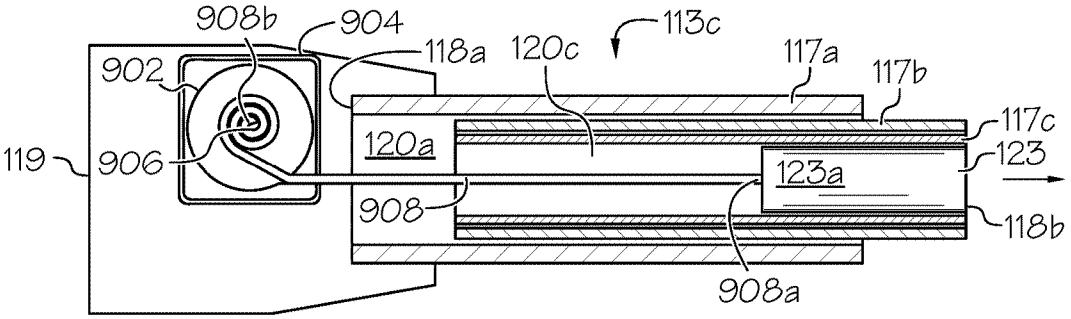
FIG. 9B schematically depicts an isolated view of the second example longitudinal telescoping assembly of FIG. 9A in a mid-position according to one or more embodiments shown and described herein.
Figure 9C:
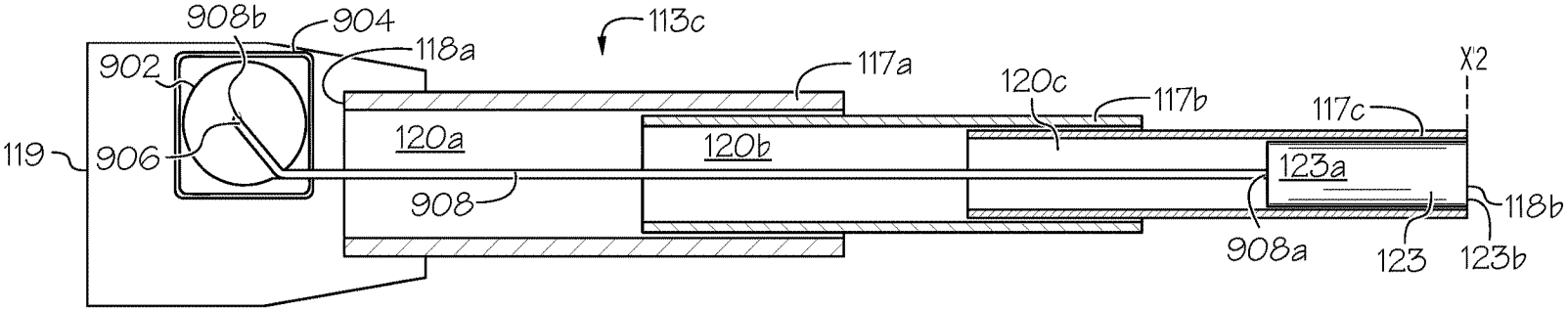
FIG. 9C schematically depicts an isolated view of the second example longitudinal telescoping assembly of FIG. 9A in a second position according to one or more embodiments shown and described herein.

FIG. 10C is a perspective view of a third example container 1015 and FIG. 10F is a front view of the third example container 1015 of FIG. 9A. The third example container 1015 includes a pair of trapezoidal sidewalls 1017, a front wall 1020 and a rear wall 1022 so to form a cavity 1024 having an opening 1026. A lip portion 1028 surrounds the circumference of the opening 1026. The movable arm assembly 112 and the gripping assembly 122 are configured to be in contact with the pair of trapezoidal sidewalls 1017 so to grip, raise, place, store, lower, and/or the like the container 1015.

Figure 11:
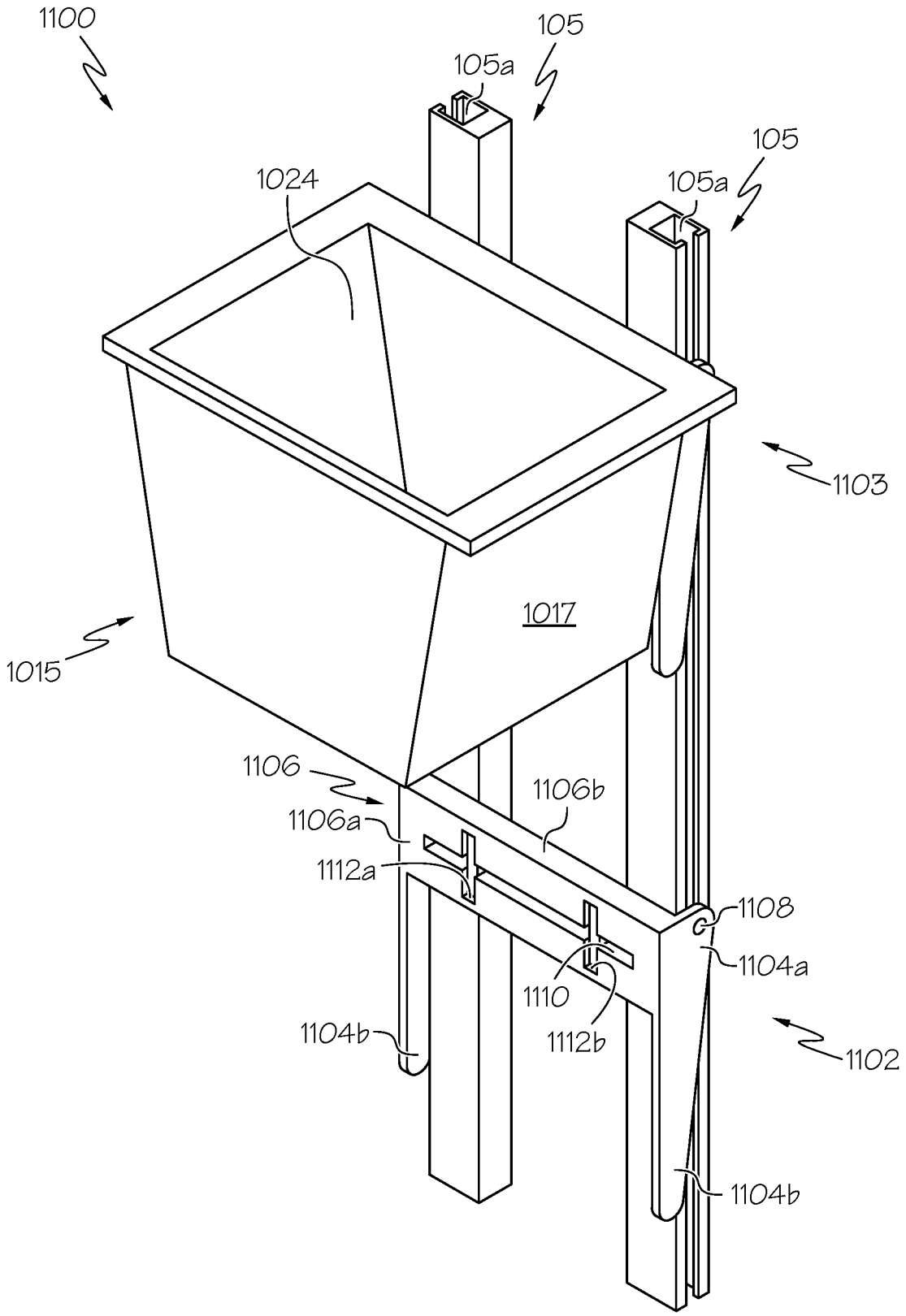
FIG. 11 schematically depicts an isolated perspective view of a container storing assembly according to one or more embodiments shown and described herein.

With reference now to FIG. 11, an isolated perspective view of an example container storage assembly 1100 for an assistive robot system will be described. The container storage assembly 1100 includes the pair of elongated members 105, a first example bracket 1102, a second example bracket 1103 mounted above the first example bracket 1102 in the system vertical direction (i.e., in the +/−Z direction) and the third example container 1015 releasably coupled or docked to the second example bracket 1103. The first example bracket 1102 and the second example bracket 1103 are mechanically coupled to the pair of elongated members 105 via the pair of elongated slots 105*a*, as discussed in greater detail herein. It should be appreciated that the first example bracket 1102 and the second example bracket 1103 are merely illustrative of one embodiment of the brackets, as discussed in greater detail herein.

With reference still to FIG. 11 and also now to FIGS. 12-14, a first embodiment of the first example bracket 1102 and a pair of latch mechanisms 1114 will be discussed. It should be appreciated that the first example bracket 1102 and the latch mechanism 1114 are described with the third example container 1015 being releasably coupled or docked to the first example bracket 1102. In this embodiment, the first example bracket 1102 includes a bracket elongated member 1106. It should be appreciated that the first example bracket 1102 may be mechanically coupled to the pair of elongated slots 105*a* by a fastener such as spring clamps and bolts, bolts and nuts, rivets, screws, and/or the like. The bracket elongated member 1106 includes a front surface 1106*a* and a top surface 1106*b*. In this embodiment, within the front surface 1106*a* of the bracket elongated member 1006 is a horizontal elongated slot 1110 that extends a length of the front surface 1106*a* of the bracket elongated member 1106 in the system lateral direction (i.e., in the +/−Y direction) and a first and second vertical slots 1112*a*, 1112*b* that intersect the horizontal elongated slot 1110 in the system vertical direction (i.e., in the +/−Z direction). The horizontal elongated slot 1110 and/or the first and second vertical slots 1112*a*, 1112*b* may be provided any structure in any arrangement such that there is no need for the horizontal elongated slot 1110 and/or the first and second vertical slots 1112*a*, 1112*b* in some embodiments. Further, in some embodiments, the first and/or the second vertical slots 1112*a*, 1112*b* intersect the horizontal elongated slot 1110 generally at a perpendicular or 90 degree angle. In other embodiments, the first and/or the second vertical slots 1112*a*, 1112*b* intersect the horizontal elongated slot 1110 at an angle so to be slanted or skewed. It should be appreciated that the angle may be an oblique angle or an acute angle.

In some embodiments, the first example bracket 1102 further includes a pair of opposing sidewalls 1104 spaced apart by the bracket elongated member 1106. The pair of opposing sidewalls 1104 have an upper surface 1104*a* larger than a lower surface 1104*b*. In embodiments, the upper surface 1104*a* is a tear drop shape and tapers from the upper surface 1104*a* towards the lower surface 1104*b* in the system vertical direction (i.e., in the −Z direction). In embodiments, the upper surface 1104*a*, and in particular, the teardrop shape of both opposing sidewalls each include a bore 1108 configured to mount the first example bracket 1102 to the pair of elongated slots 105*a* of the pair of elongated members 105. In some embodiments, the bracket elongated member 1106 may be a unitary construction with the pair of sidewalls 1104. In other embodiments, the bracket elongated member 1106 may be connected to the pair of opposing sidewalls 1104 via a plurality of fasteners, such as bolts and nuts, rivets, screws, and/or the like. Disposed within the first and second vertical slots 1112*a*, 1112*b* is the pair of latch mechanisms 1114. The pair of latch mechanisms 1114 may be rotary latches configured to accept the third example container 1015 into the horizontal elongated slot 1110 and configured to lock the third example container 1015 into the first example bracket 1102, as discussed in greater detail herein. In some embodiments, the pair of latch mechanisms 1114 may be any mechanical device configured to hold or accept and lock any container shape into either the first example bracket 1102 and/or the second example bracket 1103 of the container storage assembly 1100.

Figure 12:
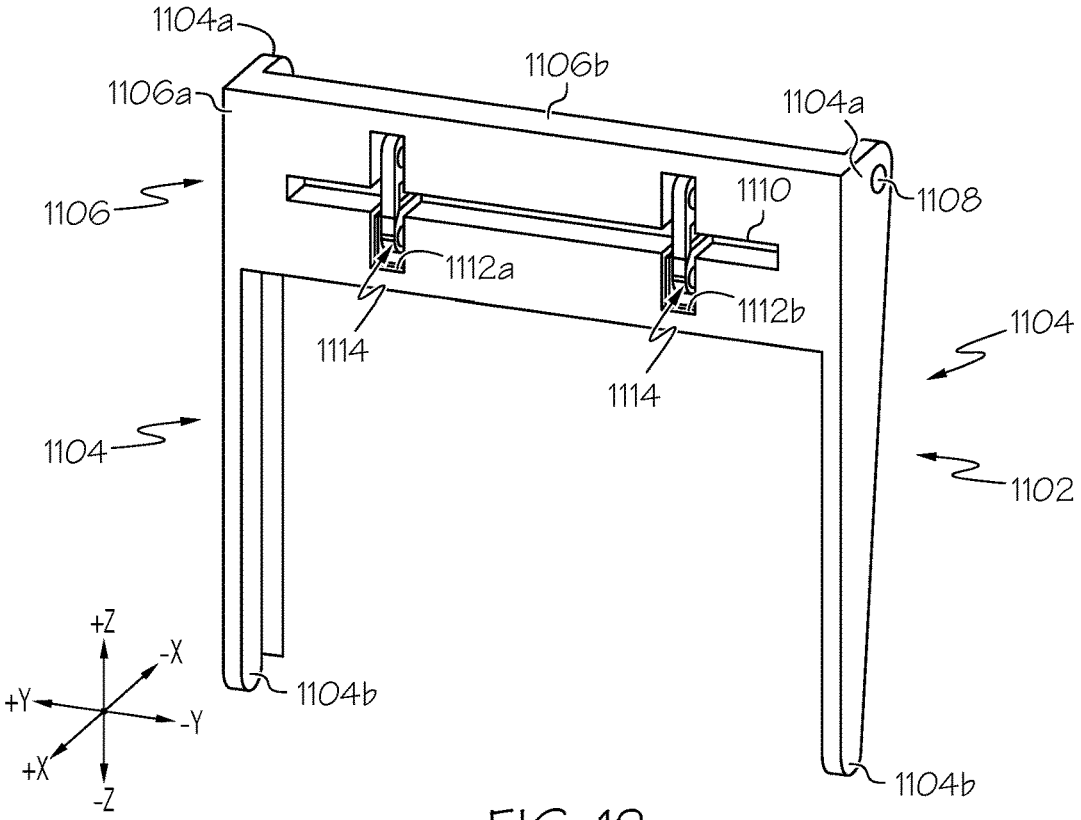
FIG. 12 schematically depicts an isolated perspective view of a first embodiment of a first example bracket according to one or more embodiments shown and described herein.
Figure 13:
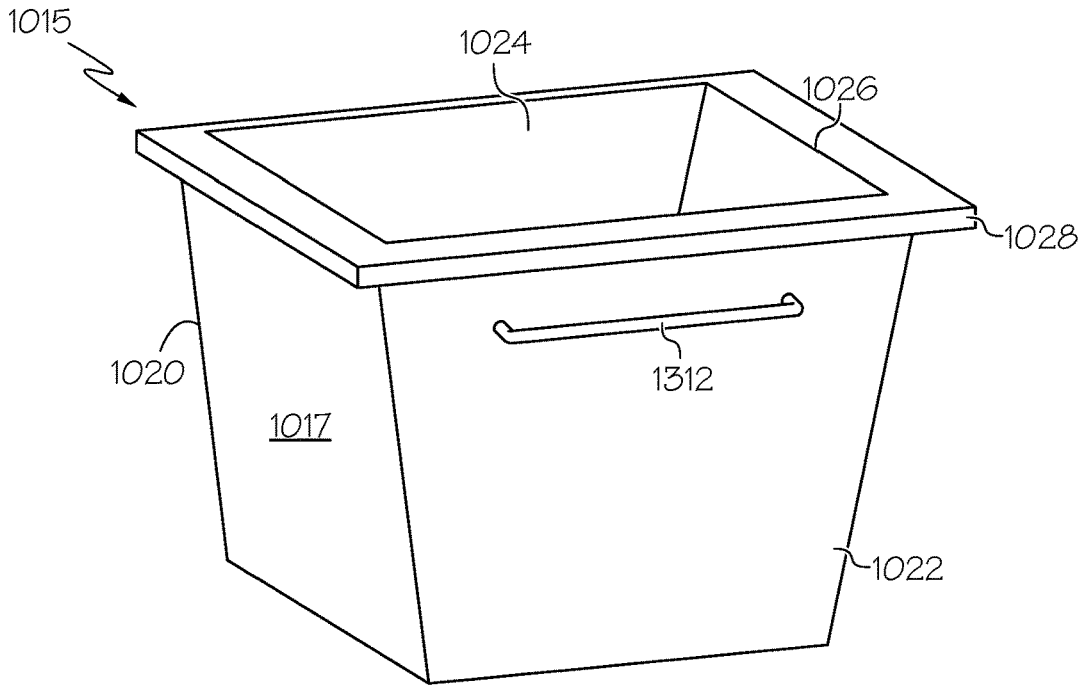
FIG. 13 schematically depicts an isolated perspective view of a first embodiment of a third example container according to one or more embodiments shown and described herein.

With particular reference to FIGS. 12-13, the third example container 1015 of this embodiment will now be discussed. An elongated rod member 1312 extends from the rear wall 1022 of the third example container 1015. The elongated rod member 1312 may be formed of a metal or a material capable of supporting the third example container 1015 and any contents within the cavity. As such, the elongated rod member 1312 is attached to, or integral with, the rear wall 1022 via any appropriate means. The elongated rod member 1312 is configured to engage with the horizontal elongated slot 1110 and locked into the horizontal elongated slot 1110 by the latch mechanism 1114 disposed within the pair of vertical slots 1112 so to store or stage the third example container 2015 onto the container storage assembly 1100. It should be appreciated that the third example container 1015 is not limited to an elongated rod member 1312 and that any shape may be used that is configured to engage within a depression on the bracket elongated member 1106

Figure 14:
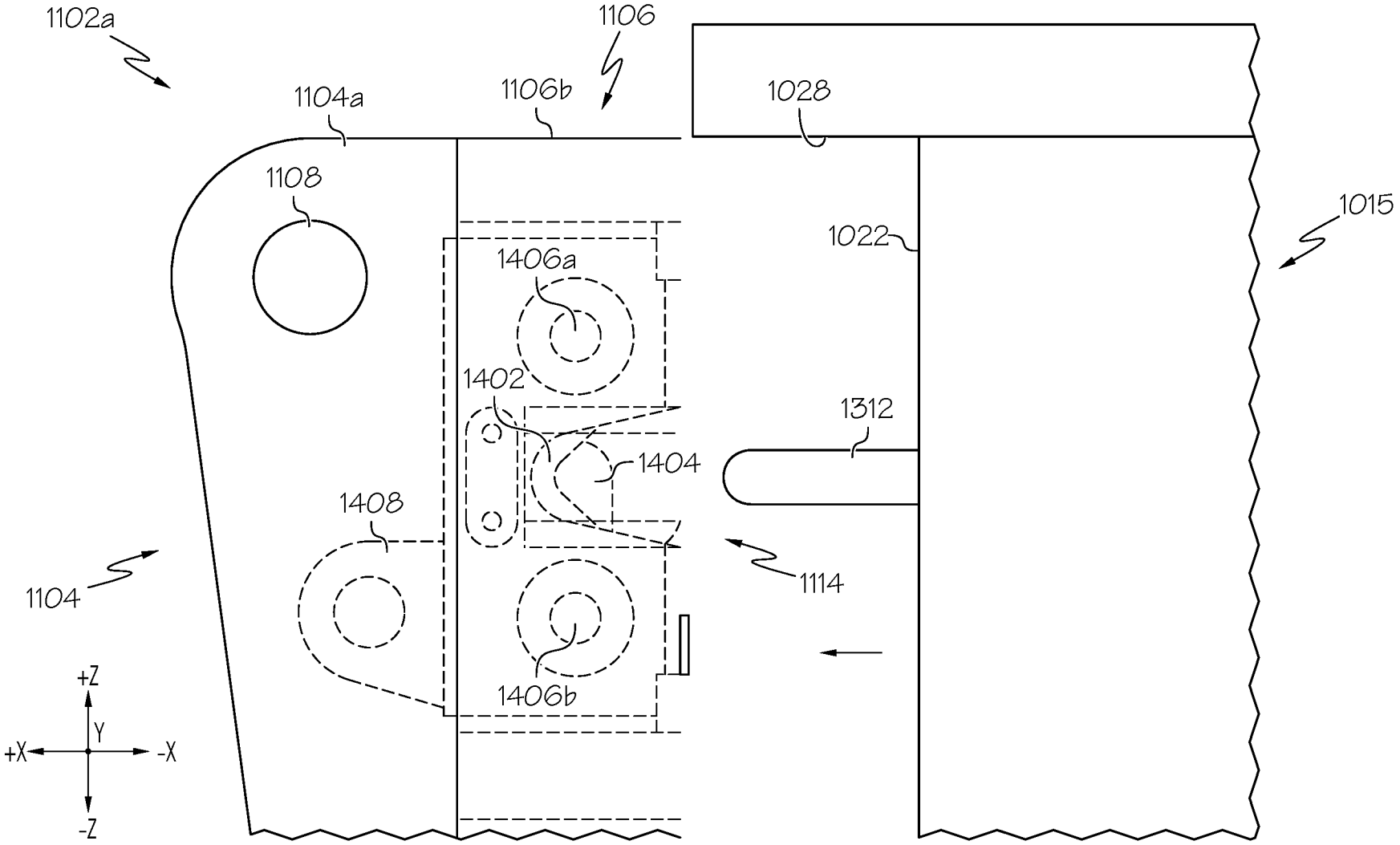
FIG. 14 schematically depicts a partial side view of a first embodiment of latch mechanism and the third example container of FIG. 13 according to one or more embodiments shown and described herein.
Figure 15:
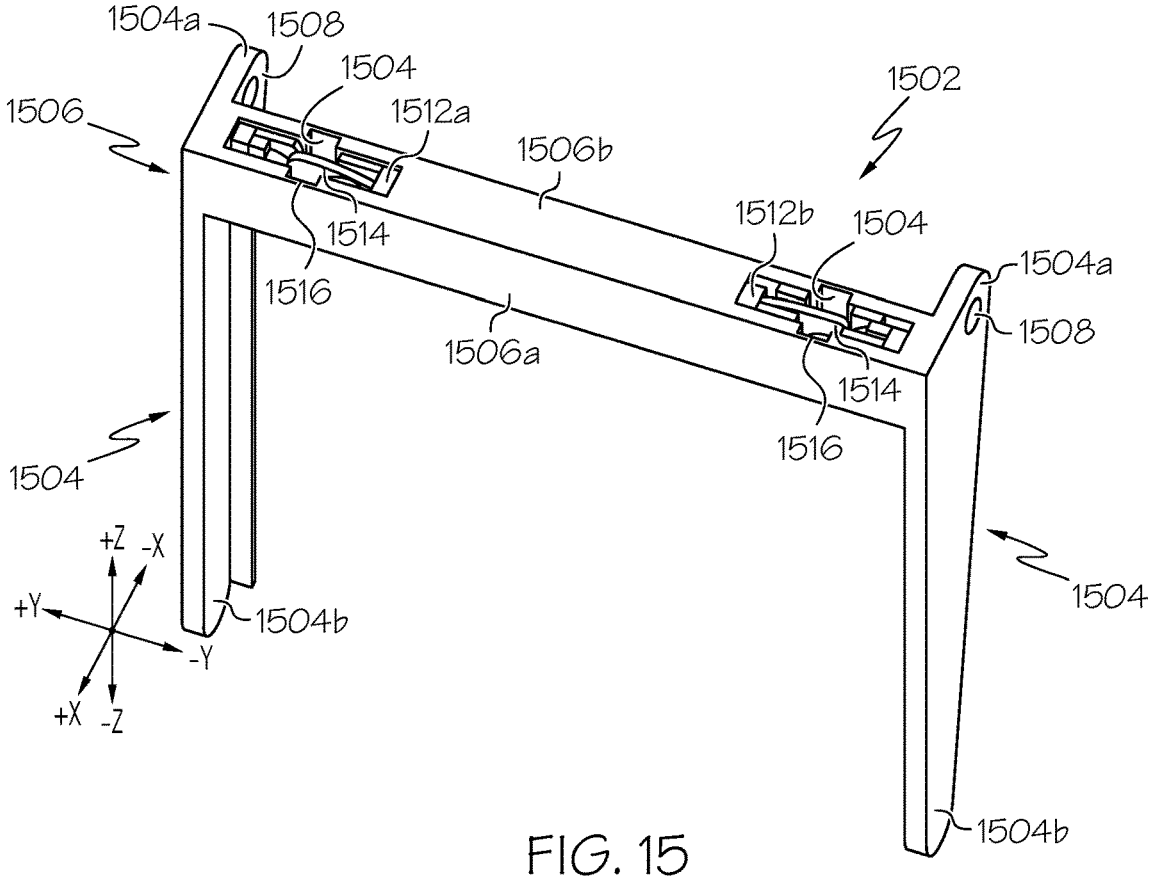
FIG. 15 schematically depicts an isolated perspective view of a second embodiment of a first example bracket according to one or more embodiments shown and described herein.

With reference now to FIG. 14, a partial side view of the latch mechanism 1114 in phantom will now be discussed. In this embodiment, the latch mechanism 1114 is orientated in a system vertical direction (i.e., in the +/−Z direction) such that the example receiving passage 1404 is oriented at the front surface 1106*a* of the bracket elongated member 1106. The latch mechanism 1114 is generally depicted in the closed position such that an example rotary jaw 1402 is blocking the receiving passage 1404. However, it should be appreciated that the closed position of the rotary jaw 1402 is configured to pivot or rotate upon contact with the elongated rod member 1312 such that the receiving passage 1404 is available to receive the elongated rod member 1312. The latch mechanism 1114 generally includes a pair of bushings 1406*a*, 1406*b* that are generally cylindrical and positioned above and below the receiving passage in a system vertical direction (i.e., in the +/−Z direction). One of the pair of bushings 1406*b* is operably coupled to a rotary pawl 1408 of the latch mechanism 1114. The other bushing 1406*a* of the pair of bushings is operably coupled to the rotary jaw 1402. As such, when the elongated rod member 1312 is received with the receiving passage 1404, the rotary jaw 1402 is rotated towards the horizontal elongated slot 1110 (FIG. 12) in the system longitudinal direction (i.e. in the +/−X direction) such that the rotary jaw 1402 rotates about one of the pair of bushings 1406*a* to engage with the elongated rod member 1312 thereby locking the elongated rod member 1312 into the receiving passage 1404. Simultaneously, the rotary pawl 1408 rotates about the other bushing of the pair of bushings 1406*b* so to permit the rotary jaw 1402 to rotate and lock in the elongated rod member 1312.

With reference now to FIGS. 11 and 15-17, a second example bracket 1502 and a pair of latch mechanisms 1514 will be discussed. It should be appreciated that the second example bracket 1502 and the latch mechanisms 1514 are described with the third example container 1015 being releasably coupled or docked to the second example bracket 1502. The second example bracket 1502 includes a bracket elongated member 1506. It should be appreciated that the second example bracket 1502 may be mounted to the pair of elongated slots 105*a* by a fastener such as spring clamps and bolts, bolts and nuts, rivets, screws, and/or the like. The bracket elongated member 1506 includes a front surface 1506*a* and a top surface 1506*b*. The front surface 1506*a* is not as wide in the system vertical direction (i.e., in the +/−Z direction) when compared to the first embodiment. Disposed within the top surface 1506*b* of the bracket elongated member 1506 is a first and second lateral slots 1512*a*, 1512*b* that extend a length of the top surface 1506*b* of the bracket elongated member 1506 in the system lateral direction (i.e., in the +/−Y direction). The first and second lateral slots 1512*a*, 1512*b* house the latch mechanism 1514. The pair of latch mechanisms 1514 may be rotary latches configured to accept and lock the u-shaped members 1602 of the third example container 1015 into each of the first and second lateral slots 1512*a*, 1512*b* so to lock the third example container 1015 into the second example bracket 1502, as discussed in greater detail herein. In some embodiments, the pair of latch mechanisms 1514 may be any mechanical device configured to hold or accept and lock a u-shaped member 1602 into each of the first and second lateral slots 1512*a*, 1512*b*.

In some embodiments, the second example bracket 1502 further includes a pair of opposing sidewalls 1504 spaced apart by the bracket elongated member 1506. In some embodiments, the pair of opposing sidewalls 1504 have an upper surface 1504*a* that is larger than a lower surface 1504*b*. In embodiments, the upper surface 1504*a* is a tear drop shape and tapers from the upper surface 1504*a* towards the lower surface 1504*b* in the system vertical direction (i.e., in the −Z direction). Further, in some embodiments, the upper surface 1504*a*, and in particular, the teardrop shape of both opposing sidewalls each include a bore 1508 configured to mount the second example bracket 1502 to the pair of elongated slots 105*a* of the pair of elongated members 105. In some embodiments, the bracket elongated member 1506 may be a unitary construction with the pair of sidewalls 1504. In other embodiments, the bracket elongated member 1506 may be connected to the pair of opposing sidewalls 1504 via a plurality of fasteners, such as bolts and nuts, rivets, screws, and/or the like.

Figure 16:
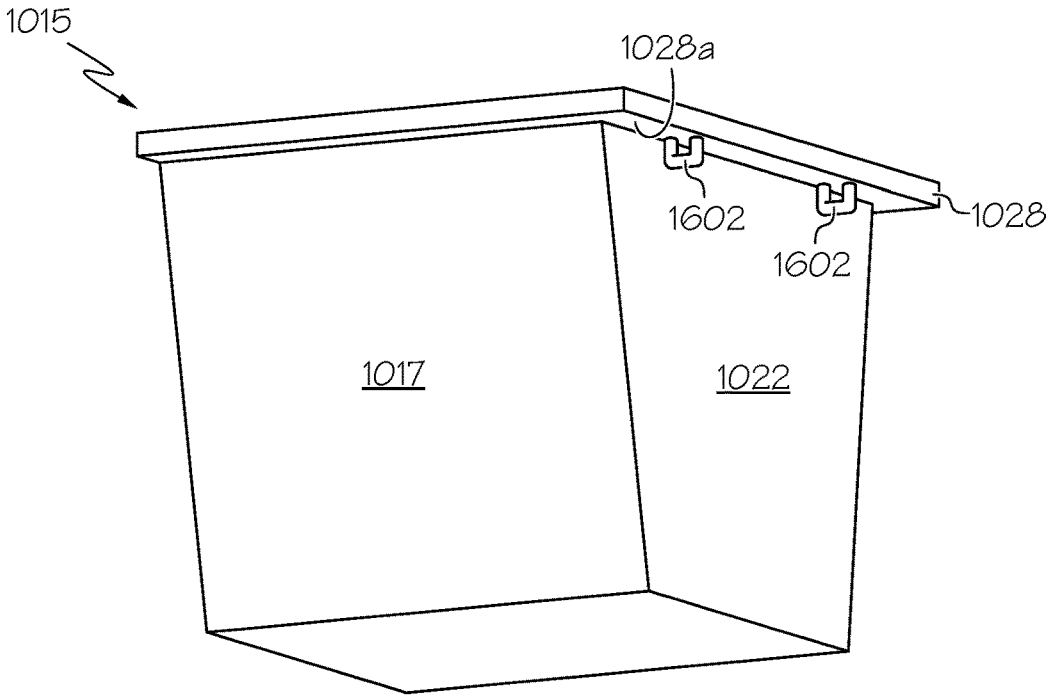
FIG. 16 schematically depicts an isolated perspective view of a second embodiment of a third example container according to one or more embodiments shown and described herein.
Figure 17:
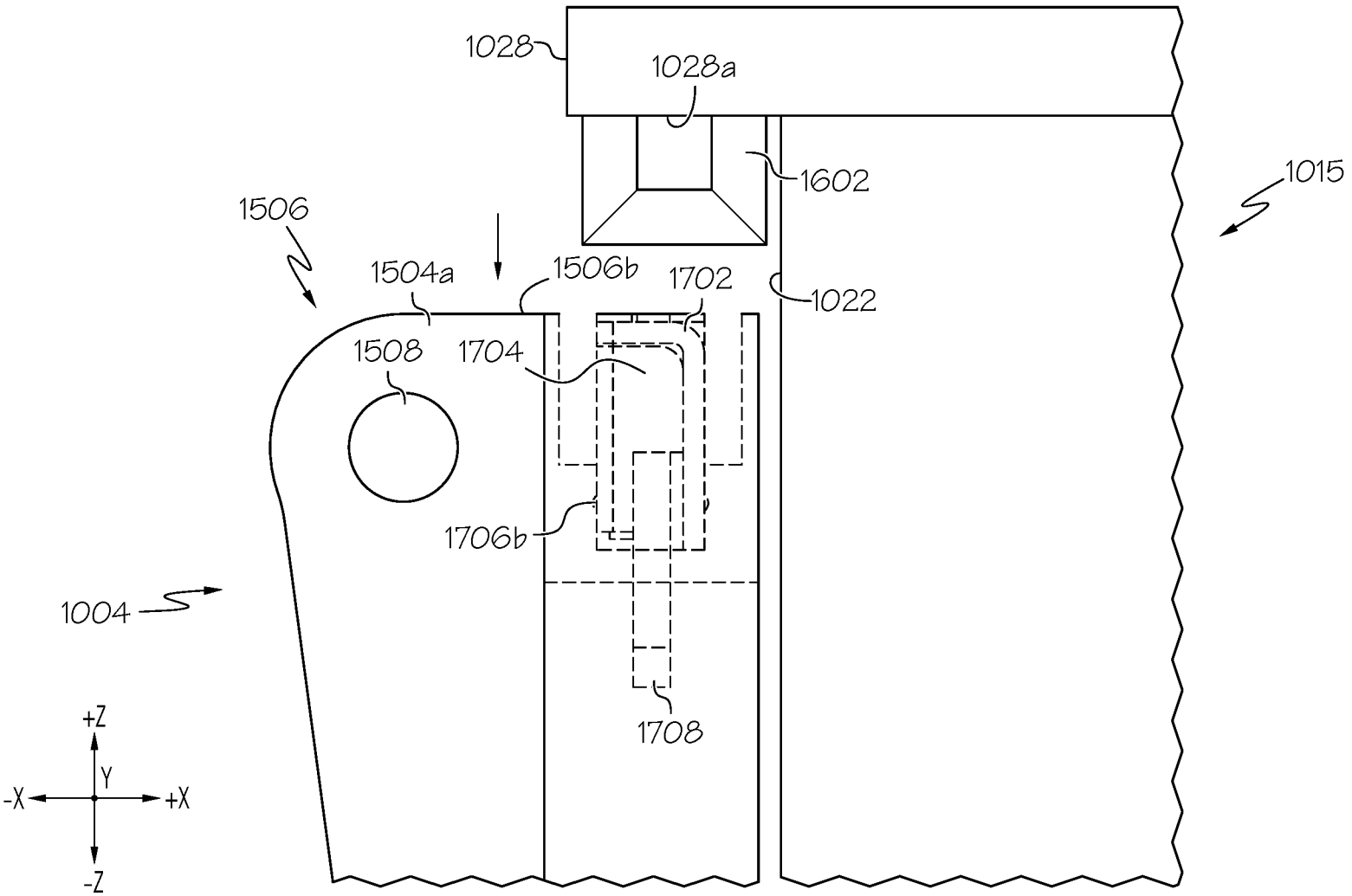
FIG. 17 schematically depicts a partial side view of a second embodiment of a latch mechanism and the third example container of FIG. 14 according to one or more embodiments shown and described herein.

Referring now to FIGS. 16 and 17, the pair of u-shaped members 1602 is disposed on the lower surface 1028*a* of the lip portion 1028. The pair of u-shaped members 1602 extend from the lower surface 1028*a* of the lip portion 1028 such that there is enough clearance for the pair of u-shaped members 1602 to slidably engage with the latch mechanism 1514. As such, the first and second lateral slots 1512*a*, 1512*b* may include recess channels 1516 that extend perpendicular or 90 degrees from the lateral slots 1512*a*, 1512*b* in the system longitudinal direction (i.e., in the +/−X direction). It should be appreciated embodiments are not limited to the pair of u-shaped members 1602 and that any shape may be used that is configured to engage within a depression on the bracket elongated member 1506.

The pair of u-shaped members 1602 may be formed of a metal or a material capable of supporting the third example container 1015 and any contents within the cavity 1024. As such, the pair of u-shaped members 1602 may be attached to, or integrated with, the lower surface 1028*a* of the lip portion 1028 via any appropriate means. The pair of u-shaped members 1602 may be configured to engage with the first and second lateral slots 1512*a*, 1512*b* and lock into the first and second lateral slots 1512*a*, 1512*b* by the latch mechanism 1514 disposed within the first and second lateral slots 1512*a*, 1512*b* such that the lower surface 1028*a* of the lip portion 1028 abuts the top surface 1506*b* of the bracket elongated member 1506.

With particular reference now to FIG. 17, a partial side view of the latch mechanism 1514 in phantom will now be discussed. In this embodiment, the latch mechanism 1514 is orientated in a system lateral direction (i.e., in the +/−Y direction) such that a second example receiving passage 1704 is oriented at the top surface 1506*b* of the bracket elongated member 1506. The latch mechanism 1514 is generally depicted in the closed position such that a second example rotary jaw 1702 is blocking the second example receiving passage 1704. However, it should be appreciated that the closed position of the rotary jaw 1702 is configured to pivot or rotate upon contact with the pair of u-shaped members 1602 such that the receiving passage 1704 is available to receive the pair of u-shaped members 1602. The receiving passage 1704 is configured to accept the pair of u-shaped members 1602 of the third example container 1015. The latch mechanism 1514 generally includes a pair of bushings 1406*a*, 1406*b* (FIG. 14), that are generally cylindrical and positioned inboard and outboard of the receiving passage 1404 in a system lateral direction (i.e., in the +/−Y direction). When the pair of u-shaped members 1602 is received within the receiving passage 1704, the rotary jaw 1702 rotates towards the pair of sidewalls 1504 in the system lateral direction (i.e. in the +/−Y direction) such that the rotary jaw 1702 rotates about one of the pair of bushings 1406*a*, 1406*b* (FIG. 14) to engage with the pair of u-shaped members 1602 thereby locking the pair of u-shaped members 1602 into the receiving passage 1704. Simultaneously, the rotary pawl 1708 rotates about the other bushing 1406*b* of the pair of bushings 1406*a*, 1406*b* (FIG. 14) so to permit the rotary jaw 1702 to rotate and lock in the pair of u-shaped members 1602.

With reference now to FIGS. 11 and 18-20, a third example bracket 1802 and a pair of latch mechanisms 1814 will be discussed. It should be appreciated that the third example bracket 1802 and the latch mechanisms 1814 are described with the third example container 1015 being releasably coupled or docked to the third example bracket 1802. The third example bracket 1802 includes a bracket elongated member 1806. It should be appreciated that the third example bracket 1802 may be mounted to the pair of elongated slots 105*a* by a fastener such as spring clamps and bolts, bolts and nuts, rivets, screws, and/or the like. The bracket elongated member 1806 includes a front surface 1806*a* and a top surface 1806*b*. The front surface 1806*a* is not as wide in the system vertical direction (i.e., in the +/−Z direction) when compared to the first example bracket 1202 (FIG. 12).

Disposed within the front surface 1806*a* of the bracket elongated member 1806 is a first and second lateral slot 1812*a*, 1812*b* that extend a length of the front surface 1806*a* of the bracket elongated member 1806 in the system lateral direction (i.e., in the +/−Y direction). The first and second lateral slots 1812*a*, 1812*b* house the latch mechanisms 1814. The pair of latch mechanisms 1814 may be rotary latches configured to accept and lock a u-shaped member 1902 into the first and second lateral slots 1812*a*, 1812*b* so to lock the third example container 1015 into the third example bracket 1802, as discussed in greater detail herein. In some embodiments, the pair of latch mechanisms 1814 may be any mechanical device configured to hold or accept and lock the u-shaped member 1902 into each of the first and second lateral slots 1812*a*, 1812*b*.

In some embodiments, the third example bracket 1802 further includes a pair of opposing sidewalls 1804 spaced apart by the bracket elongated member 1806. In some embodiments, the pair of opposing sidewalls 1804 have an upper surface 1804*a* that is larger than a lower surface 1804*b*. In embodiments, the upper surface 1804*a* is a tear drop shape and tapers from the upper surface 1804*a* towards the lower surface 1804*b* in the system vertical direction (i.e., in the −Z direction). Further, in some embodiments, the upper surface 1804*a*, and in particular, the teardrop shape of both opposing sidewalls each include a bore 1808 configured to mount the second example bracket 1802 to the pair of elongated slots 105*a* of the pair of elongated members 105. In some embodiments, the bracket elongated member 1806 may be a unitary construction with the pair of sidewalls 1804. In other embodiments, the bracket elongated member 1806 may be connected to the pair of opposing sidewalls 1804 via a plurality of fasteners, such as bolts and nuts, rivets, screws, and/or the like.

Figure 18:
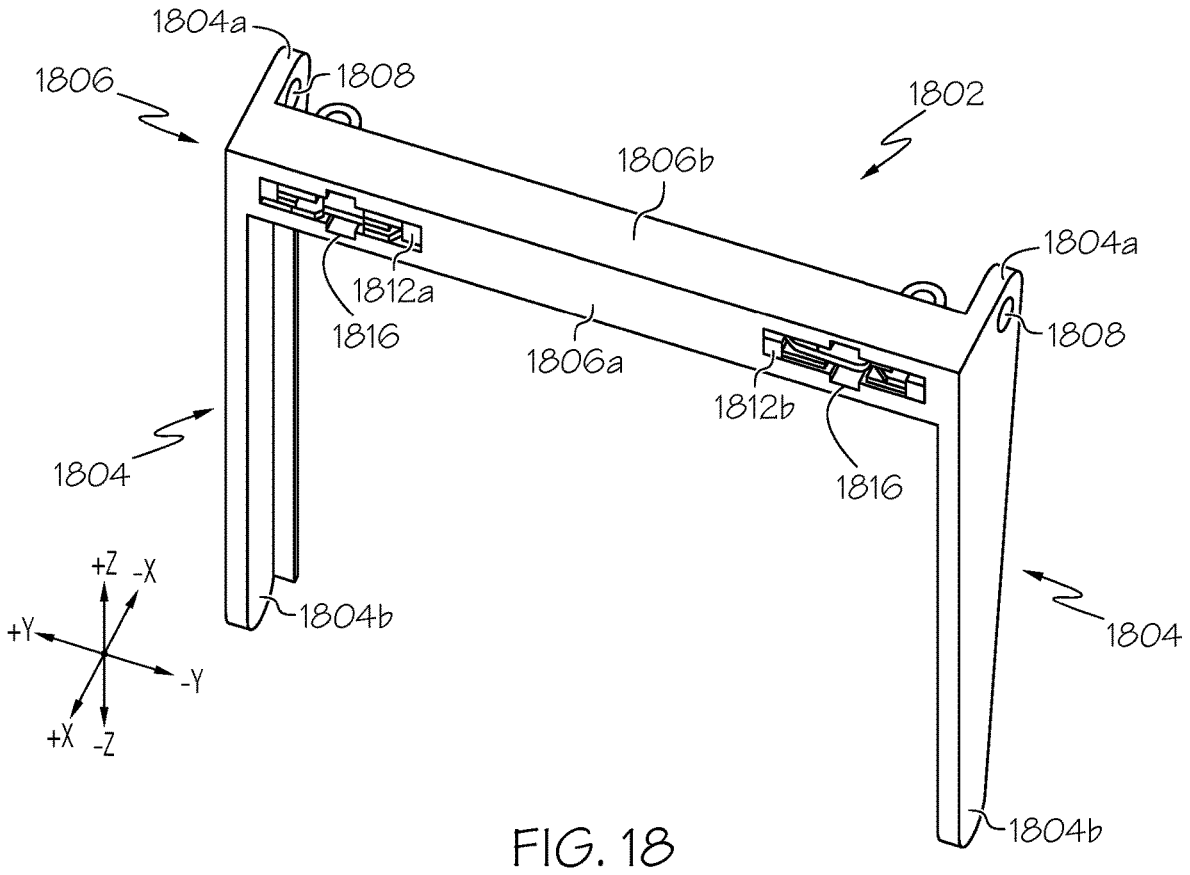
FIG. 18 schematically depicts an isolated perspective view of a third embodiment of a first example bracket according to one or more embodiments shown and described herein.
Figure 19:
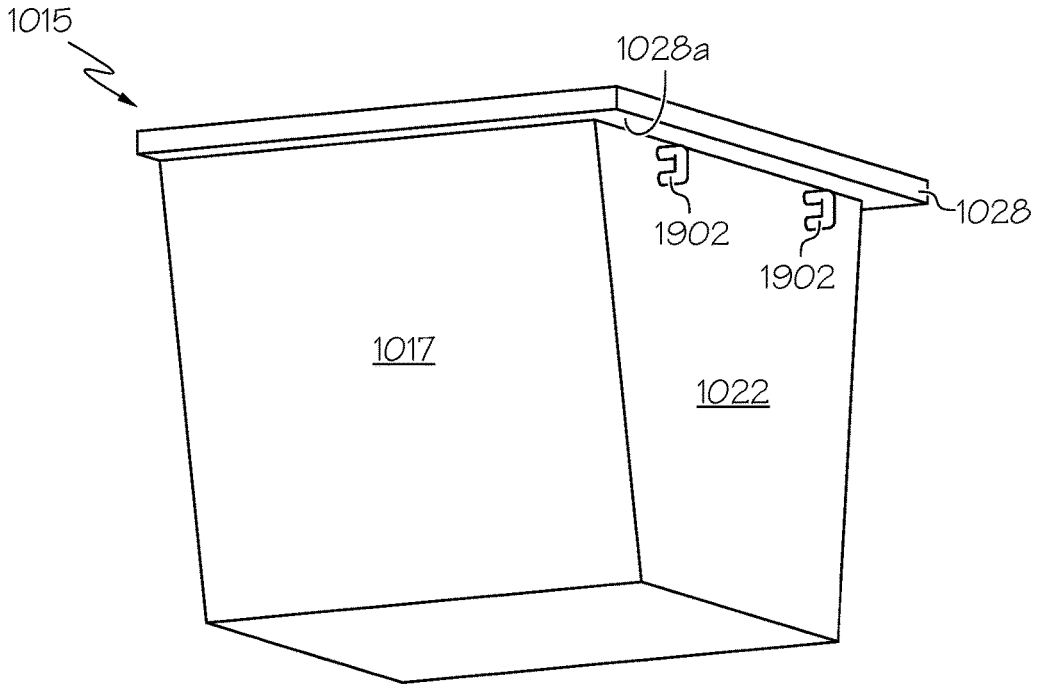
FIG. 19 schematically depicts an isolated perspective view of a third embodiment of a third example container according to one or more embodiments shown and described herein.

Referring now to FIGS. 18 and 19, disposed on the rear wall 1022 of the third example container 1015 is the pair of u-shaped members 1902. The pair of u-shaped members 1902 extend from the rear wall 1022 and below the lower surface 1028*a* of the lip portion 1028 in the system vertical direction (i.e., in the +/−Z direction) such that there is enough clearance for the pair of u-shaped members 1902 to slidably engage with the latch mechanism s. As such, the first and second lateral slots 1812*a*, 1812*b* may include recess channels 1816 that extend perpendicular or 90 degrees from the first and second lateral slots 1812*a*, 1812*b* in the system vertical direction (i.e., in the +/−Z direction). It should be appreciated embodiments are not limited to the pair of u-shaped members 1902 and that any shape may be used that is configured to engage within a depression on the bracket elongated member 1806.

The pair of u-shaped members 1902 may be formed of a metal or a material capable of supporting the third example container 1015 and any contents within the cavity 1024. As such, the pair of u-shaped members 1902 may be attached to, or integrated with, the rear wall 1022 of the third example container 1015 via any appropriate means. The pair of u-shaped members 1902 may be configured to engage with the first and second lateral slots 1812*a*, 1812*b* and lock into the first and second lateral slots 1812*a*, 1812*b* by the pair of latch mechanisms 1814 disposed within the first and second lateral slots 1812*a*, 1812*b* such that the lower surface 1028*a* of the lip portion 1028 abuts the top surface 1806*b* of the bracket elongated member 1806.

Figure 20:
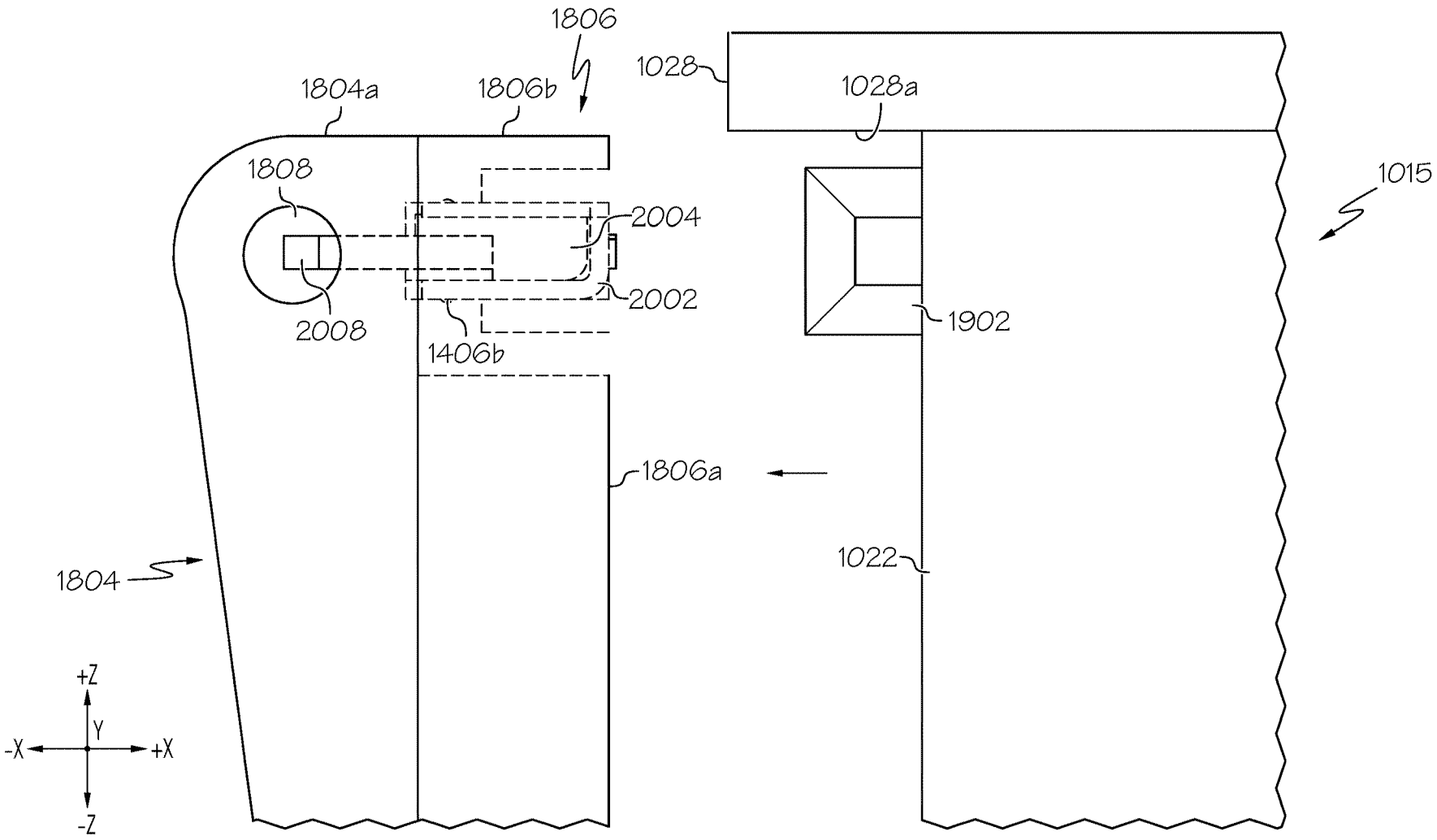
FIG. 20 schematically depicts a partial side view of a third embodiment of a latch mechanism and the third example container of FIG. 17 according to one or more embodiments shown and described herein.

With particular reference now to FIG. 20, a partial side view of one of the pair of the latch mechanisms 1814 in phantom will now be discussed. In this embodiment, each of the latch mechanisms 1814 are orientated in a system lateral direction (i.e., in the +/−Y direction) such that a third example receiving passage 2004 is oriented at the front surface 1806*a* of the bracket elongated member 1806. The latch mechanisms 1814 is generally depicted in the closed position such that a third example rotary jaw 2002 is blocking the receiving passage 2004. However, it should be appreciated that the closed position of the rotary jaw 2002 is configured to pivot or rotate upon contact with the pair of u-shaped members 1902 such that the receiving passage 2004 is available to receive the pair of u-shaped members 1902. The receiving passage 2004 is configured to accept the pair of u-shaped members 1902 of the third example container 1015. The latch mechanisms 1814 generally includes a pair of bushings 1406*a*, 1406*b* (FIG. 14) that are generally cylindrical and positioned inboard and outboard of the receiving passage 2004 in a system lateral direction (i.e., in the +/−Y direction). When the pair of u-shaped members 1902 is received within the receiving passage 2004, the rotary jaw 2002 is rotated towards the pair of sidewalls 1804 in the system lateral direction (i.e. in the +/−Y direction) such that the rotary jaw 2002 rotates about one of the pair of bushings 1406*a* (FIG. 14) to engage with the pair of u-shaped members 1902 thereby locking the pair of u-shaped members 1902 into the receiving passage 2004. Simultaneously, the rotary pawl 2008 rotates about the other bushing of the pair of bushings 1406*b* so to permit the rotary jaw 2002 to rotate and lock in the pair of u-shaped members 1902.

Figure 21A:
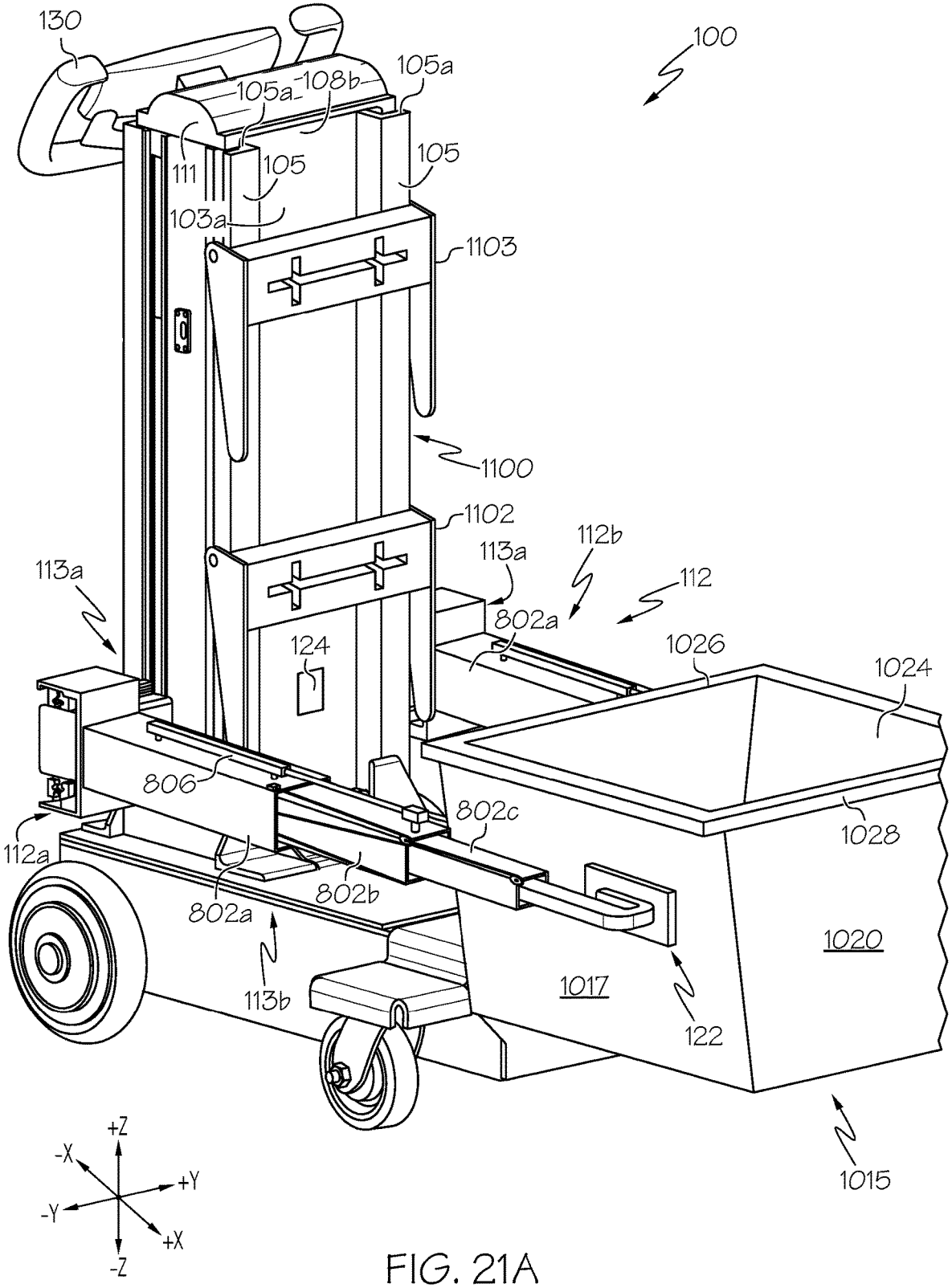
FIG. 21A depicts a perspective view of an illustrative assistive robot system gripping a container according to one or more embodiments shown and described herein.

Now referring to FIGS. 21A-21E, an example container storing motion is schematically depicted. With reference to FIG. 21A, the assistive robot system 100 is illustrated gripping the third example container 1015 by the gripping assembly 122 of each of the pair of arms 112*a*, 112*b* of the example movable arm assembly 112. It should be appreciated that the container 1015 is not limited to the third example container 1015, but may be the second example container 1010 (FIG. 10B), the first example container 1005 (FIG. 10A), and/or any other container or object shape. In the illustrated embodiment, the container 1015 begins on a floor surface. However, this is non-limiting and the container 1015 may be gripped from any height in the system vertical direction (i.e., in the +/−Z direction) that is within reach of the example gripping assembly 122 of the movable arm assembly 112 and the lifting mechanism 101.

Figure 21B:
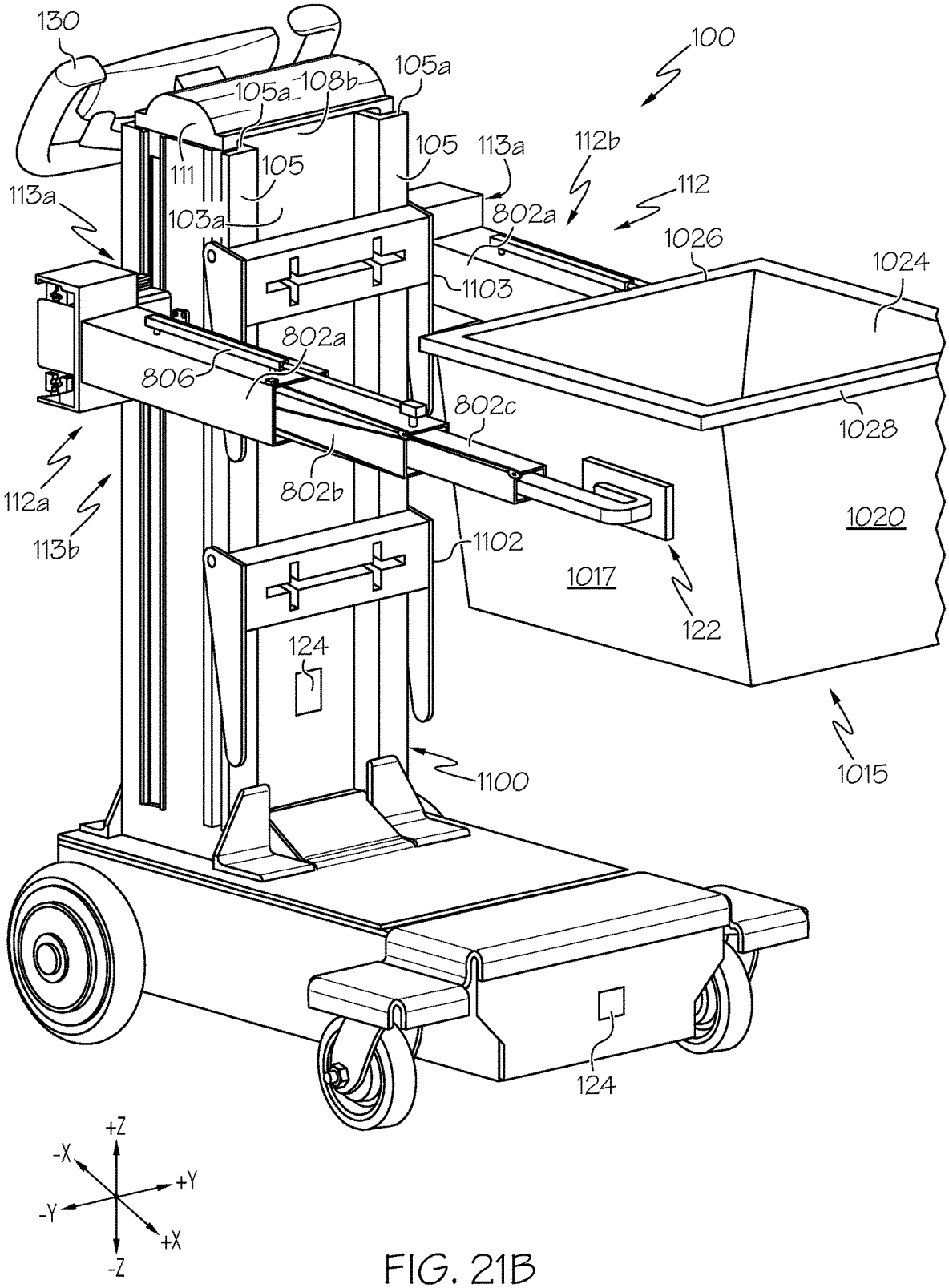
FIG. 21B depicts a perspective view of the illustrative assistive robot system of FIG. 21A raising the container in the system vertical direction according to one or more embodiments shown and described herein.

Now referring to FIG. 21B, the assistive robot system 100 is schematically depicted as raising the container 1015 in the system vertical direction (i.e., in the +/−Z direction) from the floor to a raised position. It should be appreciated that while the longitudinal telescoping assembly 113*b* of the example movable arm assembly 112 is depicted as being extended to the second position X2 (FIG. 8C), this is non-limiting and the longitudinal telescoping assembly 113*b* of the example movable arm assembly 112 may be moved (i.e. extended or retracted) to any position in the system longitudinal direction (i.e. in the +/−X direction).

Figure 21C:
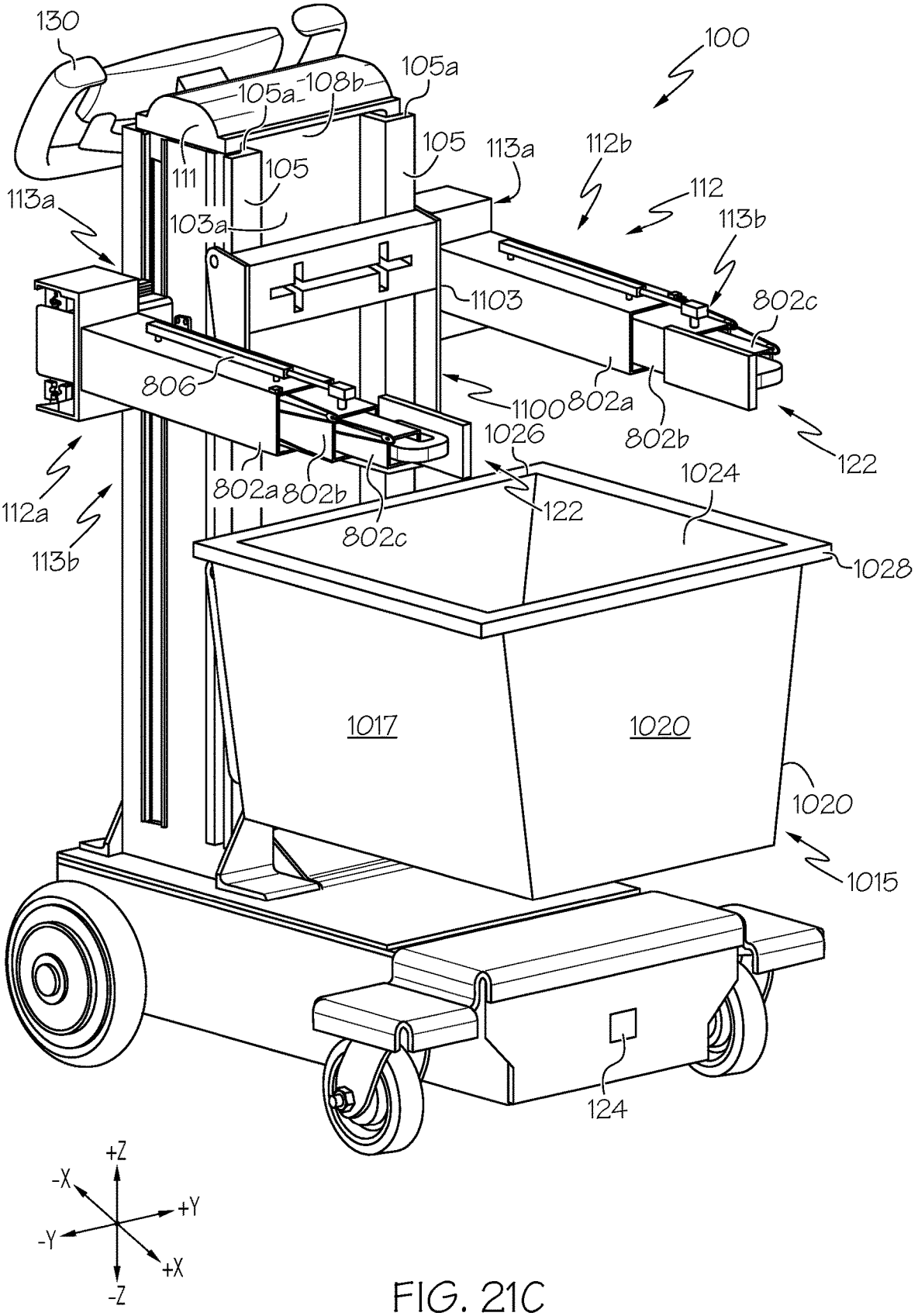
FIG. 21C depicts a perspective view of the illustrative assistive robot system of FIG. 21A storing the container according to one or more embodiments shown and described herein.

Now referring to FIG. 21C, the assistive robot system 100 is schematically depicted as positioning or docking the container 1015 in the container storage assembly 1100 by retracting the longitudinal telescoping assembly 113*b* of the example movable arm assembly 112 in the system longitudinal direction (i.e., in the +/−X direction). It should be appreciated that while the longitudinal telescoping assembly 113*b* of the example movable arm assembly 112 is depicted as being retracted to the first position X1 (FIG. 8A), this is non-limiting and the longitudinal telescoping assembly 113*b* of the example movable arm assembly 112 may be extended or retracted to any position in the system longitudinal direction (i.e. in the +/−X direction). In some embodiments, the docking or positioning of the container 1015 into the container storage assembly 1100 by the movement of the longitudinal telescoping assembly 113*b* of the example movable arm assembly 112 is based on the size of the container 1015.

Figure 21D:
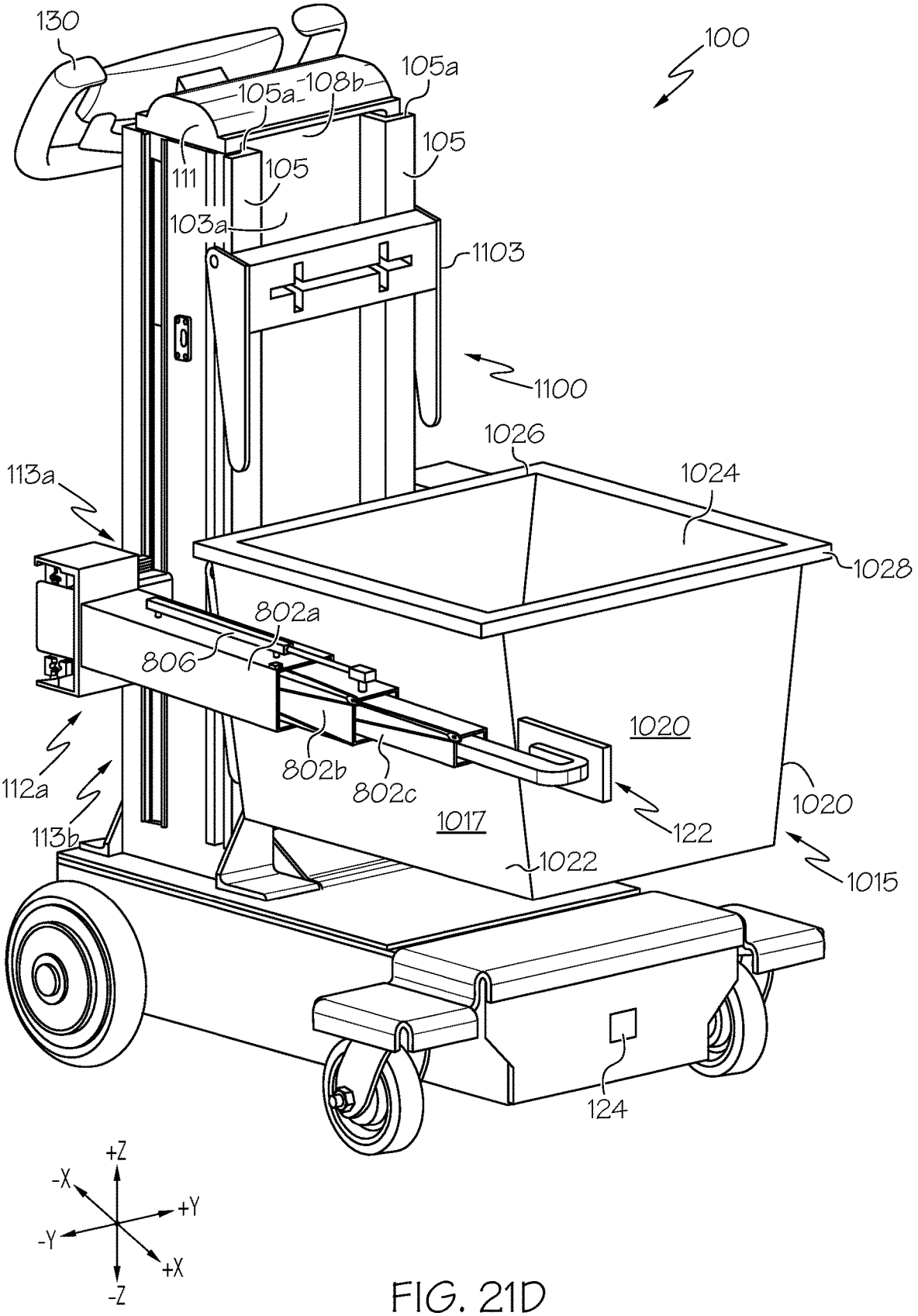
FIG. 21D depicts a perspective view of the illustrative assistive robot system of FIG. 21A extending the container in the system longitudinal direction according to one or more embodiments shown and described herein.
Figure 21E:
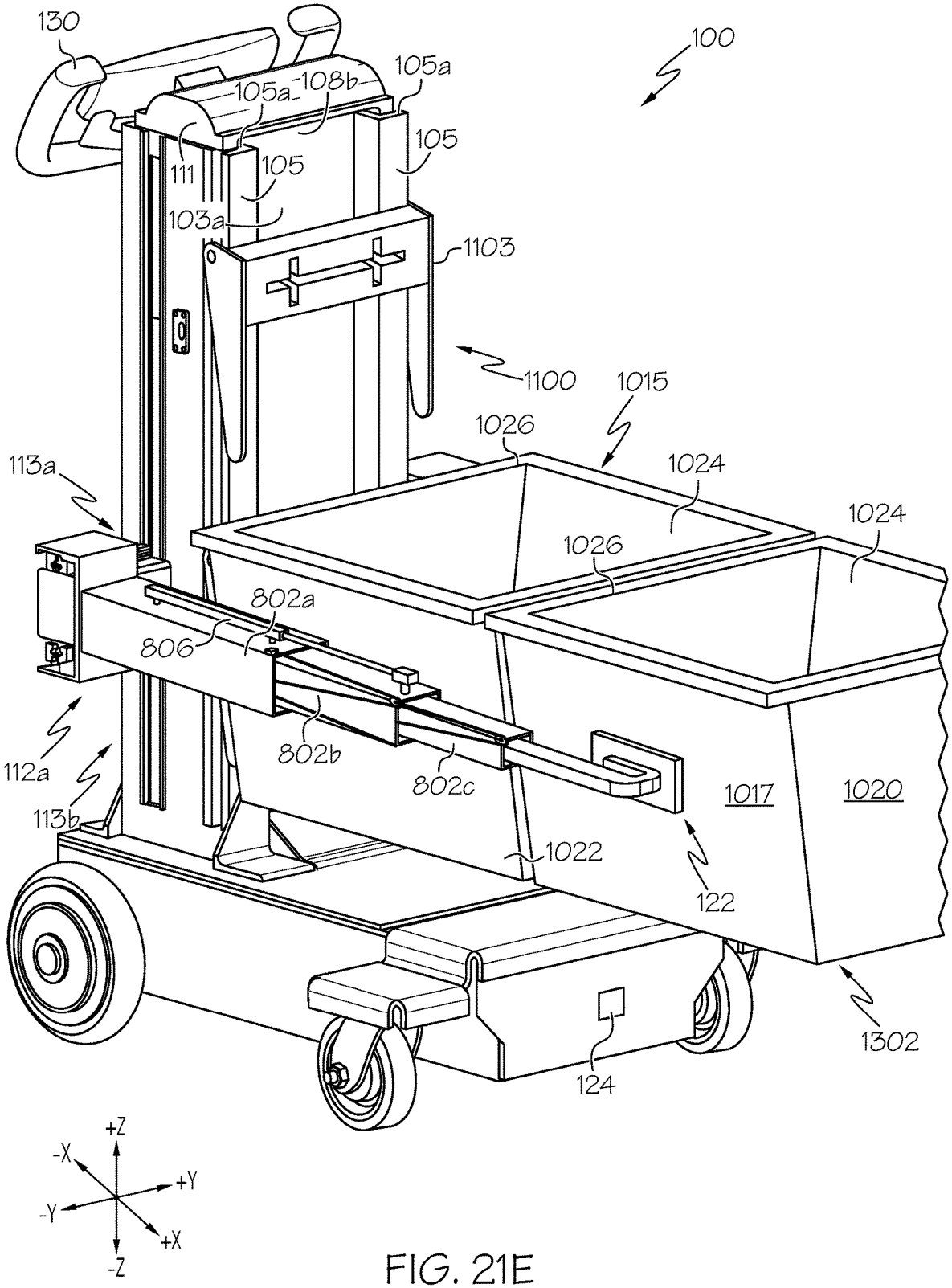
FIG. 21E depicts a perspective view of the illustrative assistive robot system of FIG. 21A releasing the container according to one or more embodiments shown and described herein.

Now referring to FIG. 21D, in some embodiments, the assistive robot system 100 is schematically depicted with the container 1015 positioned or docked onto the container storage assembly 1100 and the movable arm assembly 112 in a position to retrieve a second container 1302. The second container 1302 may be positioned somewhere on or off the assistive robot system 100 such as, without limitation, on a floor, a shelf, the second example bracket of the container storing assembly and the like Now referring to FIG. 21E, in some embodiments, the assistive robot system 100 is schematically depicted as raising the second container 1302 in the system vertical direction (i.e., in the +/−Z direction) while the first container 1015 is positioned or docked onto the container storage assembly 1100. It should be appreciated the second container 1032 may be placed, raised, lowered, tilted, and the like to any place or position, and/or may be placed onto an empty example bracket of the container storing example.

Figure 22A:
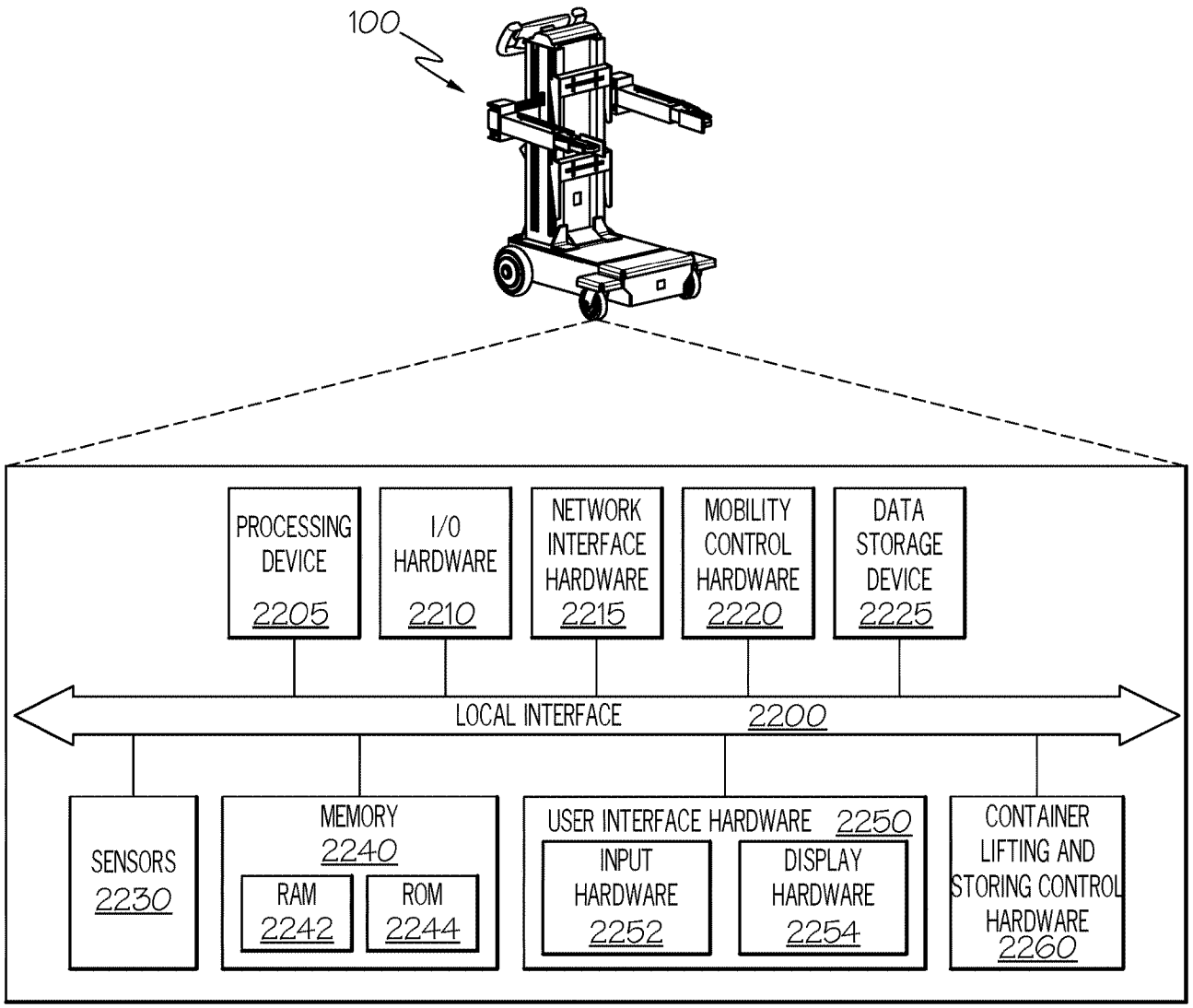
FIG. 22A schematically depicts an illustrative memory component containing illustrative logic components according to one or more embodiments shown and described herein.

Now referring to FIGS. 2 and 22A-22C, in various embodiments, the user interface device 135 and the display 140 may be integrated with one or more additional hardware components within the assistive robot system 100. FIG. 22A schematically depicts illustrative hardware components of the assistive robot system 100 that may be used to provide the functionality of the assistive robot system 100, as described herein.

The assistive robot system 100 may have a non-transitory computer-readable medium containing one or more programming instructions for completing the various processes described herein, which may be embodied as hardware, software, and/or firmware, according to embodiments shown and described herein. While in some embodiments the various components of the assistive robot system 100 may be configured as a general purpose computer with the requisite hardware, software, and/or firmware, in other embodiments, the various components of the assistive robot system 100 may also be configured as a special purpose computer designed specifically for performing the functionality described herein.

As also illustrated in FIG. 22A, the assistive robot system 100 may include a processing device 2205, I/O hardware 2210, network interface hardware 2215, mobility control hardware 2220, a data storage device 2225, one or more sensors 2230, a non-transitory memory component 2240, user interface hardware 2250, and container lifting and container storing control hardware 2260. A local interface 2200, such as a bus or the like, may interconnect the various components.

The processing device 2205, such as a computer processing unit (CPU), may be the central processing unit of the assistive robot system 100, performing calculations and logic operations to execute a program. The processing device 2205, alone or in conjunction with the other components, is an illustrative processing device, computing device, processor, or combination thereof. The processing device 2205 may include any processing component configured to receive and execute instructions (such as from the data storage device 2225 and/or the memory component 2240).

The memory component 2240 may be configured as a volatile or a nonvolatile non-transitory computer-readable medium and, as such, may include random access memory 2242 (including SRAM, DRAM, and/or other types of random access memory), read only memory (ROM) 644, flash memory, registers, compact discs (CD), digital versatile discs (DVD), and/or other types of storage components. The memory component 2240 may include one or more programming instructions thereon that, when executed by the processing device 2205, cause the processing device 2205 to complete various processes. Still referring to FIG. 22A, the programming instructions stored on the memory component 2240 may be embodied as a plurality of software logic modules, where each logic module provides programming instructions for completing one or more tasks, as described in greater detail below with respect to FIG. 22B.

The network interface hardware 2215 may include any wired or wireless networking hardware, such as a modem, LAN port, wireless fidelity (Wi-Fi) card, WiMax card, mobile communications hardware, and/or other hardware for communicating with other networks and/or devices, including the vehicle to which the assistive robot system 100 is coupled, as described herein.

The data storage device 2225, which may generally be a storage medium, may contain one or more data repositories for storing data that is received and/or generated. The data storage device 2225 may be any physical storage medium, including, but not limited to, a hard disk drive (HDD), memory, removable storage, and/or the like. While the data storage device 2225 is depicted as a local device, it should be understood that the data storage device 2225 may be a remote storage device, such as, for example, a server computing device, cloud based storage device, or the like. Illustrative data that may be contained within the data storage device 2225 is described below with respect to FIG. 6C.

Still referring to FIG. 22A, the I/O hardware 2210 may communicate information between the local interface 2200 and one or more other components of the assistive robot system 100. For example, the I/O hardware 2210 may act as an interface between the various components described with respect to FIG. 22A and other components of the assistive robot system 100, such as one or more motors or devices that drive movement and/or steering of the wheels 125. Still referring to FIG. 22A, the I/O hardware 2210 may be utilized to transmit one or more commands to the other components of the assistive robot system 100 in some embodiments.

The user interface hardware 2250 may include various hardware components for communicating with a user of the assistive robot system 100, such as, for example, input hardware 2252, and display hardware 2254. The input hardware 2252 may include devices such as, for example, a keyboard, a mouse, a joystick, a camera, a touch screen, a microphone, a wireless remote control device, and/or another device for receiving inputs from a user. The display hardware 2254 may include devices such as a video card, a monitor, and/or another device for sending and/or presenting visual data to a user. The display hardware 2254 may also incorporate audio output hardware or the like that generates and presents audible data to a user, such as spoken words, tones, and/or the like. It should be understood that the user interface hardware 2250 may be integrated with the user interface device 135 and the display 140 described herein with respect to FIG. 6.

Still referring to FIG. 22A, the mobility control hardware 2220 may be one or more hardware components for controlling movement of the various components of the assistive robot system 100, such as movement and steering of the wheels 125. Such hardware components may generally be configured to generate and transmit one or more signals to one or more motors coupled to the wheels 125 to effect movement of the wheels 125 or the like.

The one or more sensors 2230 may generally include the various sensors described herein, including the sensors included within the sensor device 124. The sensors 2230 may receive sensed information and transmit signals and/or data corresponding to the sensed information to one or more components described herein. For example, the sensors 2230 may receive images and/or image data via the sensor device 124 and generate one or more signals and/or data to transmit to the processing device 2205 for processing the data and determining control of the assistive robot system 100 for maneuvering the assistive robot system 100, lifting containers, storing containers, and/or the like, as described in greater detail herein.

The container storing control hardware 2260 may generally include one or more components for controlling movement of the movable arm assembly 112 such as an upward and downward movement thereof, an extending and retracting movement thereof, and/or a lateral inboard or outboard movement thereof so to grip, release, and/or store the container. Further, the movement may be controlled for the first tower actuator assembly 102 such as an upward and downward movement thereof. Such hardware may transmit signals to the actuator 704 (FIGS. 7A-7B), the actuator 804 (FIGS. 9A-9C), the linear actuator 806, and the lifting mechanism 101, which move accordingly.

Figure 22B:
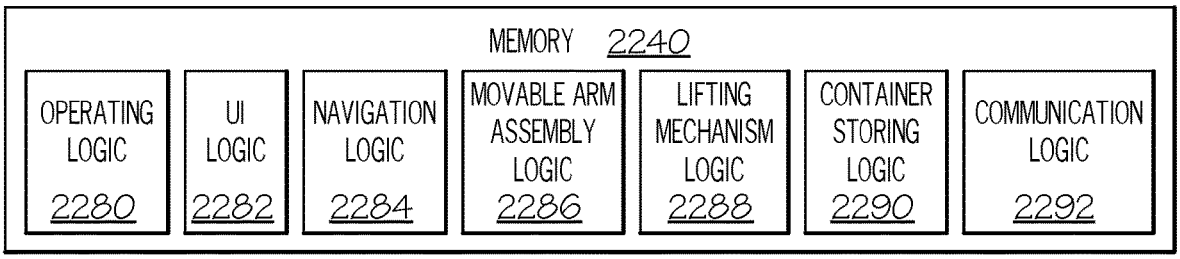
FIG. 22B schematically depicts an illustrative memory component device containing illustrative logic modules according to one or more embodiments shown and described herein.

The program instructions contained on the memory component 2240 (including the RAM 2242 and the ROM 2244) may be embodied as a plurality of software modules, where each module provides programming instructions for completing one or more tasks. For example, FIG. 22B schematically depicts the memory component 2240 containing illustrative logic components according to one or more embodiments shown and described herein. As shown in FIG. 22B, the memory component 2240 may be configured to store various processing logic, such as, for example, operating logic 2280, user interface (UI) logic 2282, navigation logic 2284, movable arm assembly logic 2286, lifting mechanism logic 2288, container storing logic 2290, and/or communication logic 2292 (each of which may be embodied as a computer program, firmware, or hardware, as an example). The operating logic 2280 may include an operating system and/or other software for managing components of the assistive robot system 100. The UI logic 2282 may include one or more programming instructions for providing a user interface to a user and receiving commands from the user. The navigation logic 2284 may include one or more programming instructions for directing movement of the assistive robot system 100, including autonomous and semiautonomous movement around a space, and/or the like, as described in greater detail herein. The movable arm assembly logic 2286 may include one or more programming instructions for directing movement of the each arm 112*a*, 112*b* of the assistive robot system 100, including autonomous and semiautonomous movement to grip a container, extend a container, place a container, and/or the like, as described in greater detail herein. The lifting mechanism logic 2288 may include one or more programming instructions for directing movement of each tower actuator assemblies 102, 104 and the telescoping sections, including autonomous and semiautonomous movement to raise and lower the movable arm assembly 112, with and without a container, and/or the like, as described in greater detail herein. The container storing logic 2290 may include one or more programming instructions for directing movement of each tower actuator assemblies 102, 104 including the telescoping sections, and the movable arm assembly 112 so to grip or release the grip of the container onto the container storage assembly 1100, including autonomous and semiautonomous movement to raise and lower the movable arm assembly 112, and/or the like, as described in greater detail herein. Further, the container storing logic 2290 may include one or more programming instructions for determining pose data of the assistive robot system including the robot itself, the location of the movable arm assembly 112, the location of the lifting mechanism 101, the location of the container storage assembly 1100 and the baskets stored thereon, and the like. The communication logic 2292 may include one or more programming instructions for communicating between the various components of the assistive robot system 100, recognizing the objects via the sensor device 124, radio frequency (RF) identification, optical imaging, and/or the like.

Figure 22C:
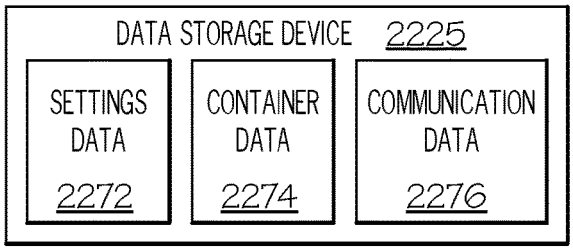
FIG. 22C schematically depicts an illustrative data storage device containing illustrative data components according to one or more embodiments shown and described herein.

FIG. 22C schematically depicts a block diagram of various data contained within a storage device (e.g., the data storage device 2225) of a computing device and/or a vehicle component according to one or more embodiments shown and described herein. As shown in FIG. 22C, the data storage device 2225 may include, for example, settings data 2272, container data 2274, and/or communication data 2276. Settings data 2272 may include, for example, data associated with particular user settings for the assistive robot system 100, such as UI preferences settings, control preferences settings, and/or the like. Container data 2274 may generally refer to a database of information relating to a plurality of containers that the assistive robot system 100 may pick-up, place somewhere, store, and/or generally transport about a space. For example, the container data 2274 may include data related to the type of container, the type of complimentary locking features, whether a container is actively being stored on the container storage assembly 1100 (FIG. 11) and/or the like. Communication data 2276 may generally be data that corresponds to communications between the various components and/or the type of container, and/or the like. For example, the communications data 2276 may include pose data for the assistive robot system 100 including the robot itself, the location of the movable arm assembly 112, the location of the lifting mechanism 101, the location of the container storage assembly 1100 and the baskets stored thereon, and the like.

It should be understood that the components illustrated in FIGS. 22A-22C are merely illustrative and are not intended to limit the scope of this disclosure. More specifically, while the components in FIGS. 22A-22C are illustrated as residing within the assistive robot system 100, this is a nonlimiting example. In some embodiments, one or more of the components may reside external to the assistive robot system 100.

As mentioned above, the various components described with respect to FIGS. 22A-22C may be used to carry out one or more processes and/or provide functionality for moving the assistive robot system 100, for guiding the movable arm assembly 112 of the assistive robot system 100, for grasping or releasing of containers, for attaching containers to the container storage assembly 1100 (FIG. 2), for detaching containers from the container storage assembly 1100 (FIG. 2), for raising and/or lowering the container via the first and second tower actuator assemblies 102, 104, and for receiving user inputs. An illustrative example of the various processes are described with respect to FIGS. 23-26 hereinbelow.

Figure 23:
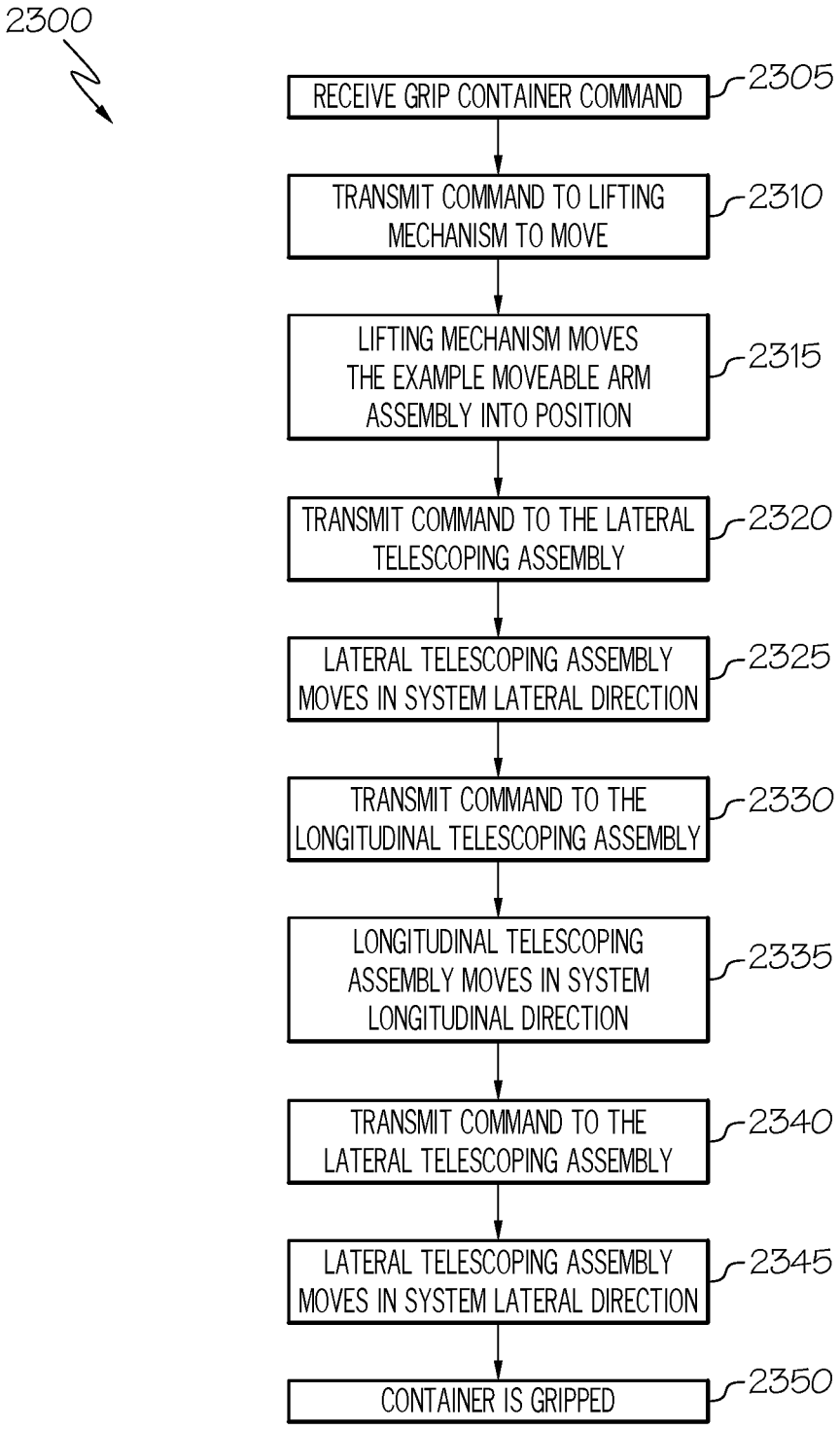
FIG. 23 depicts a flow diagram of an illustrative method of gripping a container according to one or more embodiments shown and described herein.

As previously mentioned, FIGS. 23-26 depict various non-limiting processes that may be completed by the assistive robot system 100 and/or one or more components thereof for autonomous or semiautonomous operation of the assistive robot system 100 (FIG. 2). The various processes described with respect to FIGS. 22-26 may generally be completed by the assistive robot system 100 or a component thereof, such as, for example, the processing device 2205 (FIG. 22A). FIG. 23 depicts an illustrative method of gripping a container, generally designated 2300, according to some embodiments. The various steps described with respect to FIG. 23 are merely illustrative, and additional, fewer, or alternative steps are contemplated without departing from the scope of the present disclosure. In addition, the steps described with respect to FIG. 23 are generally completed when the assistive robot system is gripping the container.

At block 2305, a grip container command may be received. The grip container command may be received via the user interface of the assistive robot system, may be received via a remote control device that transmits a wireless signal to the assistive robot system, and/or the like. It should be appreciated that the phrase "grip container" may also be understood to mean "engage container." Upon receiving such a command, a command may then be transmitted to the lifting mechanism, at block 2310, to move the example movable arm assembly into a position similar to the height in the system vertical direction (i.e., in the +/−Z direction) as the pair of sidewalls of the container to be gripped, at block 2315.

Thereafter, a command is transmitted to the lateral telescoping assembly, at block 2320, to move in the system lateral direction (i.e., in the system +Y direction) such that the example movable arm assembly has a width that is larger than the pair of sidewalls of the container to be gripped, at block 2325. For example, if the width of the container is 400 millimeters in the system lateral direction (i.e., in the +Y direction), the lateral telescoping assembly may extend 430 millimeters in the system lateral direction (i.e., in the system +Y direction) such that the example gripper assembly are wider than the container in the system lateral direction (i.e., in the +/−Y direction). It should be appreciated that this is merely an example and that the distances may vary. Further, it should be appreciated that the distances may be determined automatically by a sensing device or manually by a user controlling the lateral telescoping assembly via the user interface.

Thereafter, a command is transmitted to the longitudinal telescoping assembly, at block 2330, to move in the system longitudinal direction (i.e., in the system +Z direction) such that the example movable arm assembly moves, if required, to align with the pair of sidewalls of the container to be gripped, at block 2335. For example, if the container is 400 millimeters in front of the base of assistive robot system in the system longitudinal direction (i.e., in the +/−X direction), the longitudinal telescoping assembly may extend 430 millimeters in the system longitudinal direction (i.e., in the system +/−X direction) such that the example gripping assembly is aligned with the sidewalls of the container. It should be appreciated that this is merely an example and that the distances may vary. Further, it should be appreciated that the distances may be determined automatically by a sensing device or manually by a user controlling the longitudinal telescoping assembly via the user interface. Moreover, while not specifically described in FIG. 23, the assistive robot system may, depending on the distance of the container, transmit a signal to the drive mechanism (e.g., the one or more motors) to cause the wheels to move (i.e., towards or away from the container), thereby positioning the assistive robot system in a position so to grip the container. In another example, a signal may be transmitted to a user interface device such that the user interface device displays a command to a user that instructs the user to push or pull the assistive robot system towards or away from the container so to position the X arm manipulation portion into the proper gripping position.

Once the longitudinal telescoping assembly is in position, a command is transmitted to the lateral telescoping assembly, at block 2340, to move in the system lateral direction (i.e., in the +/−Y direction) such that the example gripping assembly makes contact with, or grips the pair of sidewalls of the container, at block 2345. As such, the container is now gripped by the assistive robot system, at block 2350. In some embodiments, confirming that the container is gripped may be verified automatically by the sensing device or manually by a user confirming via the user interface.

Figure 24A:
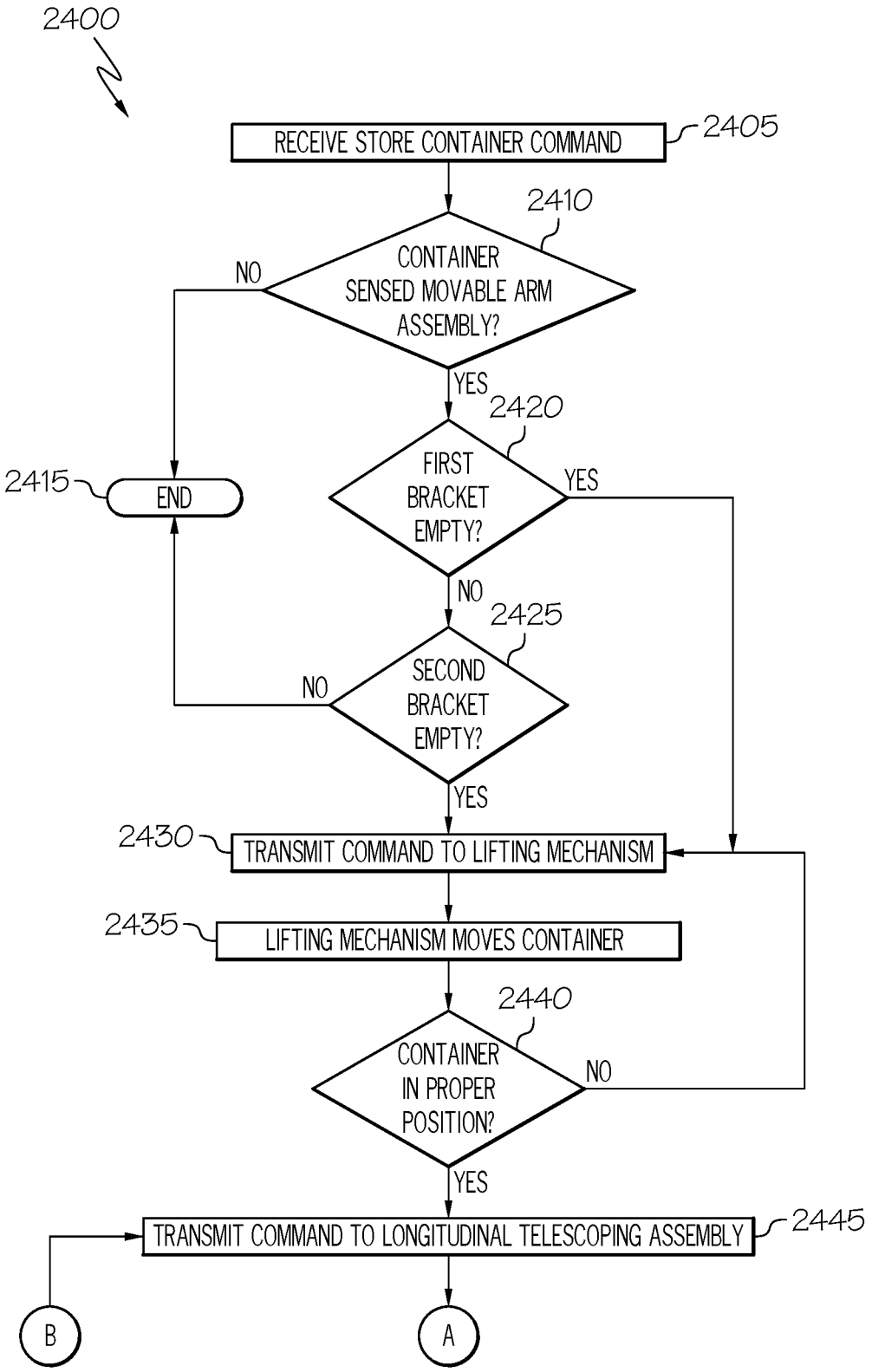
FIG. 24A depicts a flow diagram of an illustrative method of storing a container according to one or more embodiments shown and described herein.
Figure 24B:
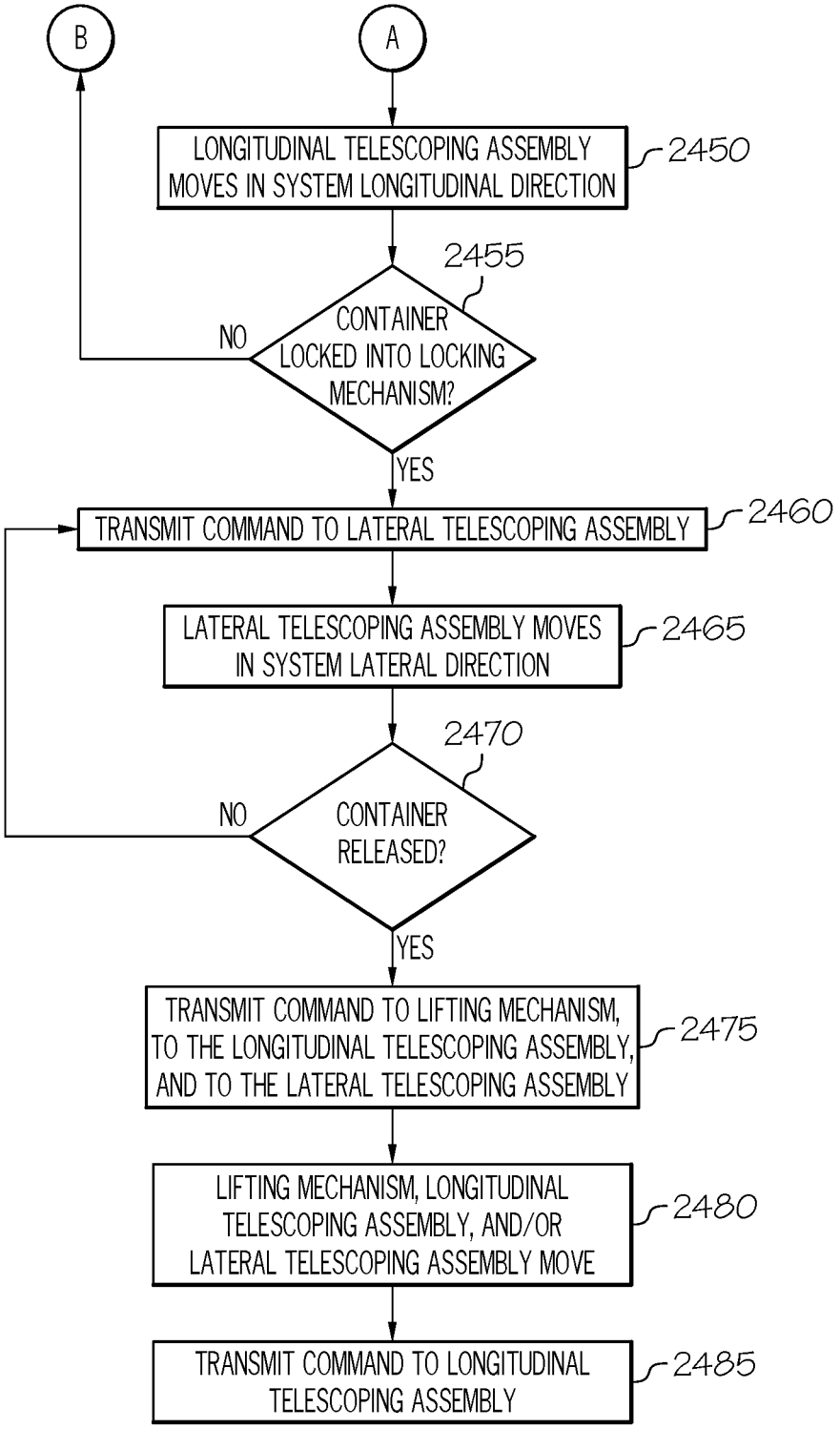
FIG. 24B depicts a continuation flow diagram from FIG. 24A of the illustrative method of storing the container according to one or more embodiments shown and described herein.

FIGS. 24A-24B depict an illustrative method of storing the container, generally designated 2400, according to some embodiments. The various steps described with respect to FIGS. 24A-24B are merely illustrative, and additional, fewer, or alternative steps are contemplated without departing from the scope of the present disclosure. In addition, the steps described with respect to FIGS. 24A-24B are generally completed when the assistive robot system has engaged the container.

At block 2405, a store container command may be received. The store container command may be received via the user interface, a sensing device, and/or the like of the assistive robot system 100, and may be received via a remote control device that transmits a wireless signal to the assistive robot system 100, and/or the like. Upon receiving such a command, a verification may be performed to ensure that the container is gripped within the movable arm assembly, at block 2410. The container gripped may be determined automatically by the sensing device or manually by a user confirming via the user interface. If the container is not gripped, the store command is ended, at block 2415. If the container is gripped, a determination is made of whether the first bracket is empty, at block 2420. Determining whether the first bracket is empty may be automatic by a sensing device or manually by a user confirming via the user interface. If the first bracket is not empty, then a determination is made of whether the second bracket is empty, at block 2425. If the second bracket is not empty, the store command is ended, at block 2415. If the first bracket is empty determined, at block 2420 or if the second bracket is empty determined, at block 2425, a command to move is transmitted to lifting mechanism, at block 2430.

In response to the command, the lifting mechanism moves the container to the proper height of the chosen empty bracket, at block 2435. At block 2440, a verification may be performed to ensure that the container is positioned properly at the height required to dock the container to the container storage assembly (i.e., the container is at a pre-dock position). If the container is not properly positioned, a command is transmitted to the lifting mechanism, at block 2430, which in turn causes the lifting mechanism to move, at block 2435. After the move of the lifting mechanism, at block 2435, the verification of the container at the proper position, at block 2440, may be performed again to ensure that the container is positioned properly. It should be appreciated that the method of blocks 2430-2440 may be performed simultaneously and continuously to properly position the container. Further, it should be appreciated that verifying whether the container is at the proper position may be determined automatically by the sensing device or manually by a user confirming via the user interface.

Once the container is positioned properly at the height required to dock the container to the container storage assembly, a command is transmitted to the longitudinal telescoping assembly, at block 2445, to move in the system longitudinal direction (i.e., in the system −X direction of FIG. 2) such that the container is locked into the locking assembly of the container storage assembly. A verification may be performed to validate whether the container is locked into the locking mechanism, at block 2450. Determining whether the container is locked into the locking mechanism may be automatic by a sensing device or manually by a user confirming via the user interface. If the verification fails, the container storage assembly of the assistive robot system may transmit a command to the longitudinal telescoping assembly, at block 2445, which in turn causes the longitudinal telescoping assembly to move in the system longitudinal direction, at block 2445, to dock the container into the locking mechanism. It should be appreciated that the method of blocks 2445-2455 may be performed simultaneously and continuously to dock the container.

Once the container is verified as locked into the locking mechanism, a command may then be transmitted to the lateral telescoping assembly, at block 2460, causing the lateral telescoping assembly to move in the system lateral direction (i.e., in the system +/−Y direction), at block 2465, such that gripping assembly no longer grips or makes contact with the pair of sidewalls of the container. Accordingly, the container is now stored in the container storage assembly. A verification may be performed to validate whether the container released from the pair of pads, at block 2470. Determining whether the container released may be automatic by a sensing device or manually by a user confirming via the user interface. If the verification fails, a command may be transmitted again to the lateral telescoping assembly, at block 2460, causing the lateral telescoping assembly to move in the system lateral direction (i.e., in the system +/−Y direction) at block 2465. Once the container release has been verified at block 2470, a command is transmitted to the lifting mechanism, the longitudinal telescoping assembly, and the lateral telescoping assembly, at block 2475. In response, the lifting mechanism, the longitudinal telescoping assembly, and/or the lateral telescoping assembly may move, at block 2480. For example, the lifting mechanism, the longitudinal telescoping assembly, and the lateral telescoping assembly may return to the home position. In other embodiments, the lifting mechanism, the longitudinal telescoping assembly, and the lateral telescoping assembly may remain in the current position and/or may move in anticipation of gripping another container from the container storage assembly or some other location.

It should be appreciated that the illustrative method 2400 is simplified for brevity reasons, but depending on the type of example container and/or the type of bracket, there may be several movements by either the lifting mechanism, the longitudinal telescoping assembly, and/or the lateral telescoping assembly to align and dock the container within the latch mechanism of the container storage assembly and/or remove the container from within the latch mechanism of the container storage assembly.

Figure 25:
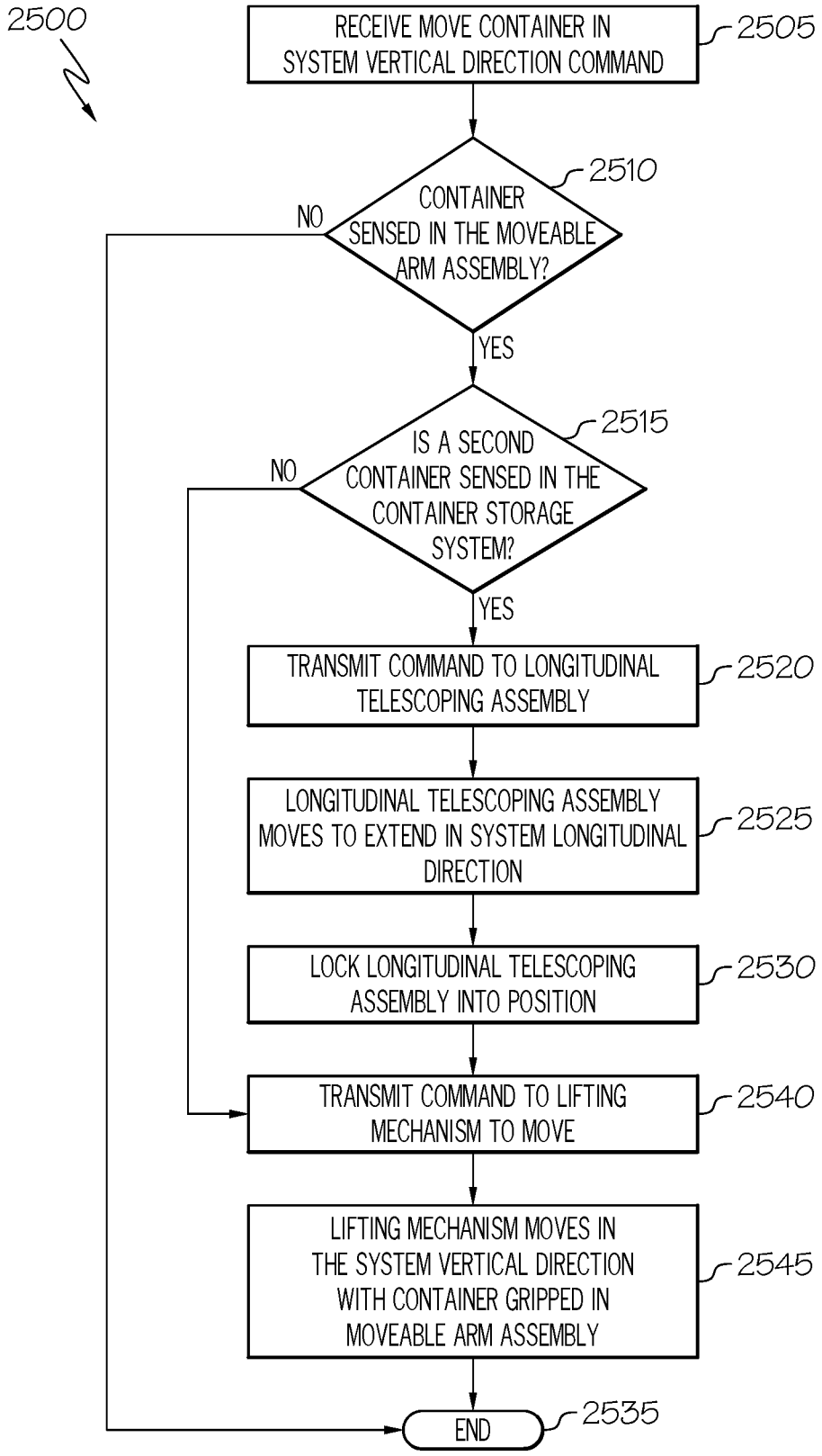
FIG. 25 depicts a flow diagram of an illustrative method of moving a container according to one or more embodiments shown and described herein.

FIG. 25 depicts an illustrative method of moving the container in the system vertical direction (i.e., in the +/−Z direction), generally designated 2500, according to some embodiments. The various steps described with respect to FIG. 25 are merely illustrative, and additional, fewer, or alternative steps are contemplated without departing from the scope of the present disclosure. In addition, the steps described with respect to FIG. 25 are generally completed when the assistive robot system has gripped the container.

At block 2505, a move container command in the system vertical direction (i.e., in the +/−Z direction) may be received. The move container command may be received via the user interface of the assistive robot system 100, may be received via a remote control device that transmits a wireless signal to the assistive robot system 100, and/or the like. Upon receiving the move container command, a verification may be performed to ensure that the container is gripped within the movable arm assembly, at block 2510. The container gripped may be determined automatically by a sensing device or manually by a user confirming via the user interface. If the container is not gripped, the move command is ended, at block 2535. If the container is gripped, a verification of whether a second container is stored in the container storage assembly is determined, at block 2515. Determining whether there is the second container stored in the container storage assembly may be automatic by a sensing device or manually by a user confirming via the user interface. Further, it should be appreciated that if the second container is stored in the container storage system, the container currently gripped in the movable arm assembly will need to move in the system vertical direction (i.e. in the +/−Z direction) around the second container stored on the container storage assembly. As such, if the second container is stored in the container storage assembly, the longitudinal telescoping section should not retract in the system longitudinal direction (i.e., in the +/−X direction) so to not interfere with the second container stored in the container storage assembly, and may have to extend in the system longitudinal direction (i.e., in the +/−X direction) to provide the necessary clearance to move the container currently gripped in the movable arm assembly out of the way of the second container. When the second container stored in the container storage assembly is sensed, at block 2515, a command is transmitted to the longitudinal telescoping assembly, at block 2520, which in turn causes the longitudinal telescoping assembly to move in the system longitudinal direction (i.e., in the +/−X direction), at block 2525. It should be appreciated that the longitudinal telescoping assembly may move into the mid position or second position X2 (FIG. 8C), as directed by the assistive robot system 100. Once into position, the assistive robot system 100 locks the longitudinal telescoping assembly into that position, at block 2530. Next, regardless of whether the second container is present in the container storage assembly, a command may then be transmitted to the lifting mechanism, at block 2540, which causes the lifting mechanism to move in the system vertical direction (i.e., in the +/−Z direction) with the container gripped in the movable arm assembly, at block 2545. In should be appreciated that the movement of the container may be to place the container into the container storage assembly, to raise the container into a position similar to the height of the place that the container will be released, lower the container to a height to be released, and the like. It should also be appreciated that the height of the release may be a predetermined height based on the type of container or a preprogrammed selection that may be chosen by the user via the user interface. Further, it should be appreciated that the release height may be determined automatically by the sensing device. Moreover, while not specifically described in FIG. 25, the assistive robot system may, depending on the distance of the release point from the assistive robot system, transmit a signal to the drive mechanism, (e.g., the one or more motors) to cause the wheels to move (i.e., towards or away from the container), thereby positioning the assistive robot system in a position so to release the container. In another example, a signal may be transmitted to a user interface device such that the user interface device displays a command to a user that instructs the user to push or pull the assistive robot system towards or away from the release point so to position the container into the proper releasing position.

Figure 26:
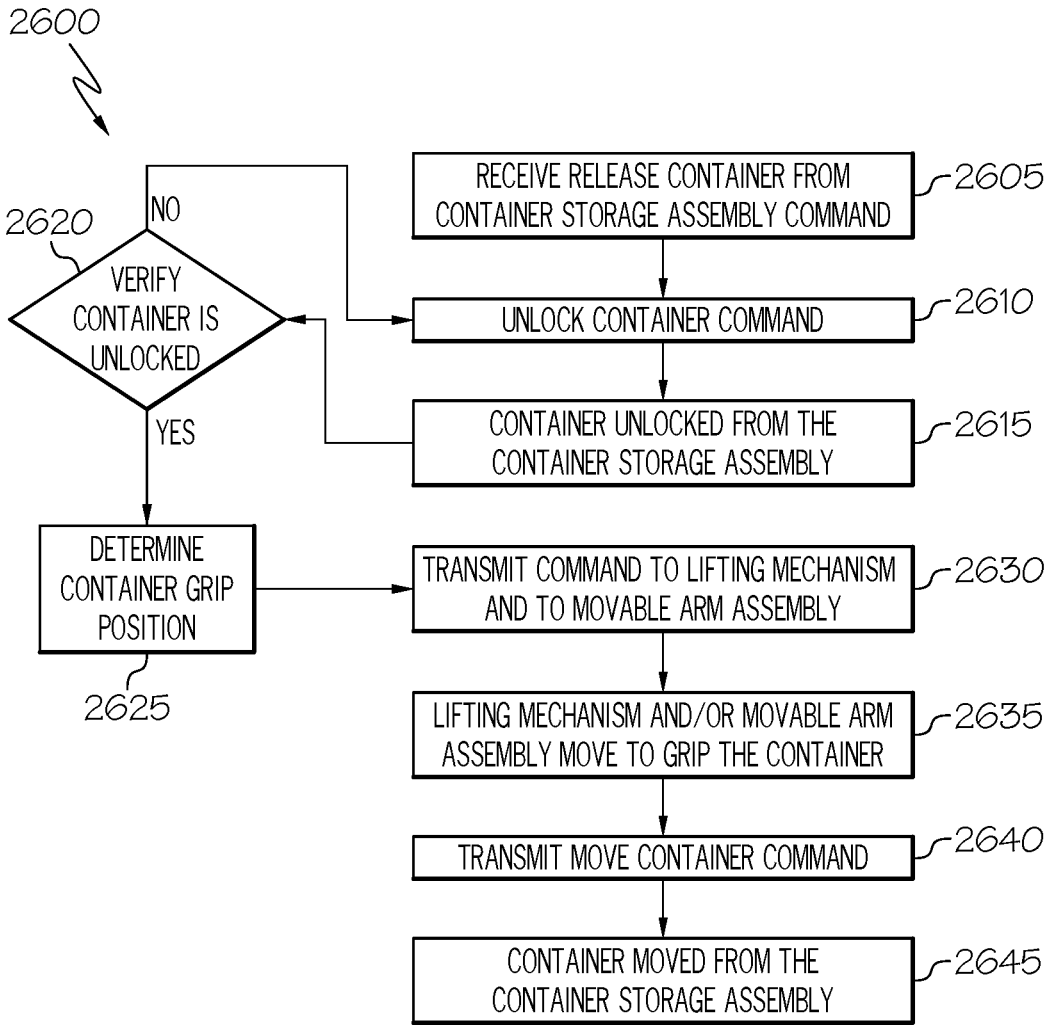
FIG. 26 depicts a flow diagram of an illustrative method of releasing a container from a container storage assembly according to one or more embodiments shown and described herein.

FIG. 26 depicts an illustrative method of releasing the container from the container storage assembly, generally designated 2600, according to some embodiments. The various steps described with respect to FIG. 26 are merely illustrative, and additional, fewer, or alternative steps are contemplated without departing from the scope of the present disclosure. In addition, the steps described with respect to FIG. 26 are generally completed when the assistive robot system has released the container.

At block 2605, a release container from the container storage assembly command may be received. The release container command may be received via the user interface of the assistive robot system, may be received via a remote control device that transmits a wireless signal to the assistive robot system, and/or the like. Upon receiving such a command, an unlock container command may be transmitted, at block 2610, which causes the container to be unlocked from the container storage assembly. The container unlock may be performed automatically by the movable arm assembly in conjunction with the lifting mechanism, if needed, or may be performed by the user, at block 2615. A verification that the container is unlocked may be performed at block 2620. The verification may be performed automatically by the sensing device or manually by a user confirming via the user interface. If the container is not released the unlock container command is again transmitted, at block 2610, which causes the container to be unlocked automatically by the movable arm assembly in conjunction with the lifting mechanism, if needed, or may be unlocked by the user, at block 2615. It should be appreciated that the method of blocks 2610-2620 may be performed simultaneously to properly unlock the container from the container storage assembly.

Once the container is verified as being released, a container grip position is determined, at block 2625. The container grip position may be determined automatically by the sensing device or manually by the user confirming via the user interface. After the container grip position is determined, the assistive robot system transits a command to the lifting mechanism and to the movable arm assembly, at block 2630, which causes the lifting mechanism and/or the movable arm assembly to move to the container grip position such that the movable arm assembly grips the container, at block 2635. It should be appreciated that the lateral telescoping assembly and the longitudinal telescoping assembly may move to grip the container and the determined grip position and that the lateral telescoping assembly and the longitudinal telescoping assembly may be moved by the lifting mechanism to obtain the proper position of the determined container grip position.

Once the movable arm assembly grips the container, a command to move the container is transmitted, at block 2640. In response the movable arm assembly and/or the lifting mechanism moves the container from the container storage assembly, at block 2645. It should be appreciated that the container is free to be moved to another location, transported to another area, placed again somewhere on the container storage assembly, and/or the like.

Figure 27:
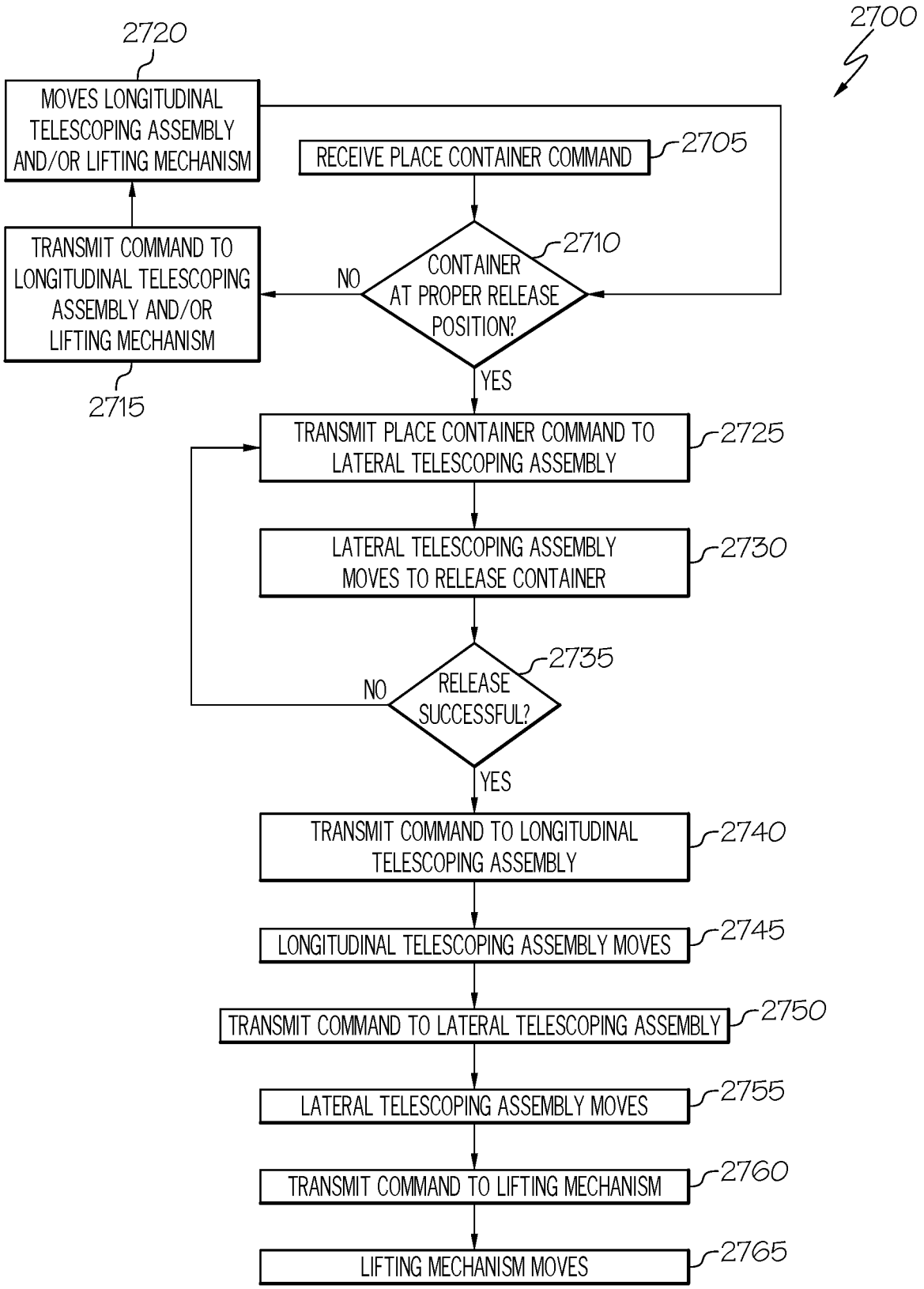
FIG. 27 depicts an illustrative method of placing the container according to one or more embodiments shown and described herein.

FIG. 27 depicts an illustrative method of placing the container, generally designated 2700, according to some embodiments. The various steps described with respect to FIG. 27 are merely illustrative, and additional, fewer, or alternative steps are contemplated without departing from the scope of the present disclosure. In addition, the steps described with respect to FIG. 27 are generally completed when the assistive robot system has released the container.

At block 2705, a place container command may be received. The place container command may be received via the user interface of the assistive robot system, may be received via a remote control device that transmits a wireless signal to the assistive robot system, and/or the like. Upon receiving such a command, a verification may be performed to ensure that the container is at the proper release position at block 2710. The container release position may be determined automatically by the sensing device or manually by a user confirming via the user interface. If the container is not at the proper release position, a command is transmitted to the longitudinal telescoping assembly and/or the lifting mechanism, at block 2715, which in turn causes the longitudinal telescoping assembly and/or the lifting mechanism to move at block 2720. It should be appreciated that the method of blocks 2710-2720 may be performed simultaneously to properly position the container at the proper release position. Moreover, in some embodiments, if the container is not at the proper release position, a signal may be transmitted to the drive mechanism (e.g., the one or more motors) to cause the wheels to move (i.e., away from the container and/or shelf), thereby positioning the assistive robot system in a position neat the release position. In another example, a signal may be transmitted to a user interface device such that the user interface device displays a command to a user that instructs the user to push or pull the assistive robot to the release position.

Once the container is in the proper release position, a place container command is transmitted, at block 2725, that causes the lateral telescoping assembly to move in the system lateral direction (i.e., in the system +/−Y direction) such that the example gripping assembly no longer make contact with, or grips the pair of sidewalls of the container, at block 2730. As such, the container is now released or placed by the assistive robot system. For example, the container may now be placed on a shelf that is higher in the system vertical direction (i.e., in the +/−Z direction) then the height where the container was gripped, placed at a lower position in the system vertical direction (i.e., in the +/−Z direction) and/or placed on the assistive robot system. The release of the container is verified at block 2735. The container release verification may be automatically performed by the sensing device or manually performed by the user confirming via the user interface. If the release of the container was not successful, the place container command may again be transmitted to the lateral telescoping assembly at block 2725 causing the lateral telescoping assembly to again move at block 2730.

If the release was successful, thereafter, a command is transmitted to the longitudinal telescoping assembly at block 2740 that causes the longitudinal telescoping assembly to move such that the example gripping assembly is clear of the container and the place of release, such as the shelf, at block 2745. Moreover, depending on the distance of the container at the release position or the shelf, a signal may be transmitted to the drive mechanism (e.g., the one or more motors) to cause the wheels to move (i.e., away from the container and/or shelf), thereby positioning the assistive robot system in a position away from the container and/or shelf. In another example, a signal may be transmitted to a user interface device such that the user interface device displays a command to a user that instructs the user to push or pull the assistive robot system away from the container and/or the shelf.

A command may then be transmitted to the lateral telescoping assembly at block 2750 causing the lateral telescoping assembly to move in the system lateral direction (i.e., in the system +/−Y direction) such that the lateral telescoping assembly moves at block 2755. A command may then be transmitted to the lifting mechanism, at block 2760, which causes the lifting mechanism to move, at block 2765.

It should now be understood that the assistive robot systems described herein are configured to grip, raise, place, retrieve and store containers on itself. Further the assistive robot systems described herein generally include various components that grip, place, retrieve, and store containers, as well as various components that allow for communications to a user while performing the gripping, raising, lowering, storing, and placing of containers. Further, it should now be understood that the assistive robot systems described herein positively lock the containers onto the robot using various complimentary geometric shapes.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

The invention claimed is:

1. An assistive robotic system for transporting a container, the system comprising:

a lifting mechanism;

a container storage assembly coupled to the lifting mechanism, the container storage assembly comprising at least one bracket assembly;

a movable arm assembly coupled to the lifting mechanism and positioned to extend beyond the container storage assembly in a system lateral direction;

a processing device communicatively coupled to the lifting mechanism and the movable arm assembly; and a non-transitory, processor-readable storage medium in communication with the processing device, the non-transitory, processor-readable storage medium comprising one or more programming instructions that, when executed, cause the processing device to:

transmit a command to the lifting mechanism to cause the lifting mechanism to move the movable arm assembly such that the movable arm assembly grips the container, transmit one or more signals to the movable arm assembly to cause the movable arm assembly to move in a system longitudinal direction such that the container gripped by the movable arm assembly is positioned at the at least one bracket assembly of the container storage assembly, and transmit one or more signals to the movable arm assembly to cause the movable arm assembly to move such that the container gripped by the movable arm assembly is released from the movable arm assembly and stored on the at least one bracket assembly of the container storage assembly as a stored container.

2. The system of claim 1 wherein:

the at least one bracket assembly further comprising a bracket elongated member, wherein:

the bracket elongated member comprises a surface having at least one slot;

the at least one bracket assembly further comprises a locking mechanism within the at least one slot; and the at least one slot and the locking mechanism are configured to slidably receive and positively lock at least one locking member of the container.

3. The system of claim 2, wherein:

the surface of the bracket elongated member comprises at least one groove in a system lateral direction, the at least one slot comprises a first vertical slot and a second vertical slot both extending in a system vertical direction and intersects the at least one groove, the second vertical slot is separated from the first vertical slot, the at least one groove extends between the first vertical slot and the second vertical slot, and the at least one groove is configured to receive the at least one locking member of the container.

4. The system of claim 3, wherein the at least one locking member of the container is configured as a rod member extending from a surface of the container.

5. The system of claim 3, wherein:

the at least one groove comprises a first groove that intersects the first vertical slot and a second groove that intersects the second vertical slot, and the at least one locking member of the container is at least one u-shaped member extending from a surface of the container.

6. The system of claim 3, wherein the surface having at least one slot is a top surface of the bracket elongated member that faces the system vertical direction, the at least one slot is configured to receive the at least one locking member of the container, the at least one locking member of the container is at least one u-shaped member extending from a lip surface of the container.

7. The system of claim 1, wherein the one or more programming instructions that, when executed, cause the processing device to:

transmit a command to the movable arm assembly such that the stored container in the container storage assembly is unlocked from the container storage assembly, transmit a command to the lifting mechanism to cause the lifting mechanism and the movable arm assembly to move the movable arm assembly such that the stored container is gripped by the movable arm assembly, and transmit one or more signals to the lifting mechanism and to the movable arm assembly to cause the lifting mechanism and the movable arm assembly to move such that the stored container gripped by the movable arm assembly is released from the container storage assembly.

8. An assistive robotic system for transporting a container, the assistive robotic system comprising:

a drive mechanism comprising a motor;

one or more wheels coupled to the drive mechanism that drives movement of the one or more wheels;

a lifting mechanism coupled to the drive mechanism;

a container storage assembly coupled to the lifting mechanism, the container storage assembly comprising at least one bracket assembly;

a movable arm assembly coupled to the lifting mechanism and positioned to extend beyond the container storage assembly in a system lateral direction;

a processing device communicatively coupled to the lifting mechanism, the movable arm assembly and the drive mechanism; and a non-transitory, processor-readable storage medium communicatively coupled to the processing device, the non-transitory, processor-readable storage medium comprising one or more programming instructions stored thereon that, when executed by the processing device, cause the processing device to:

determine a grip position of the container to receive the movable arm assembly, generate at least one movement command that corresponds to one or more movements for the drive mechanism, the lifting mechanism and the movable arm assembly wherein the one or more movement commands correspond to the movement command to grip the container, transmit one or more movement commands to the movable arm assembly and the lifting mechanism, wherein the one or more movement commands correspond to the movement command to move the container to a pre-dock position, determine a storage position of the container within the container storage assembly, transmit one or more movement commands to the movable arm assembly and the lifting mechanism, wherein the one or more movement commands correspond to the movement command to dock the container within the container storage assembly, and generate at least one movement command to the movable arm assembly and the lifting mechanism, wherein the one or more movement commands correspond to the movement command to release the container.

9. The assistive robotic system of claim 8, wherein the one or more programming instructions that, when executed, cause the processing device to:

determine a stored grip position of the container stored in the container storage assembly to receive the movable arm assembly, generate at least one movement command that corresponds to one or more movements for the lifting mechanism and the movable arm assembly wherein the one or more movement commands correspond to the movement command to release the container from the container storage assembly and to grip the container, and transmit one or more movement commands to the movable arm assembly, the lifting mechanism and the drive mechanism, wherein the one or more movement commands correspond to the movement command to move the container from the container storage assembly.

* * * * *